US009932169B2

(12) United States Patent
Kraft

(10) Patent No.: US 9,932,169 B2
(45) Date of Patent: Apr. 3, 2018

(54) LOCKING MECHANISM FOR A COLLAPSIBLE CONTAINER

(71) Applicant: COMPACT CONTAINER SYSTEMS LLC, Boca Raton, FL (US)

(72) Inventor: Joshua J. Kraft, Tequesta, FL (US)

(73) Assignee: Compact Container Systems LLC, Boca Raton, FL (US)

( * ) Notice: Subject to any disclaimer, the term of this patent is extended or adjusted under 35 U.S.C. 154(b) by 0 days.

(21) Appl. No.: 14/490,992

(22) Filed: Sep. 19, 2014

(65) Prior Publication Data

US 2015/0069051 A1 Mar. 12, 2015

Related U.S. Application Data

(63) Continuation-in-part of application No. 13/815,638, filed on Mar. 13, 2013.

(51) Int. Cl.
*B65D 6/00* (2006.01)
*B65D 88/52* (2006.01)

(52) U.S. Cl.
CPC ..... *B65D 88/522* (2013.01)

(58) Field of Classification Search
CPC .... B65D 88/52; B65D 88/522; B65D 88/528; B65D 90/08; B65D 2590/666; B65D 88/526
USPC ..... 220/6, 1.5
See application file for complete search history.

(56) References Cited

U.S. PATENT DOCUMENTS

| | | | | |
|---|---|---|---|---|
| 3,403,806 | A | 10/1968 | Pohl | |
| 3,612,330 | A | 10/1971 | Baer | |
| 3,866,365 | A | 2/1975 | Honigman et al. | |
| 4,099,640 | A | 7/1978 | Nessfield et al. | |
| 4,240,359 | A | 12/1980 | Howe | |
| 4,319,732 | A * | 3/1982 | Godfrey | B65D 88/022 108/53.1 |
| 4,726,486 | A | 2/1988 | Masuda | |
| 5,732,839 | A | 3/1998 | Schimmang et al. | |
| 5,755,472 | A * | 5/1998 | Clive-Smith | B65D 88/129 108/53.1 |
| 6,866,160 | B2 | 3/2005 | Wang | |
| 7,874,107 | B1 | 1/2011 | Medley et al. | |
| 7,931,164 | B2 | 4/2011 | Krohn | |
| 7,984,819 | B1 | 7/2011 | Davis | |
| 8,646,638 | B2 * | 2/2014 | Buskermolen | B65D 88/522 220/1.5 |

(Continued)

FOREIGN PATENT DOCUMENTS

| | | |
|---|---|---|
| CN | 103204330 A | 7/2013 |
| CN | 103619732 A | 3/2014 |

(Continued)

OTHER PUBLICATIONS

International Search Report with Written Opinion dated Jul. 18, 2014 in Application No. PCT/US2014/026191, 11 pages.

(Continued)

*Primary Examiner* — Andrew T Kirsch
*Assistant Examiner* — Don M Anderson
(74) *Attorney, Agent, or Firm* — Lathrop Gage L.L.P.

(57) ABSTRACT

A foldable shipping container is provided. The foldable shipping container has improved locking mechanisms on the inside and outside of the shipping container to improve assembly and disassembly of the container.

6 Claims, 94 Drawing Sheets

(56) References Cited

U.S. PATENT DOCUMENTS

| | | | | |
|---|---|---|---|---|
| 2006/0043090 | A1* | 3/2006 | Ferrini | B65D 88/522 220/6 |
| 2008/0029510 | A1 | 2/2008 | Fisk | |
| 2008/0135545 | A1 | 6/2008 | Sadkin et al. | |
| 2010/0025397 | A1 | 2/2010 | Krohn | |
| 2010/0025398 | A1 | 2/2010 | Krohn | |
| 2010/0102056 | A1 | 4/2010 | Bellehumeur et al. | |
| 2012/0006816 | A1 | 1/2012 | Turnquist | |
| 2012/0048846 | A1 | 3/2012 | Choi | |
| 2012/0248105 | A1 | 10/2012 | Leong | |
| 2012/0318811 | A1 | 12/2012 | Leasure | |
| 2013/0020316 | A1 | 1/2013 | Hong | |
| 2013/0180981 | A1 | 7/2013 | Meijers et al. | |
| 2014/0144907 | A1 | 5/2014 | Giesbers et al. | |
| 2014/0144920 | A1 | 5/2014 | Meijers et al. | |
| 2014/0183186 | A1 | 7/2014 | Buskermolen et al. | |
| 2014/0299596 | A1 | 10/2014 | Kochanowski | |

FOREIGN PATENT DOCUMENTS

| | | | |
|---|---|---|---|
| CN | 203473630 | U | 3/2014 |
| DE | 102013100260 | A1 | 7/2013 |
| NL | 2007607 | C | 4/2012 |
| NL | 2009992 | C | 9/2013 |
| WO | 0140064 | A1 | 6/2001 |
| WO | 2012057616 | A1 | 5/2012 |
| WO | 2012154036 | A1 | 11/2012 |

OTHER PUBLICATIONS

Non-Final Office Action dated Jan. 5, 2015 in U.S. Appl. No. 13/815,638, 12 pages.
International Search Report with Written Opinion dated Feb. 6, 2015 in Application No. PCT/US2014/062092, 10 pages.
U.S. Appl. No. 13/815,638, filed Mar. 13, 2013, 150 pages.
U.S. Appl. No. 62/052,614, filed Sep. 19, 2014, 35 pages.
U.S. Appl. No. 14/587,074, filed Dec. 31, 2014, 186 pages.
U.S. Appl. No. 14/581,383, filed Dec. 23, 2014, 181 pages.
U.S. Appl. No. 13/815,638, Final Office Action dated Aug. 9, 2015, 11 pages.
International Search Report with Written Opinion dated Apr. 15, 2015 in Application No. PCT/US2014/062001, 11 pages.
U.S. Appl. No. 62/052,614, filed Sep. 19, 2014, 39 pages.
Search Report re PCT/US2014/026191, dated Jul. 18, 2014., 11 pages.
U.S. Appl. No. 13/815,638, Final Office Action dated Sep. 20, 2016, 22 pages.
U.S. Appl. No. 13/815,638 Non-Final Office Action dated, Apr. 22, 2016, 18 pages.
Chinese Application No. 201520430322, Notice of Grant, dated Jan. 8, 2016, 2 pages.

* cited by examiner

LOCKING MECHANISM FOR A COLLAPSIBLE CONTAINER

CROSS-REFERENCE TO RELATED APPLICATIONS

This is a continuation-in-part of U.S. patent application Ser. No. 13/815,638, filed on Mar. 13, 2013.

TECHNICAL FIELD

The present invention relates generally to a shipping container. More specifically the present invention relates to improvements in locking mechanisms for a collapsible shipping container.

BACKGROUND OF THE INVENTION

The shipping industry uses large cargo containers to ship cargo from one location to another in domestic and global commerce. Such containers are designed to be conveniently moved from one mode of transport to another across the land by road or on rail or over the sea. Such containers are sometimes referred to as "intermodal shipping containers". The use of such containers has essentially eliminated the need for manually transferring cargo from one vessel to another, or from one vehicle or railcar to another in the effort to deliver the cargo to its final destination.

Today, cargo containers are generally standardized by internationally recognized standards, and by national domestic standards with respect to dimensions and structure. Thus, the standard containers can be securely arranged in vertical stacks in side-by-side and end-to-end relationship with each other, and can be handled most effectively when transferring from one mode of transport to another.

Often, these containers must be transported empty from one delivery point to the next location where cargo is available for shipment. Transport of empty containers costs the shipper money and erodes profits since transport of each such container incurs handling cost and occupies valuable space which could otherwise be used to ship a revenue producing container loaded with cargo. Additionally, the shipping of both loaded and empty containers creates problems such as how to arrange the lighter, empty containers and the heavier, loaded containers aboard ships in such a manner that the safety of the ships is not compromised. Beyond safety issues, the shipment of empty containers causes monetary losses for shippers, losses which result in either substantial financial impact on the shipper, or increased charges to customers for the handling and transport of loaded containers. Similar cost disadvantages apply when shipping empty containers over road or by rail.

Long ago shippers recognized that significant economic savings in shipping could be realized if empty containers could be "folded" so as to occupy a substantially smaller space, so that less space need be sacrificed in the transporting of empty containers. Such an effort presently exists only for the "open frame" or flat rack type containers. To that end, the prior art proposed many foldable or nesting cargo containers of the enclosed types intended to reduce the space required for their shipment when empty. While such prior art foldable containers have been proposed, the market has not embraced the prior art containers as a substitute for the standard, non-foldable cargo containers.

One common shortcoming in most foldable container designs is that structural features are incorporated in them which render the designs nearly incompatible for use in combination with existing, standard cargo containers. Accordingly, if these cargo containers were to become a part of the norm, they could not be used with existing standard containers, making the cost of implementation of these designs impractical, if not prohibitive.

Another shortcoming of foldable containers of the prior art is the use of external locking mechanisms for securing the container in an erect position and the potential safety and security measures such a design leaves vulnerable.

SUMMARY

The present invention discloses a system for collapsible shipping containers. More specifically, in an embodiment of the present invention an internal locking system for a collapsible container is provided. The internal locking system comprises a plurality of locking plate assemblies for securing the container front panel and door panel to corner posts and a plurality of lever latch assemblies positioned along an internal face of one or more side panels for coupling the one or more side panels to a skirt of the roof panel.

In an alternate embodiment of the present invention, a slidable locking mechanism for a collapsible shipping container is provided. The slidable locking mechanism comprises a plate, a linkage bar coupled to the plate, a lever arm coupled to the linkage bar and having a hinge point at one end and a removable pin. The linkage bar and plate move in a lateral direction upon rotation of the lever arm about the hinge point.

In an alternate embodiment of the present invention, a lever latch assembly is provided for a collapsible shipping container. The lever latch assembly comprises a lever arm, a lever latch having a locking tab and also coupled to the lever arm. The lever latch assembly further comprises a base hinge coupled to the lever arm and one or more capture plates having a recessed opening sized to receive the locking tab.

In yet another embodiment of the present invention, a locking system for a collapsible shipping container is provided. The locking system comprises a plurality of locking plate assemblies for securing the front panel and door panel to corner posts and a plurality of lever latch assemblies positioned along an internal face of one or more side panels for securing the one or more side panels to a skirt of the roof panel. The locking system also comprises a plurality of locking levers having spring loaded locking tabs for securing the container in a collapsed condition.

In yet another embodiment of the present invention, an external locking mechanism for securing a collapsible shipping container in a collapsed condition is provided. The external locking mechanism comprises one or more locking levers and one or more corner posts having an opening sized to receive a locking tab of the locking lever.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

OBJECTS OF THE PRESENT INVENTION

An object of this invention is to provide a novel, foldable, enclosed shipping container which is compatible with existing standard non-foldable containers.

It is another object of this invention to provide a container which does not require assembly and disassembly of loose parts of the container in its normal use.

Another object and feature of the present invention is to provide a foldable shipping container which includes flat, horizontal, rigid unitary roof and base panels and vertical side panels hingedly connected to adjacent edges of the base panel whereby the side panels can pivot laterally inwardly relative to the roof and base panels during the process of folding the container from an unfolded condition to a folded condition in which the roof panel and base panel end up in close parallel relationship with each other.

Yet another object of this invention is to provide a container structure of the general character referred to above which includes normally vertical end walls to maintain the roof, base and side panels in their normal positions.

Still another object of this invention is to provide a container which includes vertical posts at the four corners of the container but which allow for free movement of the panels and their related parts while folding or unfolding the container.

The foregoing and other objects and features of this invention will be fully understood from the following detailed description of one typical preferred embodiment of the invention throughout which description reference is made to the accompanying drawings.

BRIEF DESCRIPTION OF THE SEVERAL VIEWS OF THE DRAWINGS

The present invention is described in detail below with reference to the attached drawing figures, wherein:

FIG. 123 is an elevation view of an internal locking mechanism for a collapsible container.

FIG. 124 is a perspective view of the internal locking mechanism of FIG. 123.

FIG. 125 is an alternate perspective view of the internal locking mechanism of FIG. 123.

FIG. 126 is a partial perspective of an alternate internal locking mechanism.

FIG. 127 is a partial perspective view of the alternate internal locking mechanism of FIG. 126.

FIG. 128 is a perspective view of a capture plate portion of the alternate internal locking mechanism of FIG. 126.

FIG. 129 is a perspective view of the alternate internal locking mechanism of FIG. 126.

FIG. 130 is a partial perspective view of an external locking mechanism for a collapsed container.

FIG. 131 is a detailed perspective view of the external locking mechanism of FIG. 130.

FIG. 132 is a perspective view of the locking lever of the external locking mechanism.

DETAILED DESCRIPTION

Figure 1:
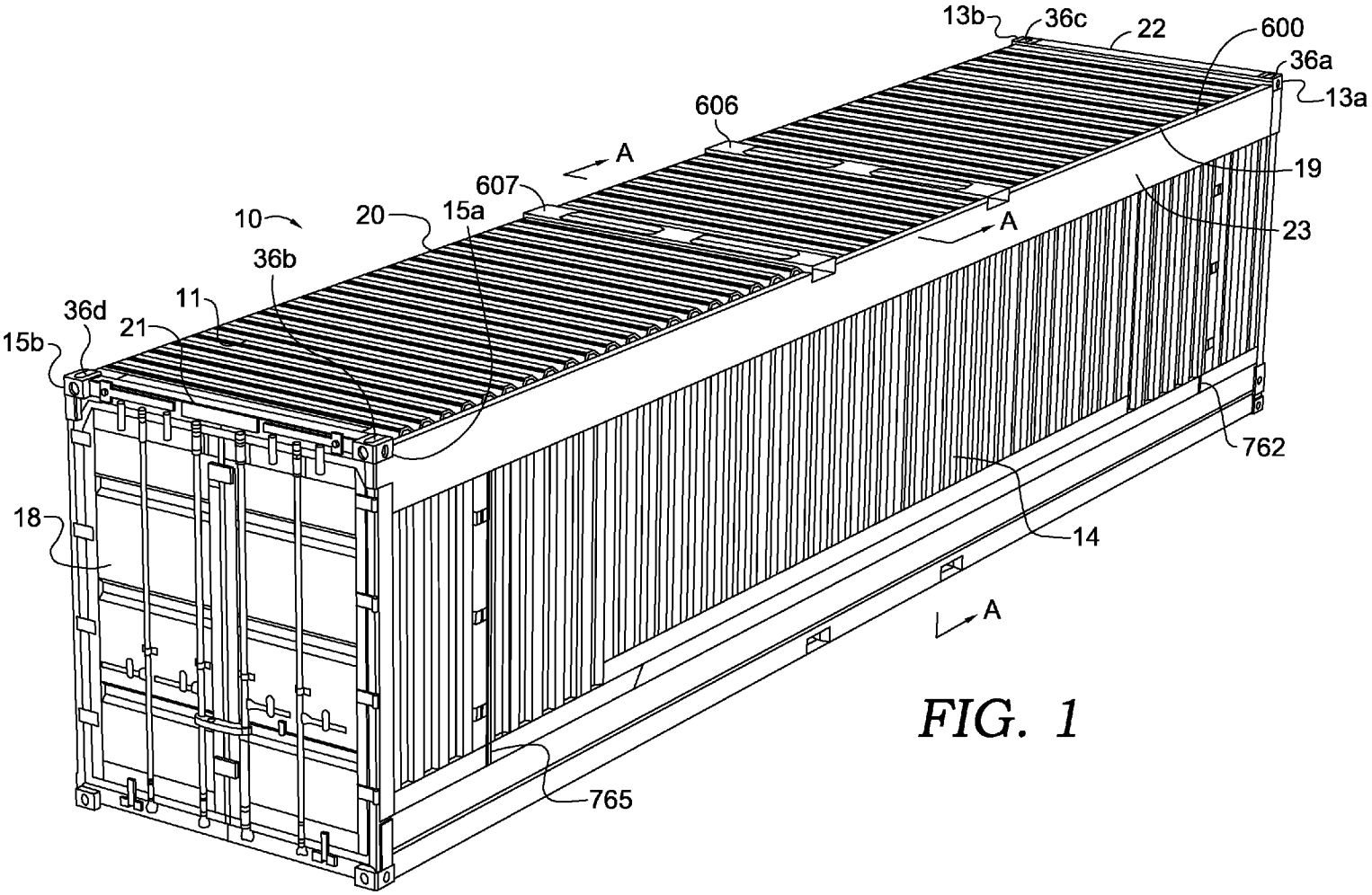
FIG. 1 is a view of the present invention viewing the door panel and the right side panel.
Figure 2:
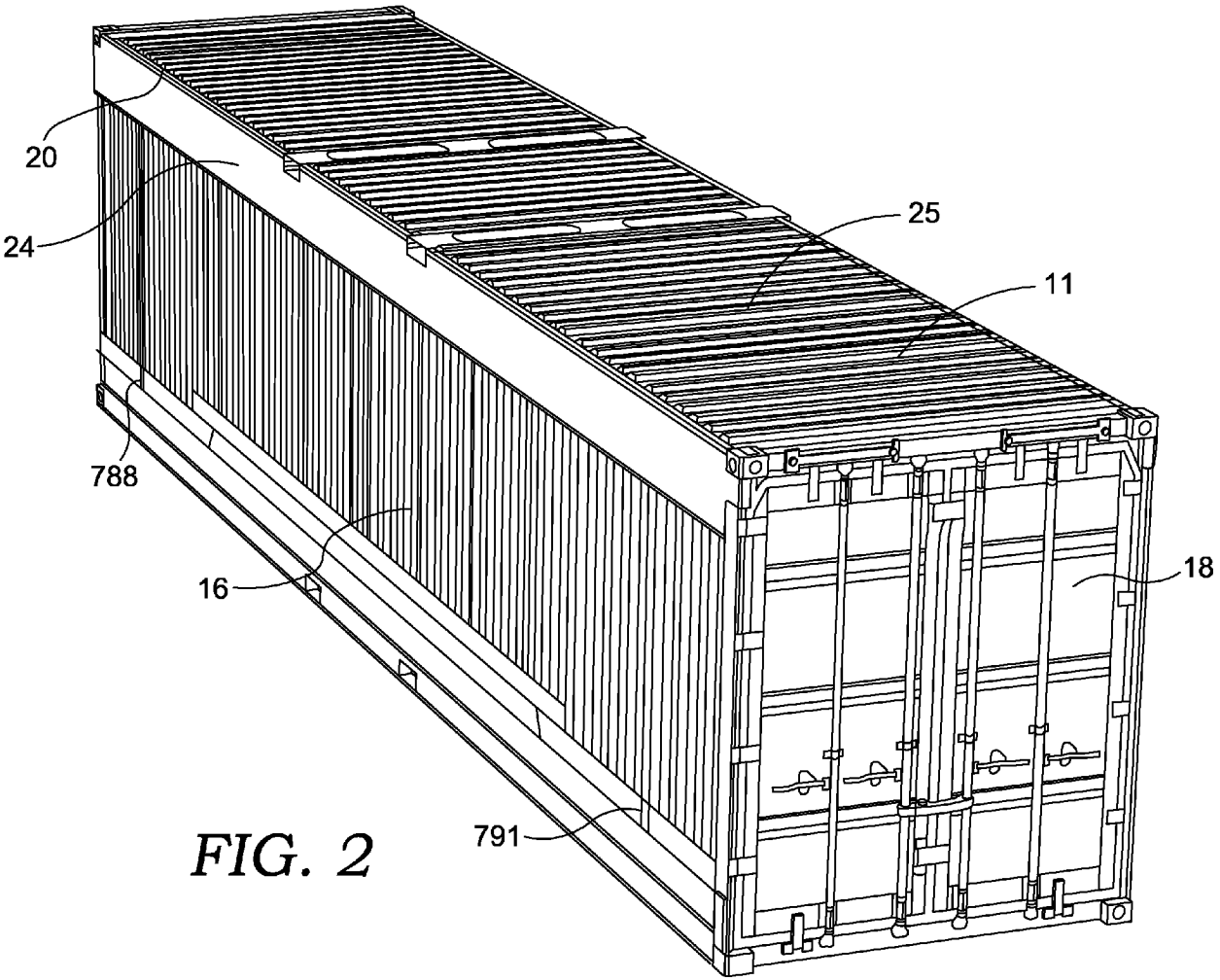
FIG. 2 is a view of the present invention viewing the door panel and the left side panel.
Figure 3:
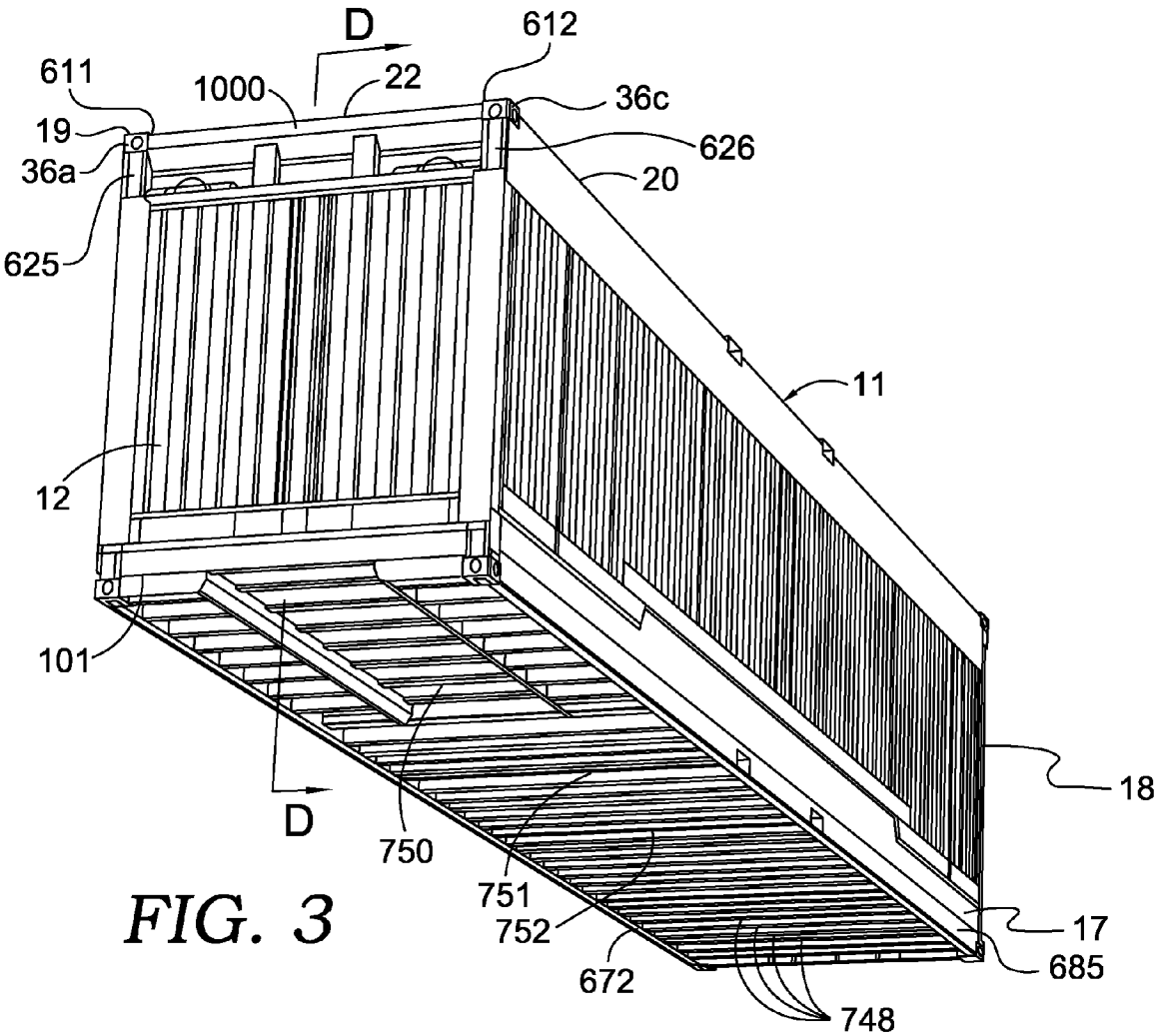
FIG. 3 a view of the present invention viewing the front panel and the left side panel.

As shown in FIG. 1 the preferred embodiment of the foldable container 10 of the present invention includes a roof panel 11, a door panel, and a right side panel 14, and as shown in FIG. 2 the foldable container 10 further includes a left side panel 16. Collectively, the right side panel 14 and the left side panel 16 may be referred to herein as the "side panels", or individually either may be referred to as a "side panel". As shown in FIG. 3, the foldable container further includes a base panel 17, and a front panel 12 opposite the door panel 18.

Referring back to FIG. 1, the roof panel 11 includes a roof right edge 19, a roof left edge 20, a roof door edge 21, and a roof front edge 22. As shown in FIGS. 1 and 3, the roof panel 11 includes four standard corner fittings 36*a*, 36*b*, 36*c*, 36*d* of the type known in the art for lifting the foldable container 10 (as with a spreader), or for securing the foldable container 10 to another container which may be stacked on top of it. One corner fitting 36*a*, 36*b*, 36*c*, 36*d* is located on the roof panel 11 adjacent each end 13*a*, 13*b* of the roof front edge 22, and adjacent each end 15*a*, 15*b* of the roof door edge 21 thereof, in accordance with the international standards.

Figure 4:
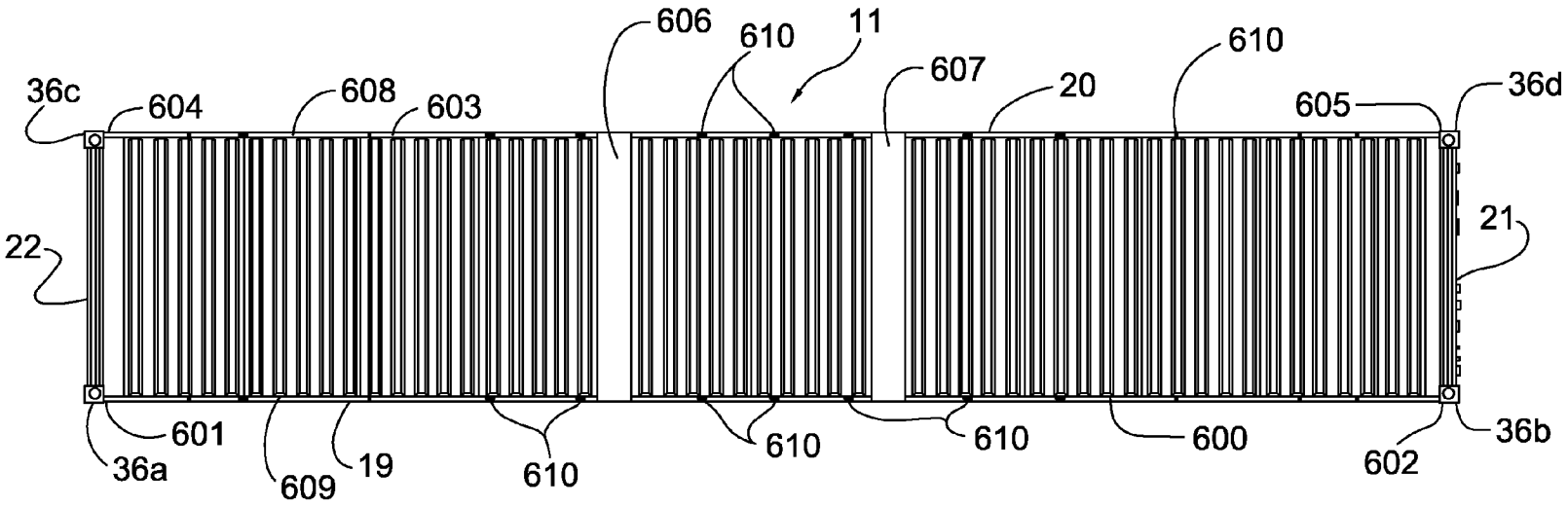
FIG. 4 is a plan view of the top of the roof panel.
Figure 5:
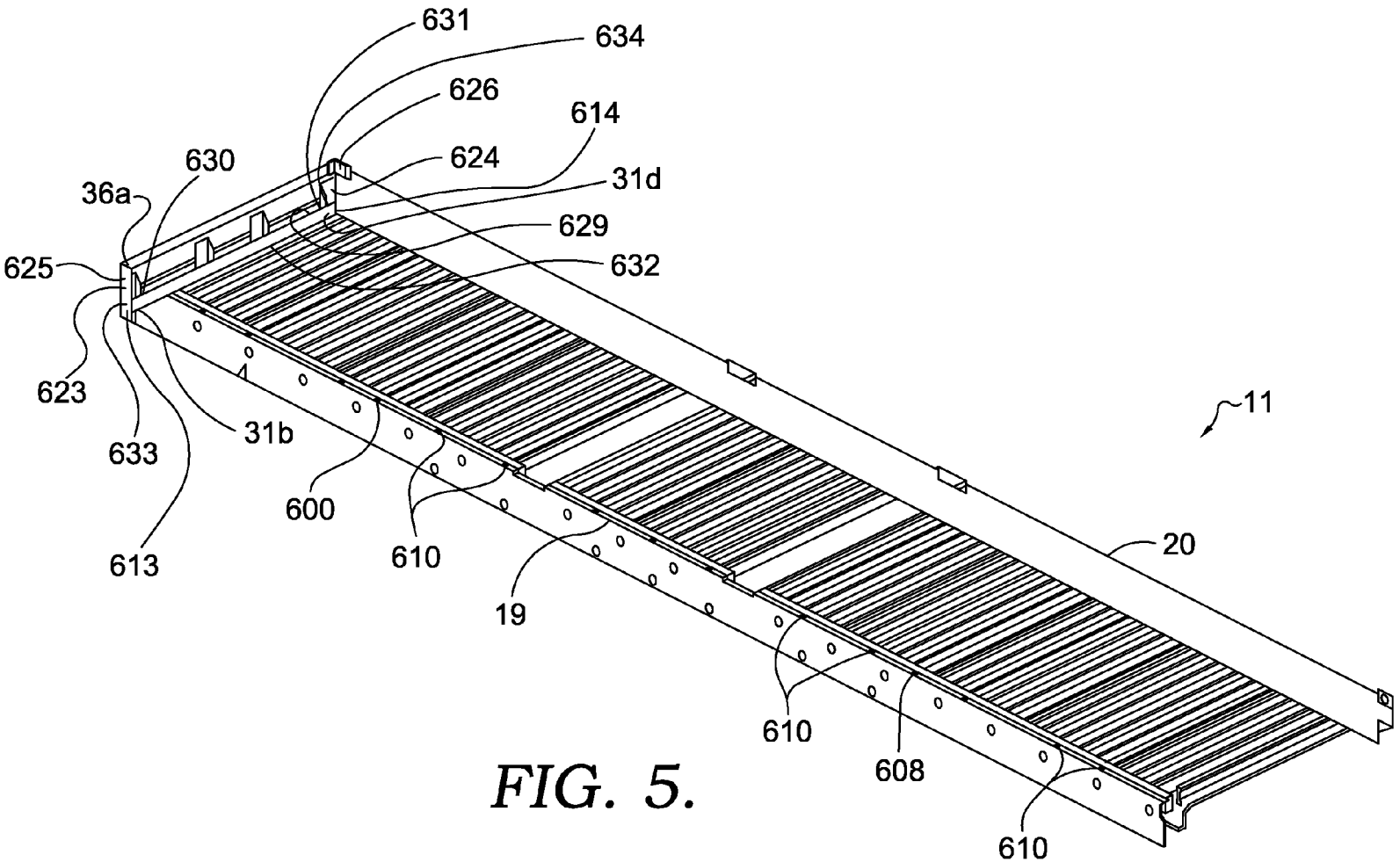
FIG. 5 is a perspective view of the underside of the roof panel.
Figure 6:
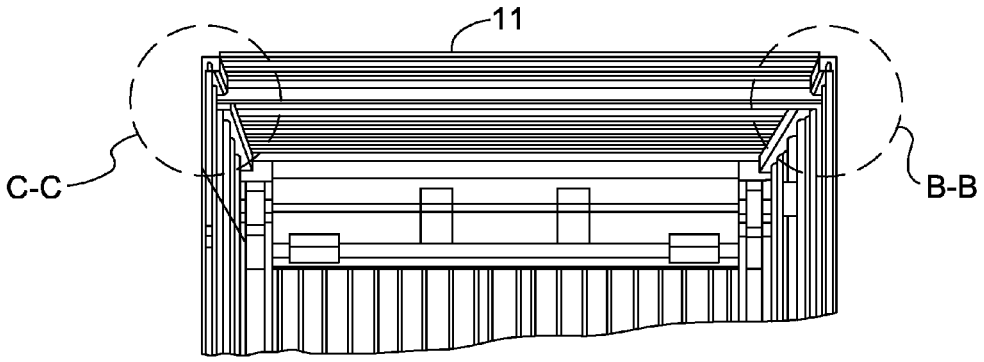
FIG. 6 is a view of the inside of the front panel taken along line A-A of FIG. 1.
Figure 7:
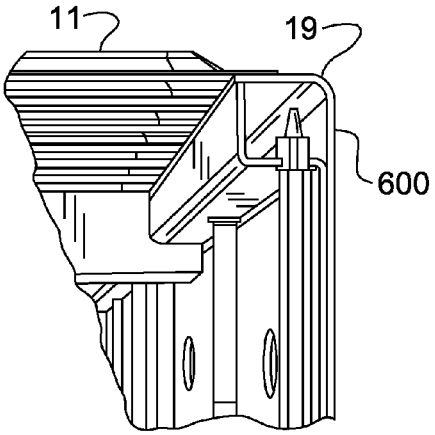
FIG. 7 is an enlarged view of section B-B of FIG. 6.

As shown in FIGS. 4 & 5, a hollow, rectangular roof right beam 600 extends along the right edge 19 of the roof panel 11 from the corner fitting 36*a* on the front edge 22 adjacent the roof right edge 19 of the roof panel 11 to the corner fitting 36*b* on the roof door edge 21 adjacent the roof right edge 19 of the roof panel 11. The roof right beam 600 is continuous except for the interruptions where the roof lifting beams 606, 607 pass through the roof right beam 600. The end 601 of the roof right beam 600 adjacent the roof front edge 22 is rigidly attached to the adjacent corner fitting 36*a*, preferably by welding, and the end 602 of the roof right beam 600 adjacent the roof door edge 21 is rigidly attached to the adjacent corner fitting 36*b*, preferably by welding. Likewise, the roof right beam 600 is preferably welded to the roof lifting beams 606, 607 where they pass through the roof right beam 600. As shown in FIGS. 6&7, the roof right beam 600 is hollow and extends downwardly from the roof right edge 19 a distance of about four inches.

Figure 8:
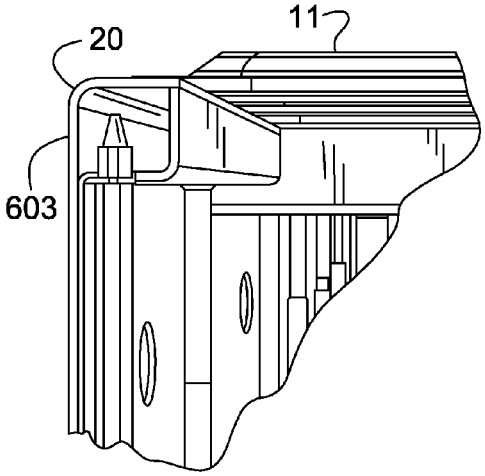
FIG. 8 is an enlarged view of section C-C of FIG. 6.

As shown in FIGS. 4 & 8, a hollow, rectangular roof left beam 603 extends along the roof left edge 20 of the roof panel 11 from the corner fitting 36*c* on the front edge 22 adjacent the roof left edge 20 of the roof panel 11 to the corner fitting 36*d* on the roof door edge 21 adjacent the roof left edge 20 of the roof panel 11. The roof left beam 603 is continuous except for the interruptions where the roof lifting beams 606, 607 pass through the roof left beam 603. The end 604 of the roof left beam 603 adjacent the roof front edge 22 is rigidly attached to the adjacent corner fitting 36*c*, preferably by welding, and the end 605 of the roof left beam 603 adjacent the roof door edge 21 is rigidly attached to the adjacent corner fitting 36*d*, preferably by welding. Likewise, the roof left beam 603 is preferably welded to the roof lifting beams 606, 607 where they pass through the roof left beam 603. The roof left beam 603 is hollow and extends downwardly from the roof left edge 20 a distance of about four inches. The lower face 608 of the roof right beam 600 and the lower face 609 of the roof left beam 603 each contain a plurality of locking bolt holes 610, the purpose of which is described below.

As shown in FIG. 1, along the roof right edge 19 of the roof panel 11, a right skirt 23 extends downwardly therefrom a length of about twelve inches, and as shown in FIG. 2, along the roof left edge 20 of the roof panel 11, a left skirt 24 also extends downwardly therefrom a length of about twelve inches.

Figure 9:
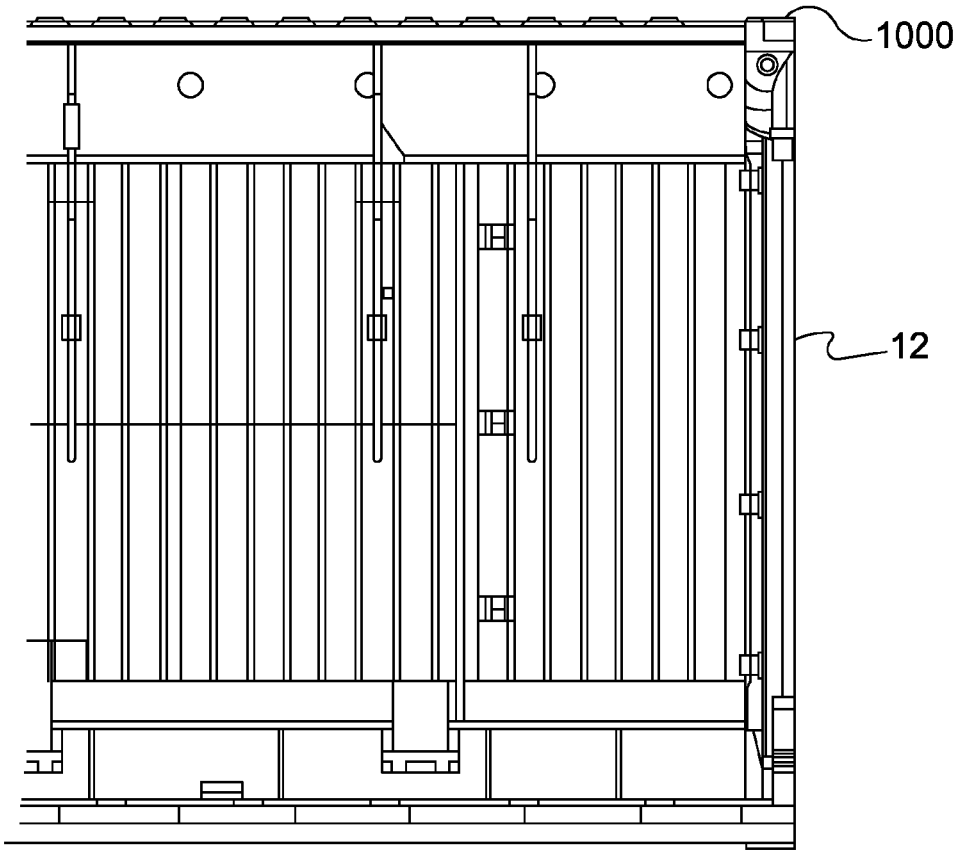
FIG. 9 is a cross sectional view of the front panel taken along line D-D of FIG. 3.
Figure 10:
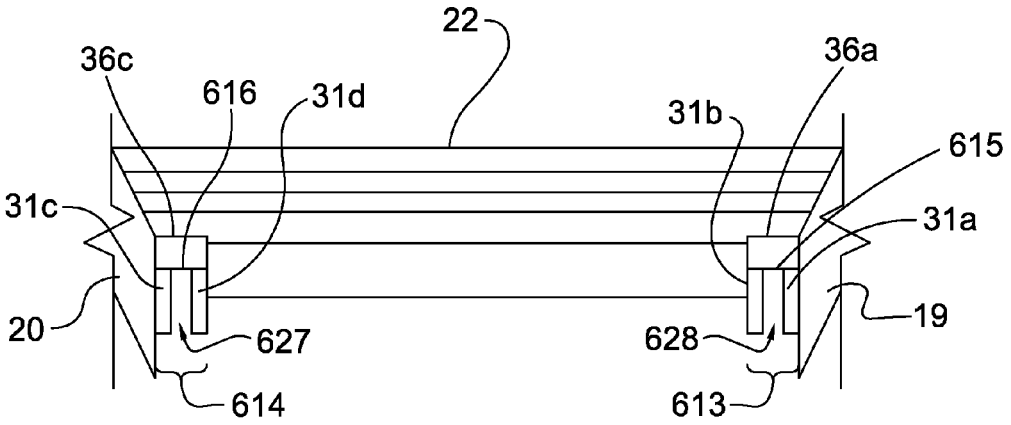
FIG. 10 is a partial view of the underside of the front end of the roof panel.
Figure 11A:
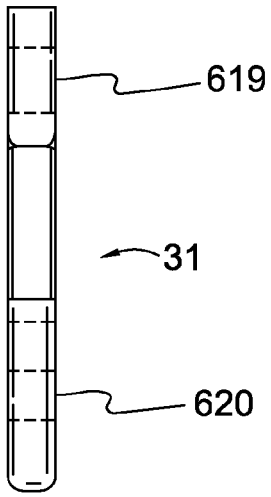
FIGS. 11A and 11B are plan views of the front first hinge members.
Figure 11B:
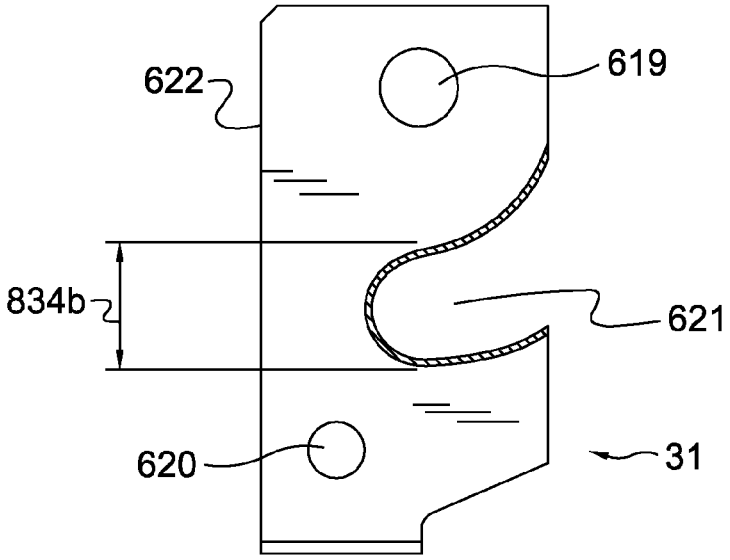

The upper exterior surface 25 of the roof panel 11 is made from corrugated metal, preferably CorTen® steel. As shown in FIGS. 3 & 9, the roof panel 11 includes a hollow, rectangular roof front beam 1000 that has one end 611 adjacent the roof right edge 19 and another end 612 adjacent the roof left edge 20. The roof front beam 1000 extends along the roof front edge 22 of the roof panel 11, and extends downwardly therefrom a distance of about four inches. More specifically, the rectangular roof front beam 1000 extends from the corner fitting 36*a* on the roof front edge 22 to the other corner fitting 36*c* on the roof front edge 22. The end 611 of the front beam 1000 adjacent the corner fitting 36*a* is rigidly attached thereto, preferably by welding, and the end 612 of the roof front beam 1000 adjacent the corner fitting 36*c* is rigidly attached thereto, also preferably by welding. As shown in FIG. 10, the roof panel 11 further includes two front first hinge sets 613, 614. The front first hinge set 613 includes two front first hinge members 31*a*, 31*b*, each rigidly connected to the lower surface 615 of the corner fitting 36*a* adjacent the roof front edge 22 and the roof right edge 19, preferably by welding. The front first hinge set 614 likewise includes two front first hinge members 31*c*, 31*d*, each rigidly connected to the lower surface 616 of the corner fitting 36*c* adjacent the roof front edge 22 and the roof left edge 20, preferably by welding. The front first hinge members 31*a*, 31*b*, of the front first hinge set 613 adjacent the roof right edge 19 are fixed in spaced relation to each other for receiving a front hinge pivot 617, as described in greater detail below, and the front first hinge members 31*c*, 31*d*, of the front first hinge set 614 adjacent the roof left edge 20 are fixed in spaced relation to each other for receiving another front hinge pivot 618, as described in greater detail below. A representative front first hinge member 31 is shown in isolation in FIGS. 11A and 11B. Each front first hinge member has a front hinge edge 622, front pivot hole 619, a front bolt hole 620, and a lug receiving slot 621. The purpose of each of these features is described in greater detail below.

As shown in FIG. 5, a front hinge plate 623, 624, having a length substantially equal to the length of the front hinge edge 622 of the first hinge members 31*a*, 31*b*, 31*c*, 31*d*, is fixedly secured between immediately adjacent first hinge members 31*a*, 31*b*, and 31*c*, 31*d*, preferably by welding along the length of each front hinge edge 622. The combination of front hinge plate 623 and the first front hinge members 31*a*, 31*b* secured to it, form a roof front interlock 625 adjacent the roof right edge 19 of the roof panel 11, and the combination of front hinge plate 624 and the first front hinge members secured to it 31*c*, 31*d*, form a roof front interlock 626 secured to the corner fitting 36*c* adjacent the roof left edge 20 of the roof panel 11. Each front roof interlock 625, 626 has a lower slot 627, 628 for receiving a large tang extending from the base panel 17 when the folding container 10 is in its fully folded condition, as described below.

Figure 12:
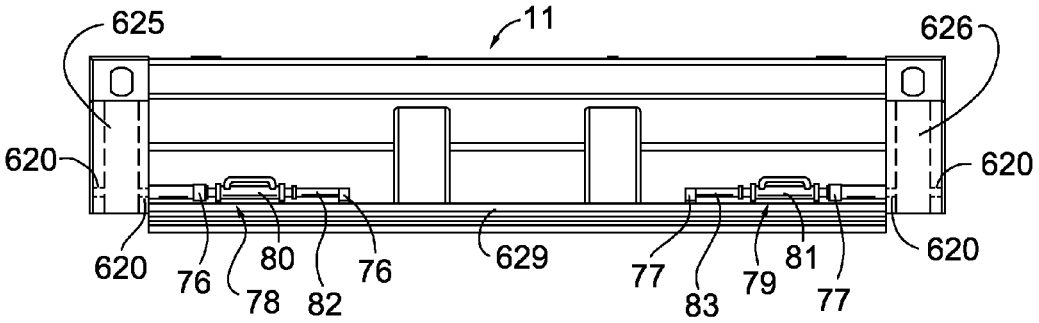
FIG. 12 is a plan view of the front end of the roof panel.

Referring again to FIG. 5, a front shelf beam 629 extends between the front first hinge sets 613, 614, and the end 630 of the front shelf beam 629 adjacent the roof right edge 19 is fixedly secured to the inward front first hinge member 31*b*, preferably by welding, such that the lower edge 632 of the front shelf beam 629 is approximately aligned with the lower edge 633 of the front hinge plate 623. Likewise, the end 631 of the front shelf beam 629 adjacent the roof left edge 20 is fixedly secured to the inward front first hinge member 31*d*, preferably by welding, such that the lower edge 632 of the front shelf beam 629 is approximately aligned with the lower edge 634 of the front hinge plate 624. As shown in FIG. 12, mounted to the front shelf beam 629 adjacent each roof front interlock 625, 626, and aligned with the bolt holes 620 therein, are hammer lock retainers 76, 77. A hammer locking mechanism 78, 79, including a slide hammer 80, 81, and a hammer locking bolt 82, 83 is slideably secured to each of the hammer lock retainers 76, 77, such that each hammer locking mechanism 78, 79 is positionable by use of one of the slide hammers 80, 81, slideably mounted on one of the hammer locking bolts 82, 83, between an unlocked position in which the respective hammer locking bolt 82, 83, is in a retracted position substantially outside of the roof front interlock 625, 626, immediately adjacent thereto, and a locked position in which the respective hammer locking bolt 82, 83 extends through the bolt holes 620 of the roof front interlock 625, 626 immediately adjacent thereto.

Figure 13:
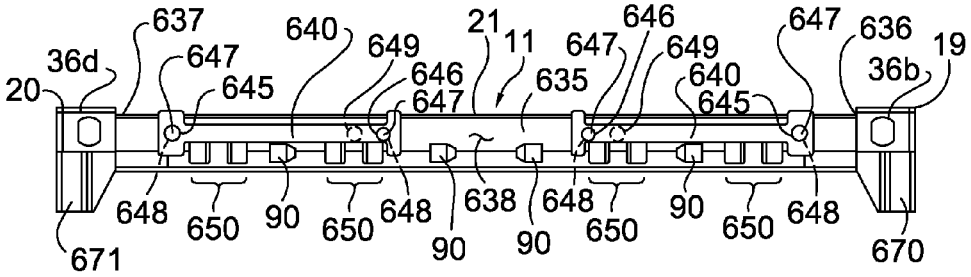
FIG. 13 is a plan view of the door end of the roof panel.

As shown in FIG. 13, the roof panel 11 includes a hollow, rectangular roof door beam 635 that extends along the roof door edge 21 of the roof panel 11, and extends downwardly therefrom a distance of about four inches. The hollow, rectangular roof door beam 635 extends from the corner fitting 36*b* on the roof door edge 21 adjacent the roof right edge 19 to the corner fitting 36*d* on the roof door edge 21 adjacent the roof left edge 20. The end 636 of the roof door beam 635 adjacent the roof right edge 19 is rigidly attached to the corner fitting 36*b* adjacent the roof right edge 19, preferably by welding, and the end 637 of the roof door beam 635 adjacent the roof left edge 20 is rigidly attached to the corner fitting 36*d* adjacent the roof left edge 20, preferably by welding. The exterior vertical face 638 of the rectangular roof door beam 635 includes a plurality of lock hasps 90, preferably four, rigidly secured thereto for receiving the upper ends 91 of each of the locking rods 92 of the door latch assembly 639 as described below. The roof panel 11 further includes a pair of locking straps 640, removably secured thereto adjacent the lock hasps 90. Each locking strap 640 is preferably made of steel, and has a shape of similar to that of an "I". Adjacent each end of each locking strap 640 is a bolt hole 645, 646, for receiving one of the strap bolts 647 that are used to removably secure the locking strap 640 to the container 10 when the container 10 is in its folded, and unfolded, condition, as described below. When the container 10 is in its unfolded condition, the strap bolts 647 are received within stored strap bolt holes 648, not shown, that secure the locking strap 640 to the roof panel 11. The roof panel 11 also includes two upper active strap bolt holes 649, not shown, for use when the container 10 is in its folded condition, as described below. A plurality, and preferably four (4), pairs of upper door stop receivers 650 are welded to the exterior vertical face 638 of the rectangular roof door beam 635 adjacent the lock hasps 90, the upper door stop receivers 650 of each such pair being in spaced relation to each other. Each of the upper active strap bolt holes 649 is aligned with one pair of upper door stop receivers 650. As those skilled in the art will readily appreciate, when a locking strap 640 is secured by a strap bolt 647 to one of the upper active strap bolt holes 649, the "I" at one end 645 of the locking strap 640 rests on one pair of the door stop receivers when the locking strap 640 is supporting a load. Accordingly, the thickness of the each locking strap 640, and the load carrying ability of the upper door stop receivers 650 on which the locking strap 640 rests, must be sufficient to support, at a minimum, a weight equal to that of the entire container 10 when the container 10 is empty, which, in turn, depends on the material from which the container 10, the locking straps 640, and the upper door stop receivers 650 are made, as well as the strength of the welds securing the upper door stop receivers 650 to the roof door beam 635.

Figure 14:
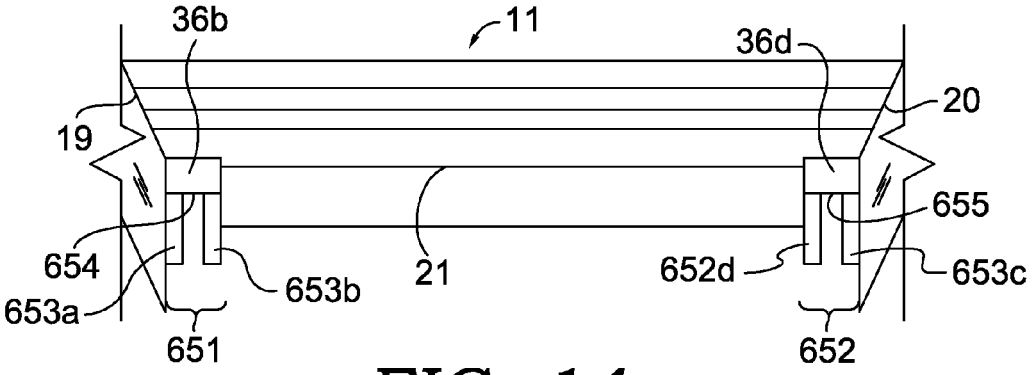
FIG. 14 is a partial view of the underside of the door end of the roof panel.
Figure 15:
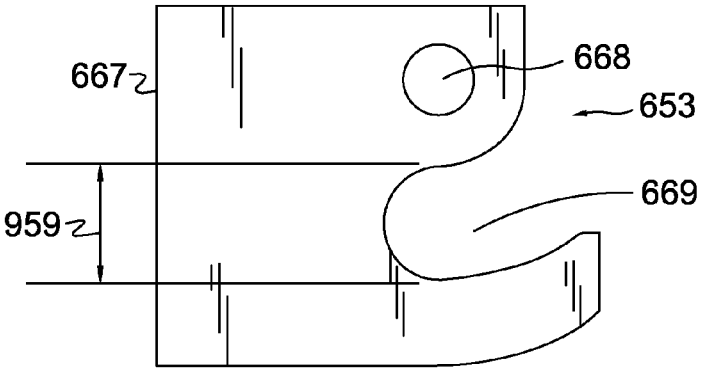
FIG. 15 is a plan view of the door first hinge members.

As shown in FIG. 14, the roof panel 11 further includes two door first hinge sets 651, 652. The door first hinge set 651 includes two door first hinge members 653*a*, 653*b*, each rigidly connected to the lower surface 654 of the corner fitting 36*b* adjacent the roof door edge 21 and the roof right edge 19, preferably by welding. The door first hinge set 652 likewise includes two door first hinge members 653*c*, 653*d*, each rigidly connected to the lower surface 655 of the corner fitting 36*d* adjacent the roof door edge 21 and the roof left edge 20, preferably by welding. The door first hinge members 653*a*, 653*b*, of the door first hinge set 651 adjacent the roof right edge 19 are fixed in spaced relation to each other for receiving a door hinge pivot 656, as described in greater detail below, and the door first hinge members 653*c*, 653*d*, of the door first hinge set 652 adjacent the roof left edge 20 are fixed in spaced relation to each other for receiving a front hinge pivot 666, as described in greater detail below. A representative door first hinge member 653 is shown in isolation in FIG. 15. Each door first hinge member 653 has a door hinge edge 667, door pivot hole 668, and a door lug receiving slot 669. The purpose of each of these features is described in greater detail below.

Referring again to FIG. 13, a door hinge plate 670, 671, having a length substantially equal to the length of the door hinge edge 667 of the door first hinge members 653*a*, 653*b*, 653*c*, 653*d*, is fixedly secured between immediately adjacent door first hinge members 653*a*, 653*b*, 653*c*, 653*d*, preferably by welding along the length of each door hinge edge 667.

Figure 16:
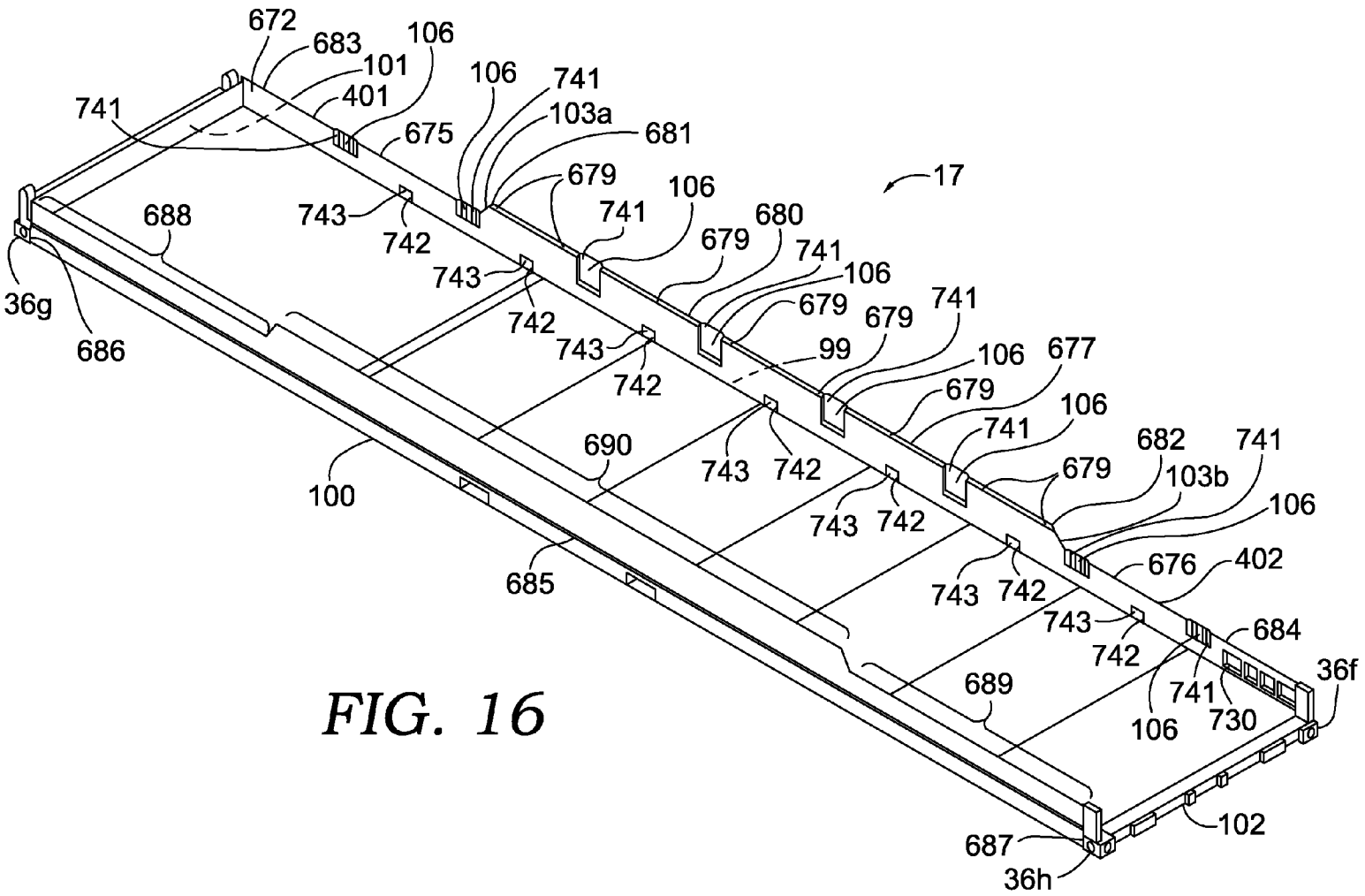
FIG. 16 is a perspective view of the upper side of the left side of the base panel.
Figure 17:
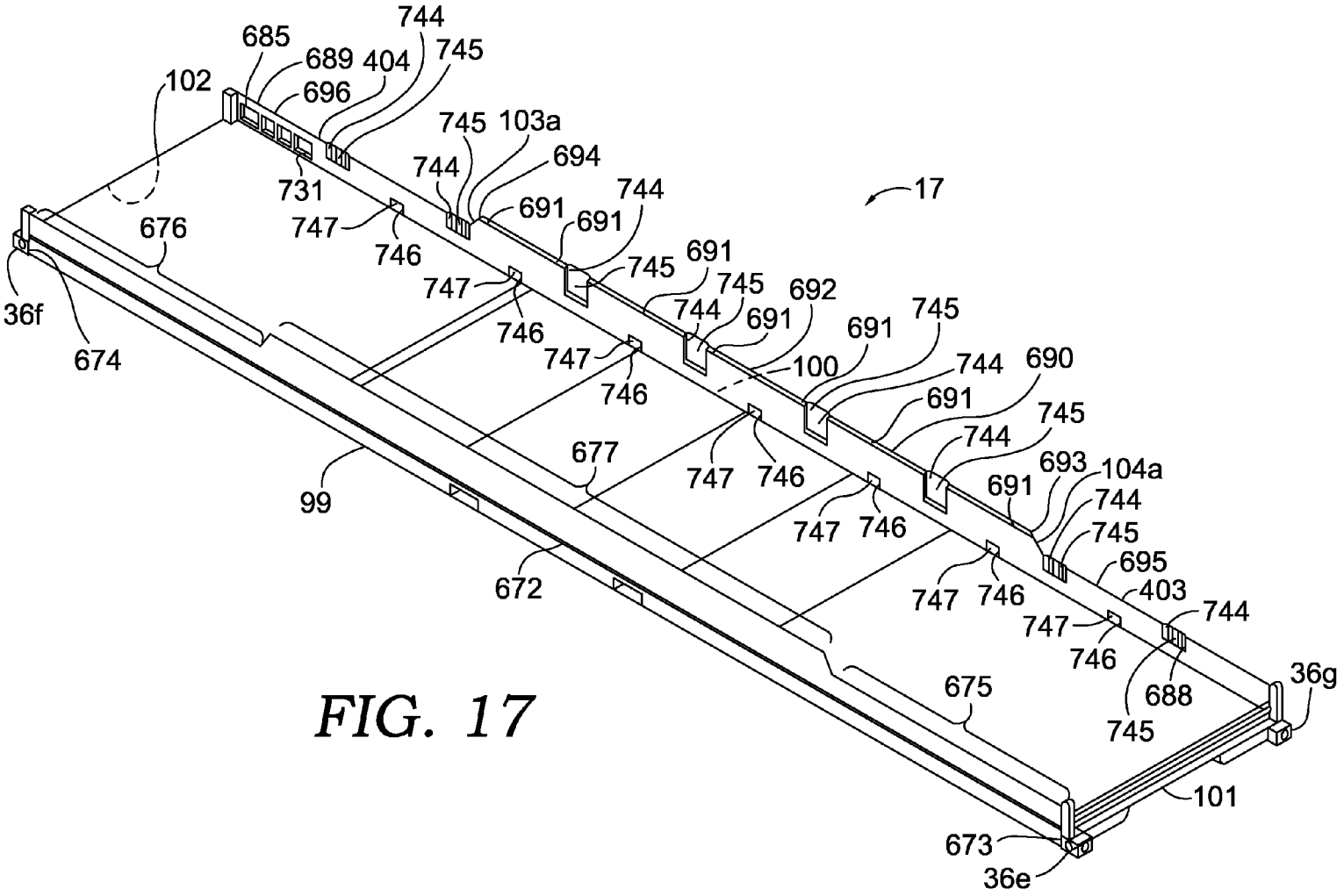
FIG. 17 is a perspective view of the upper side of the right side of the base panel.

As shown in FIGS. 16 & 17, the base panel 17 includes a base right edge 99, a base left edge 100, a base front edge 101, and a base door edge 102. The base panel 17 includes four standard corner fittings 36*e*, 36*f*, 36*g*, 36*h* of the type known in the art for securing the container 10 to another container on which it may be stacked. One corner fitting 36*e*, 36*f*, 36*g*, 36*h* is located on the base panel 17 adjacent each end of the base front edge 101, and adjacent each end of the base door edge 102, in accordance with the international standards.

As shown in FIG. 17, a hollow, rectangular base right beam 672 extends along the base right edge 99 of the base panel 17 from the corner fitting 36*e* on the base front edge 101 adjacent the base right edge 99 of the base panel 17 to the corner fitting 36*f* on the door edge 102 adjacent the right edge 99 of the base panel 17. Each end 673, 674 of the base right beam 672 is rigidly attached to the adjacent corner fitting 36*e*, 36*f*, preferably by welding. The base right beam 672 comprises base right beam lower portions 675, 676 which extend upwardly from the base right edge 99 a distance of about eight inches, and a base right beam upper portion 677 that extends further up from the base right edge 99 to a height of about twelve inches. Referring again to FIG. 16, a plurality of cable anchors 679, the purpose of which is described in greater detail below, are secured to base right beam 672 in spaced relation to each other adjacent the upper edge 680 of the base right beam upper portion 677. Sloped right transition portions 103*a*, 103*b*, extend between each end 681, 682 of the base right beam upper portion 677 to the base right beam lower portions 675, 676 adjacent thereto. The top edge 683, 684 of each of the base right beam lower portions 675, 676, is capped with a guide rail 401, 402, preferably made of stainless steel. The purpose of the guide rails 401, 402, and the purpose of the base right beam lower portions 675, 676 of the base right beam 672, are discussed below.

As shown in FIG. 16, a hollow, rectangular base left beam 685 extends along the base left edge 100 of the base panel 17 from the corner fitting 36*g* on the base front edge 101 adjacent the base left edge 100 of the base panel 17 to the corner fitting 36*h* on the door edge 102 adjacent the left edge 100 of the base panel 17. Each end 686, 687 of the base left beam 685 is rigidly attached to the adjacent corner fitting 36*g*, 36*h*, preferably by welding. The base left beam 685 comprises base left beam lower portions 688, 689 which extend upwardly from the base left edge 100 a distance of about eight inches, and a base left beam upper portion 690 that extends further up from the base left edge 100 to a height of about twelve inches. Referring again to FIG. 17, a plurality of cable anchors 691, the purpose of which is described in greater detail below, are secured to base left beam 685 in spaced relation to each other adjacent the upper edge 692 of the base right beam upper portion 690. Sloped left transition portions 104*a*, 104*b*, extend between each end 693, 694 of the base left beam upper portion 690 to the base left beam lower portions 688, 689 adjacent thereto. The top edge 695, 696 of each of the base left beam lower portions 688, 689, is capped with a guide rail 403, 404, preferably made of stainless steel. The purposes of the guide rails 403, 404, and the purpose of the base left beam lower portions 688, 689 of the base left beam 685, are discussed below.

Figure 18:
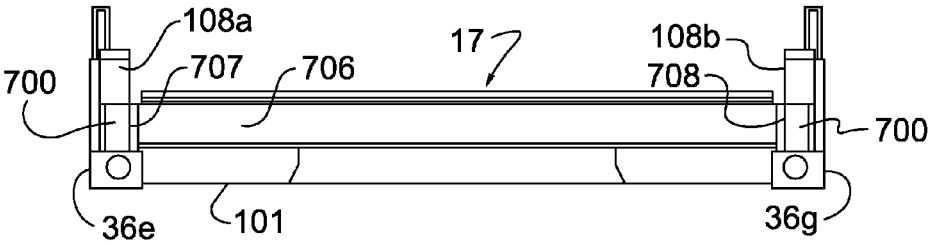
FIG. 18 is a plan view of the front end of the base panel.
Figure 19:
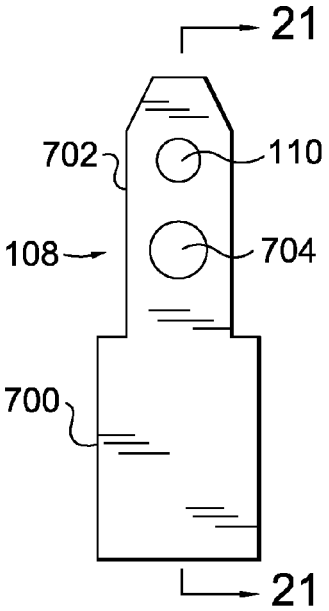
FIGS. 19, 20 and 21 are views of base front tangs.
Figure 20:
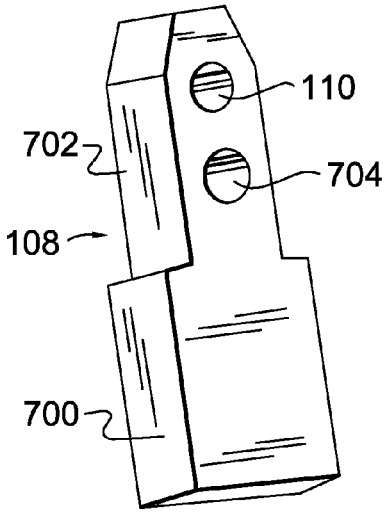
Figure 21:
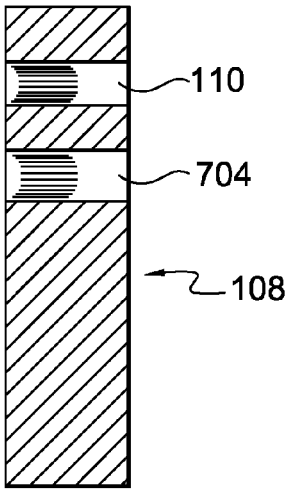

As shown in FIG. 18, extending upward from each corner fitting 36*e*, 36*g* on the base panel 17 adjacent the front edge 101 is a base front tang 108*a*, 108*b*. A representative base front tang 108 is shown in FIGS. 19-21. Each of the base front tang 108 has a rectangular base portion 700, and a locking portion 702 extending therefrom. The locking portion 702 of each base front tang 108 includes an upper tapered locking hole 110 and a lower tapered locking hole 704, each of which is substantially parallel to the front edge 101 of the base panel 17, and each of which is sized and located so as to be able to receive therein one of the hammer locking bolts of the front panel 12, as discussed below.

Referring back to FIG. 18, the base portion 700 of each base front tang 108*a*, 108*b* is fixedly secured to the corner fitting 36*e*, 36*g* it extends from, preferably by welding. The base panel 17 includes a hollow, rectangular base front beam 706 that extends between the base portions 700 of the base front tangs 108*a*, 108*b*. Each end 707, 708 of the base front beam 706 is rigidly attached to the base portion 700 of the base front tang 108*a*, 108*b* immediately adjacent thereto, preferably by welding.

Figure 22:
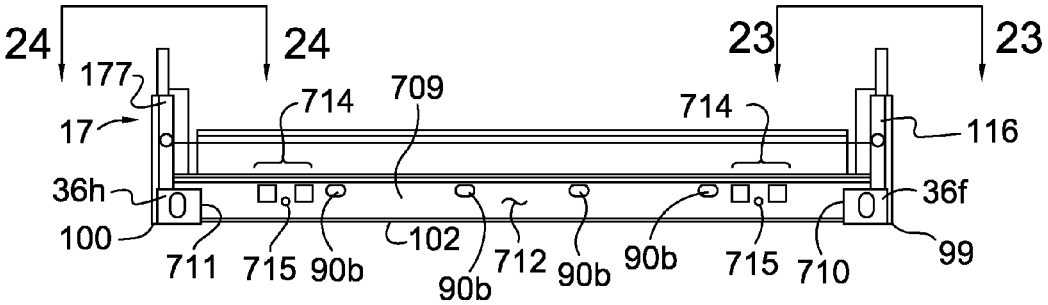
FIG. 22 is a plan view of the door end of the base panel.

As shown in FIG. 22, the base panel 17 includes a hollow, rectangular base door beam 709 that extends along the door edge 102 of the base panel 17, and extends upwardly therefrom a distance of about four inches. The base door beam 109 extends from the corner fitting 36*f* on the door edge 102 adjacent the right edge 99 of the base panel 17 to the corner fitting 36*h* on the door edge 102 adjacent the left edge 100 of the base panel 17. Each end 710,711 of the base door beam 709 is rigidly attached to the adjacent corner fitting 36*f*, 36*h*, preferably by welding. The exterior vertical face 712 of the base door beam 709 includes a plurality of lock hasps 90*b*, preferably four, rigidly secured thereto for receiving lower end 713 of each of the locking rods 92 of the door latch assembly as described below. The door end of the base panel 17 further includes at least two pairs of lower door stop receivers 714 that are welded to the exterior vertical face 712 of the rectangular base door beam 709 adjacent the lock hasps 90*b* closest to the corner fittings 36*f*, 36*h*, the lower door stop receivers 714 of each such pair being in spaced relation to each other. A lower active strap bolt hole 715 is aligned with each pair of lower door stop receivers 714. As those skilled in the art will readily appreciate, when a locking strap 640 is secured by a strap bolt 647 to one of the lower active strap bolt holes 715, the inverted "T" at one end of the locking strap 640 supports the load placed on it by the pair of door stop receivers 714 within which the locking strap 640 is received. Accordingly, the load carrying ability of the lower door stop receivers 714 which rest on the locking strap 640 must be sufficient to support, at a minimum, a weight equal to that of the entire container 10 when the container 10 is empty, which, in addition to those factors previously stated, depends on the material from which the lower door stop receivers 714 are made, as well as the strength of the welds securing the lower door stop receivers 714 to the base door beam 709.

Figure 23:
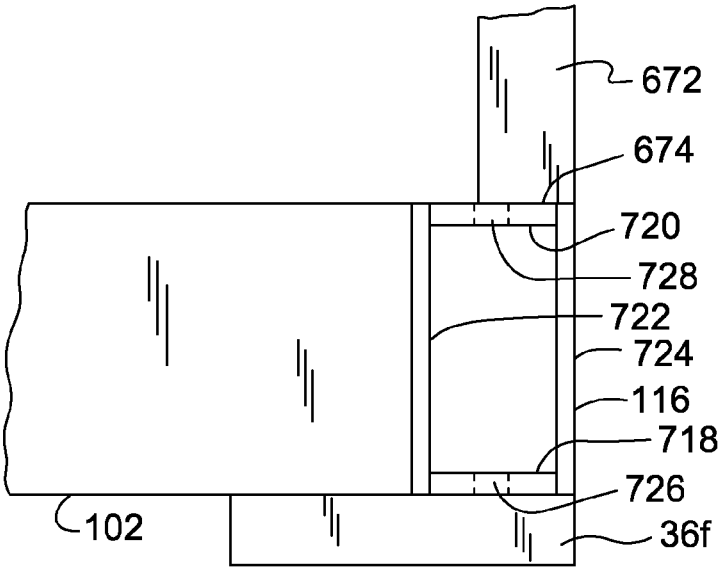
FIG. 23 is a plan view of the right side door interlock.
Figure 24:
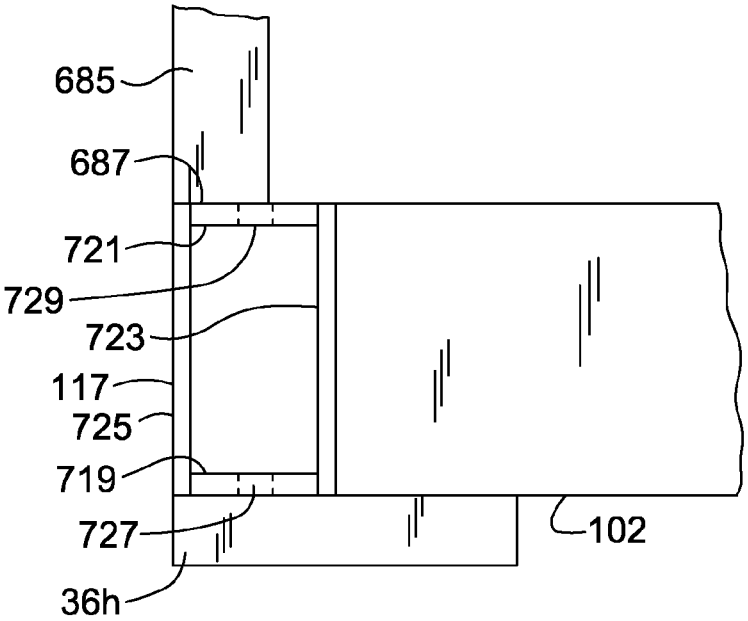
FIG. 24 is a plan view of the left side door interlock.

Extending upwardly from each of the corner fittings 36*f*, 36*h* on the door edge 102 of the base panel 17 is a door interlock 116, 117. As shown in FIGS. 23 & 24, each door interlock 116, 117 has four walls: a door wall 718, 719 which faces the door edge 102 of the base panel 17, a front wall 720, 721 which faces the front edge 101 of the base panel 17 and is parallel to, and in spaced relation with, the door wall 718, 719, an inner wall 722, 723 that is perpendicular to the door wall 718, 719 and the front wall 720, 721 and faces the inner wall 720, 721 of the other door interlock 116, 117, and an outer wall 724, 725 which is parallel to, and in spaced relation with, the inner wall 720, 721. The door interlock 116 extending from the corner fitting 36*f* on the door edge 102 adjacent the base right beam 672 is rigidly attached to that corner fitting 36*f* and the door end 674 of the base right beam 672, preferably by welding. Likewise, the door interlock 117 extending from the corner fitting 36*h* on the door edge 102 adjacent the base left beam 685 is rigidly attached to that corner fitting 36*h* and the door end 687 of the base left beam 685, also preferably by welding.

Each door interlock 116, 117 has a first bolt hole 726, 727 in the door wall 718, 719 thereof, and a second bolt hole 728, 729 in the front wall 720, 721 thereof aligned with the first bolt hole 726, 727 of the same door interlock 116, 117. The diameter of the second bolt holes 728, 729 is preferably slightly larger than the diameter of the first bolt holes 726, 727 for reasons discussed below.

Figure 25:
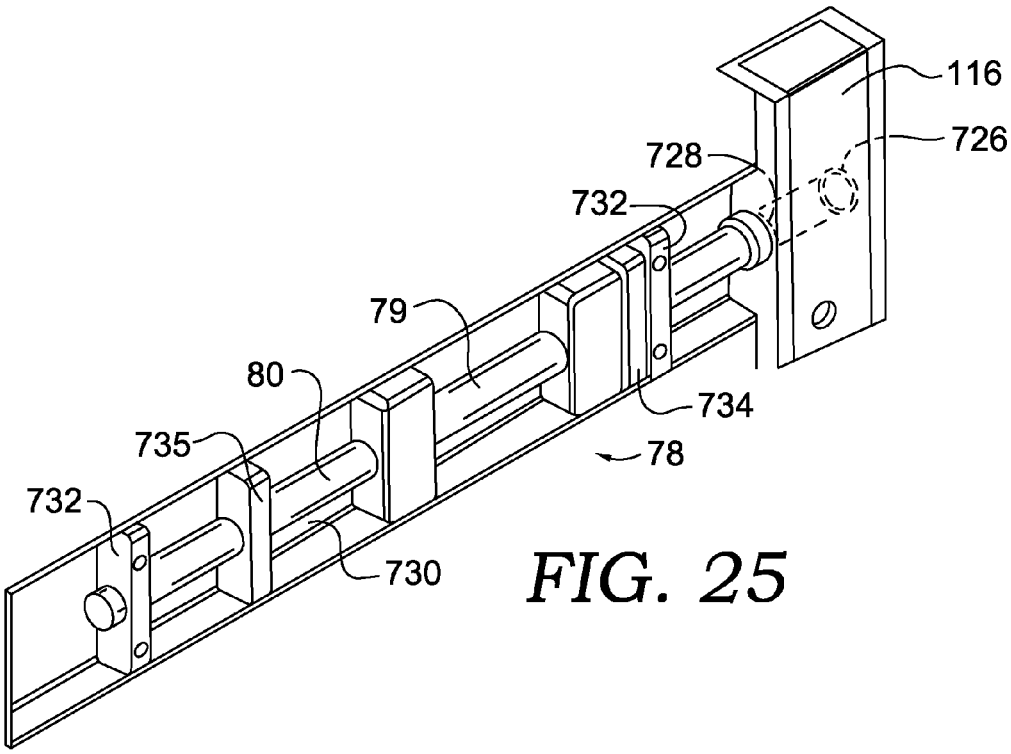
FIG. 25 is a view of the base panel hammer locking mechanism and right door interlock.

As shown in FIGS. 16 & 17, the lower portion 676 of the base right beam 672 and the lower portion 689 of the base left beam 685 each include a recessed portion 730, 731 immediately adjacent the door edge 102 of the base panel 17. As shown in greater detail in FIG. 25, hammer lock retainers 732 are mounted in the recessed portion 730 of the lower portion 676 of the base right beam 672 adjacent the door interlock 116 and aligned with the bolt holes 726, 728 therein. Likewise, as shown in greater detail in FIG. 26, hammer lock retainers 733 are mounted in the recessed portion 731 of the lower portion 689 of the base left beam 685 adjacent the door interlock 117 and aligned with the bolt holes 727, 729 therein. As shown in FIG. 25, a hammer locking mechanism 78 is slideably secured to the hammer lock retainers 732 in the recessed portion 730 of the lower portion of the base right beam 676. The hammer locking mechanism 78 therein includes a slide hammer 79 slideably mounted on a hammer locking bolt 80. As those skilled in the art will readily appreciate, by sliding the slide hammer 79 against one of the hammer stops 734, 735, the hammer locking bolt 80 can be selectively positioned at an unlocked position in which the hammer locking bolt 80 is in a retracted position substantially outside of the interlock 116 immediately adjacent thereto, and a locked position in which the locking bolt 80 extends through the bolt holes 726, 728 of the interlock 116 immediately adjacent thereto.

Figure 26:
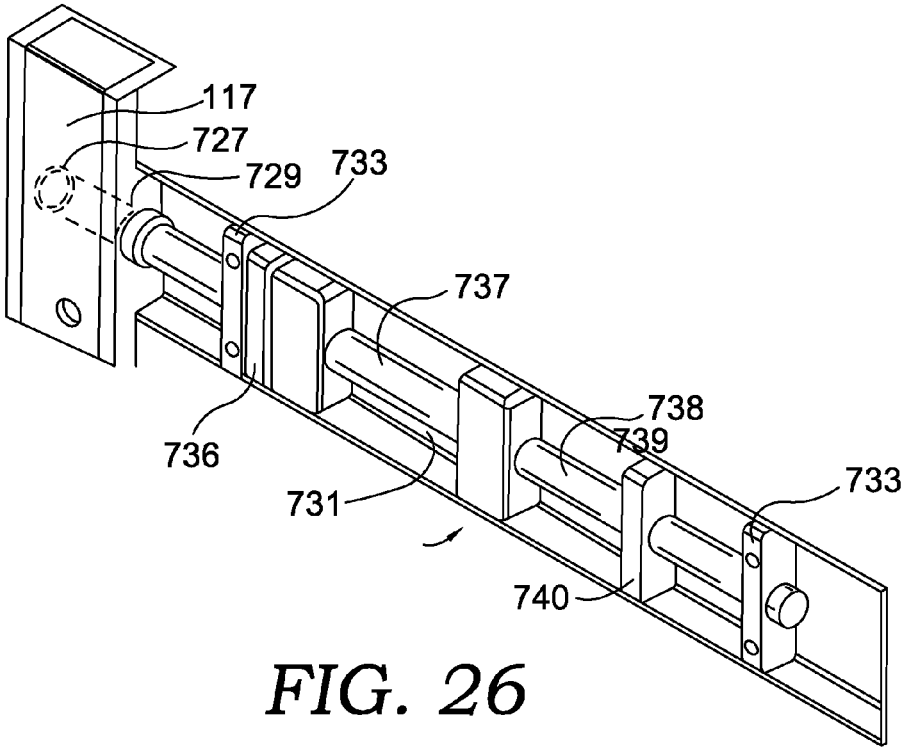
FIG. 26 is a view of the base panel hammer locking mechanism and left door interlock.

Likewise, as shown in FIG. 26, a hammer locking mechanism 736 is slideably secured to the hammer lock retainers 733 in the recessed portion 731 of the lower portion of the base left beam 689. The hammer locking mechanism 736 therein includes a slide hammer 737 slideably mounted on a hammer locking bolt 738. As those skilled in the art will readily appreciate, by sliding the slide hammer 737 against one of the hammer stops 739, 740, the hammer locking bolt 738 can be selectively positioned at an unlocked position in which the hammer locking bolt 738 is in a retracted position substantially outside of the interlock 117 immediately adjacent thereto, and a locked position in which the locking bolt 738 extends through the bolt holes 727, 729 of the interlock 117 immediately adjacent thereto.

Figure 41B:
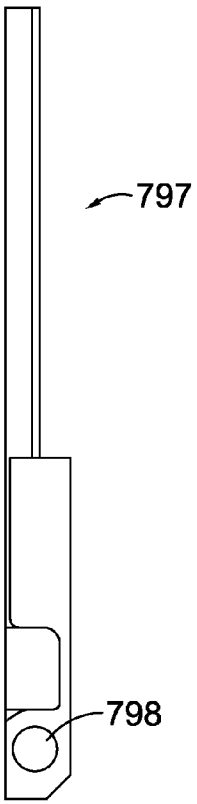
FIGS. 41A and 41B are plan views of the side hinge members.
Figure 41A:
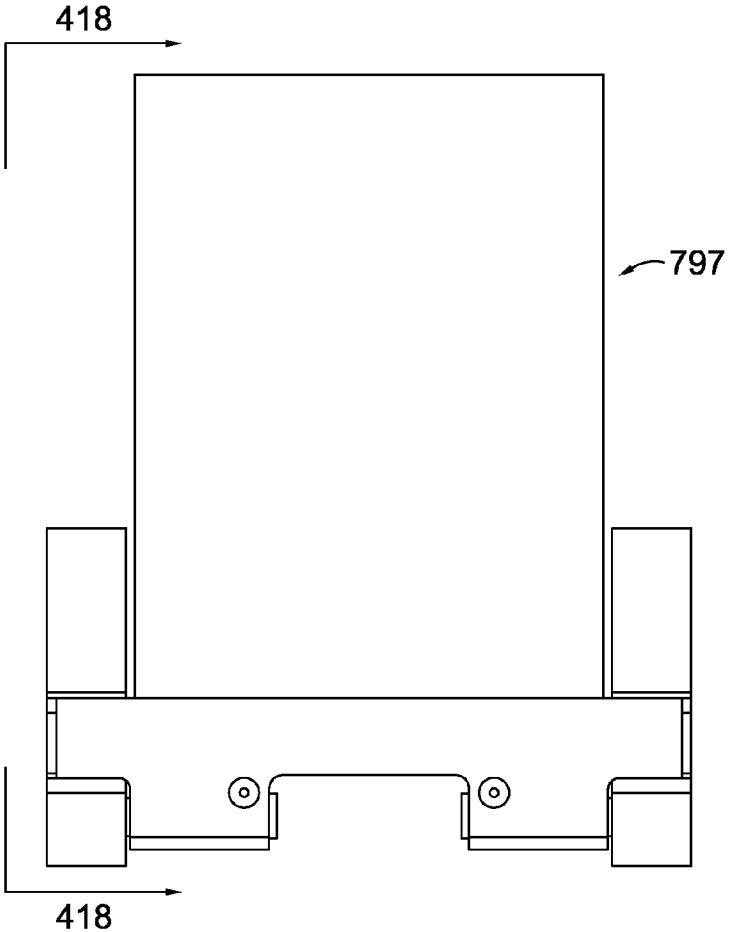

Referring again to FIG. 16, the base right beam 672 includes a plurality of right hinge recesses 741in spaced relation to each other along the length of the base right beam 672, and a base right hinge member 106 is fixedly secured within each of the right hinge recesses 741. A close-up view exemplary of a base right hinge member 106 is shown in FIG. 41. Additionally, the base right beam 672 preferably includes a plurality of small recesses 742 spaced along the length thereof, within which tie-down bars 743 are rigidly mounted for receiving tie-down straps of the type known in the art for securing the contents of the container 10 during shipping.

As shown in FIG. 17, the base left beam 685 includes a plurality of left hinge recesses 744 in spaced relation to each other along the length of the base left beam 685, and a base left hinge member 745 is fixedly secured within each of the left hinge recesses 744. The base left hinge member 745 is similar in design and function to the base right hinge member 106 shown in FIG. 41. Additionally, the base left beam 685 preferably includes a plurality of small recesses 746 spaced along the length thereof, within which tie-down bars 747 are rigidly mounted for receiving tie-down straps of the type known in the art for securing the contents of the container 10 during shipping.

Figure 27:
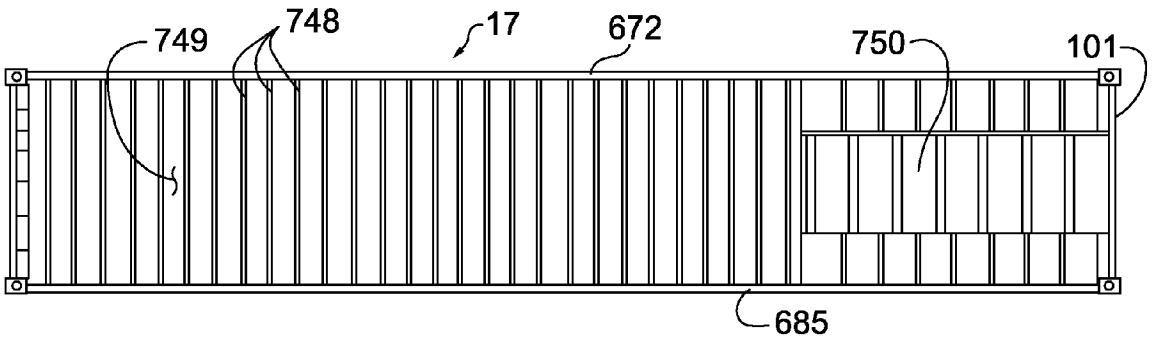
FIG. 27 is a plan view of the underside of the base panel.
Figure 28:
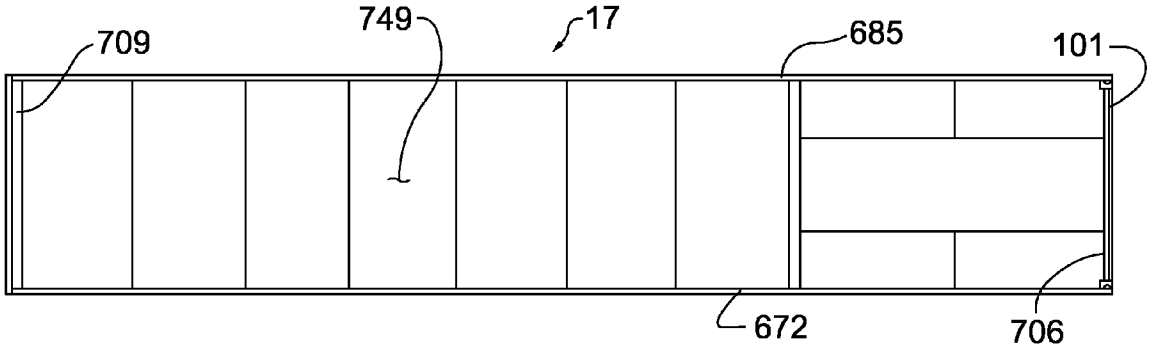
FIG. 28 is a plan view of the upper side of the base panel.

As shown in FIGS. 3, 27 & 28, a plurality of base support beams 748 are secured to the base right beam 672 and the base left beam 685 and span therebetween to add structural rigidity to the floor 749 of the base panel 17. Adjacent the base front edge 101, the base panel 17 includes a "gooseneck tunnel" 750 of the type known in the art. As shown in FIG. 3, a pair of hollow, base lifting beams 751, 752 are secured to the base right beam 672 and the base left beam 685, preferably by welding, and span therebetween to add structural rigidity to the base panel 17 and to provide means for lifting the foldable container 10 by use of a fork lift if desired. The floor 749 of the base panel 17 is preferably made of a sheet of Cor-Ten steel extending from the base right beam 672 to the base left beam 685, and from the base front beam 706 to the base door beam 709. The floor 749 is welded about its entire periphery to the right beam 672, the base left beam 685, the base front beam 706 and the base door beam 709, to make the base panel 17 watertight with respect to the floor 749. The floor 749 is also welded to the base support beams 748 and the base lifting beams 751, 752 for structural purposes. Preferably, the floor 749 is covered with plywood, or a similarly suitable flooring material.

Figure 29:
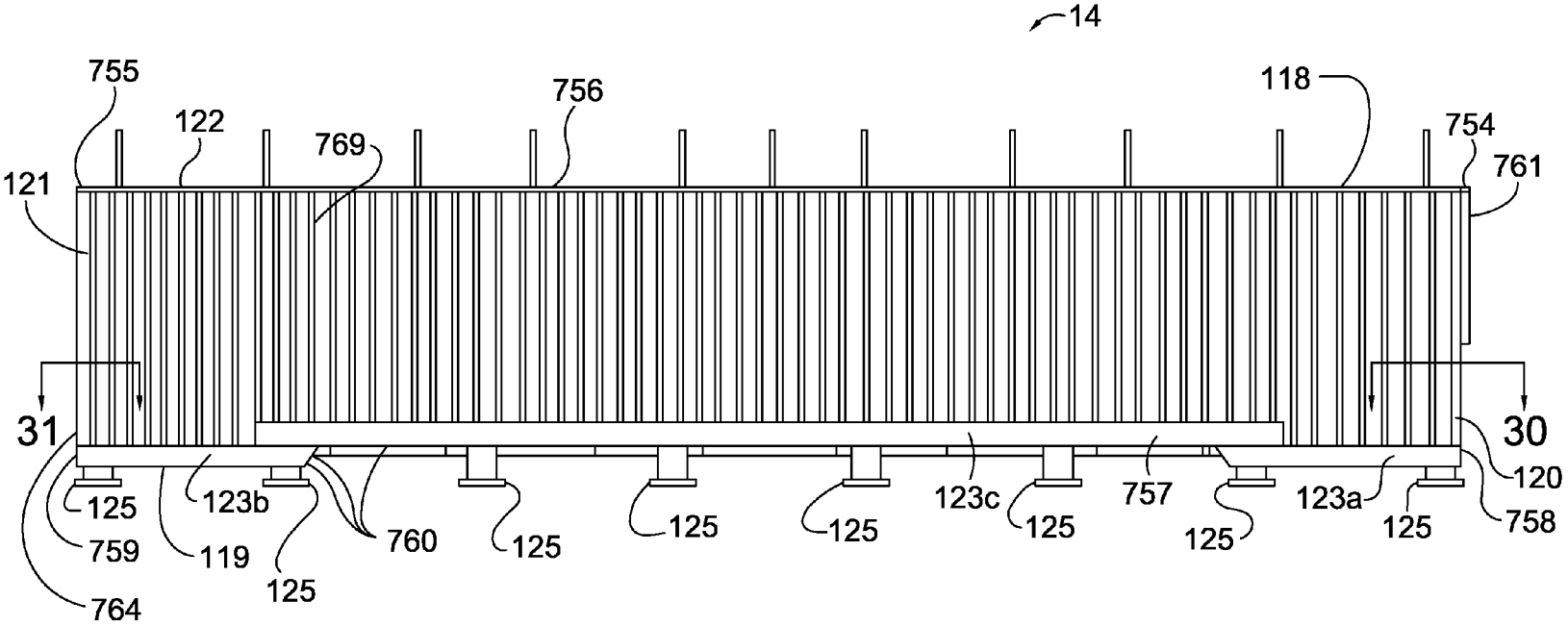
FIG. 29 is a plan view of the external surface of the right side panel.

As shown in FIG. 29, the right side panel 14 includes a top edge 118, a bottom edge 119, a front edge 120 and a door edge 121. Extending along the top edge 118 of the right side panel 14 along the length thereof is a right upper cap plate 122 having a front end 754, a door end 755, and a right roof flange 756 extending from the front end 754 to the door end 755. Extending along the bottom edge 119 of the right side panel 14 along the length thereof is a right compound beam 757 that has a front end 758 and a door end 759. The right compound beam 757 comprises a right upper horizontal beam 123*c* rigidly connected to two right lower horizontal beams 123*a*, 123*b*, preferably by welding. As shown in FIGS. 16 & 29, the lower edge 760 of the right compound beam 757 has a profile that matches the profile formed by the upper edge 680 of the base right beam upper portion 677, the top edges 683, 684 of the base right beam lower portions 675, 676, and the sloped right transition portions 103*a*, 103*b* of the base panel 17, to provide mating sealing surfaces when the container 10 is in its unfolded condition.

Figure 30:
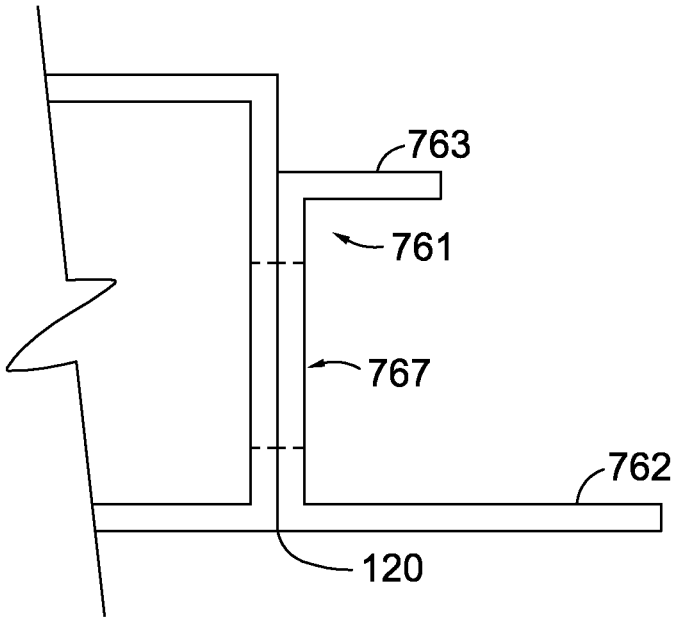
FIG. 30 is a cross sectional view of the flanges at the front edge of the right side panel.
Figure 31:
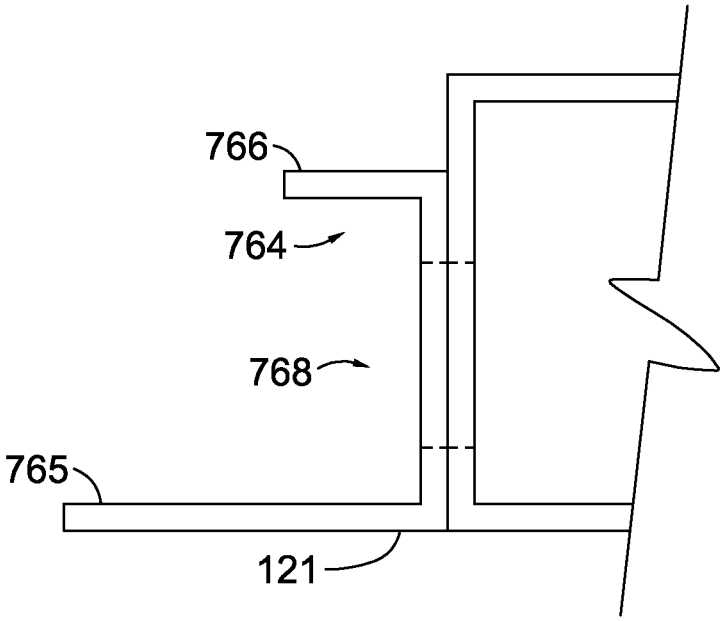
FIG. 31 is a cross sectional view of the flanges at the door edge of the right side panel.

As shown in FIG. 29, a right front member 761 extends from the front end 754 of the right upper cap plate 122 to the front end 758 of the right compound beam 757, and is fixedly secured to the front ends 754, 758, preferably by welding. As shown in FIG. 30, the right front member 761 includes a long flange 762 and a short flange 763, each of which extends along the length of the right front member 761 and towards the front edge 101 of the base panel 17. As shown in FIG. 29, a right door member 764 extends from the door end 755 of the right upper cap plate 122 to the door end 759 of the right compound beam 757, and is fixedly secured to the door ends 755, 759, preferably by welding. The right door member 764 includes a long flange 765 and a short flange 766, each of which extends along the length of the right door member 764 and towards the door edge 102 of the base panel 17, as shown in FIG. 31. The right front member 761 and the right door member 764 each have a plurality, and preferably three, right side bolt holes 767, 768 for receiving locking bolts as described in greater detail below.

Referring again to FIG. 29, corrugated sheet metal 769 extends from the right upper cap plate 122 to the right compound beam 757 along the entire length thereof, and from the right front member 761 to the right door member 764 along the entire length thereof. The corrugated sheet metal 769 is welded along its entire perimeter to the immediately adjacent right upper cap plate 122, right front member 761, right compound beam 757, and right door member 764. As shown in FIG. 1, the corrugated sheet metal 769 is welded to the right front member 761 and the right door member 764 such that the long flanges 762, 765 are visible from the exterior of the container 10 in its unfolded condition.

Figure 32:
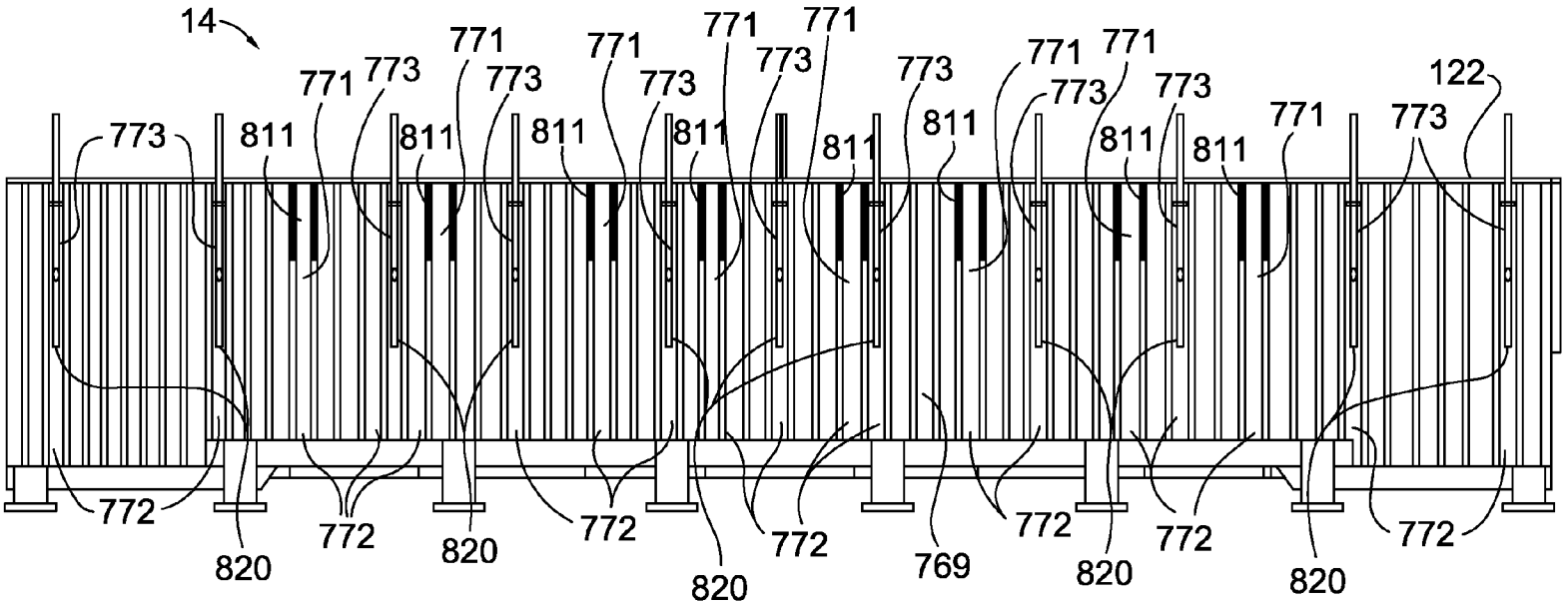
FIG. 32 is a plan view of the internal surface of the right side panel.

As shown in FIG. 29, extending downwardly from the bottom edge 119 of the right side panel 14 are a plurality of right side hinge members 125, each of which is fixedly secured to the right compound beam 757. Each right side hinge member 125 is rotatably connected to one of the base right hinge members 106 of the base panel 17 by one or more hinge pins 770, so as to allow the right side panel 14 to rotate relative to the base panel 17. As shown in FIG. 32, a plurality of linear spring assemblies 771 are mounted to the right side panel 14 within corrugations 772 of the corrugated sheet metal 769, as are a plurality of locking bolt assemblies 773.

Figure 33:
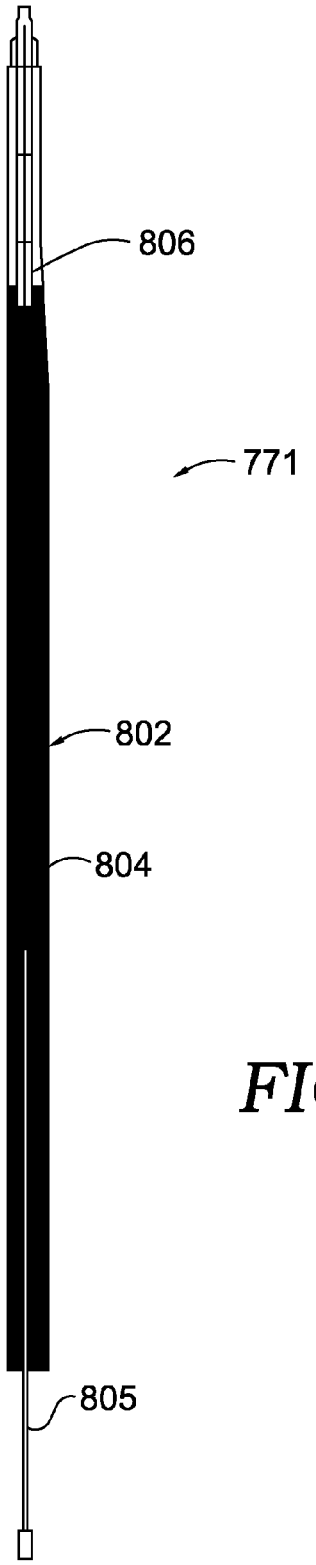
FIG. 33 is a cross sectional view of a linear spring assembly.
Figure 34:
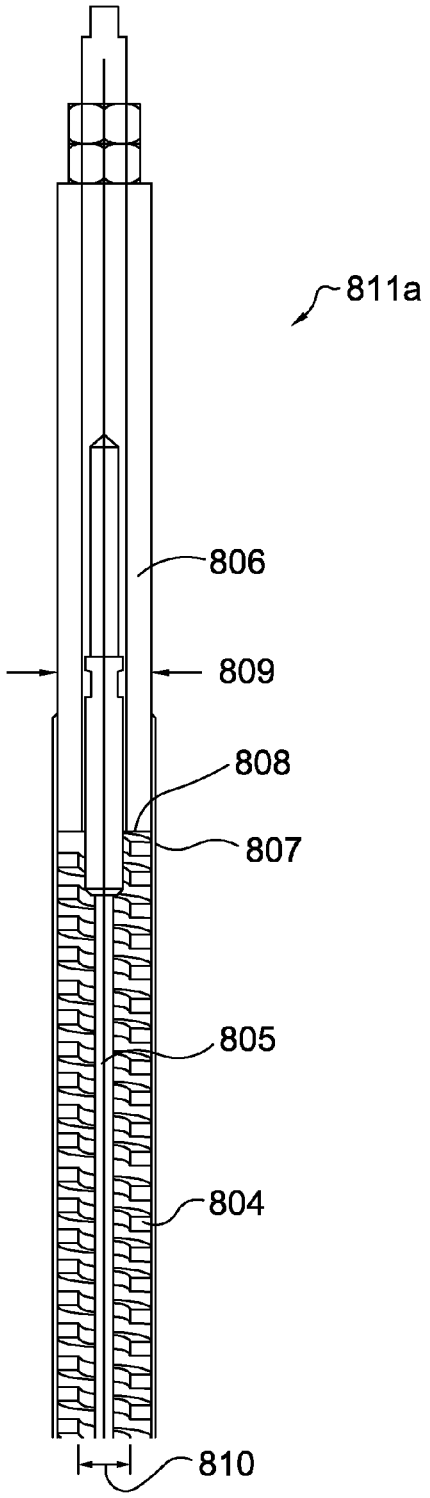
FIG. 34 is a cross sectional view of the upper end of a linear spring assembly.
Figure 35:
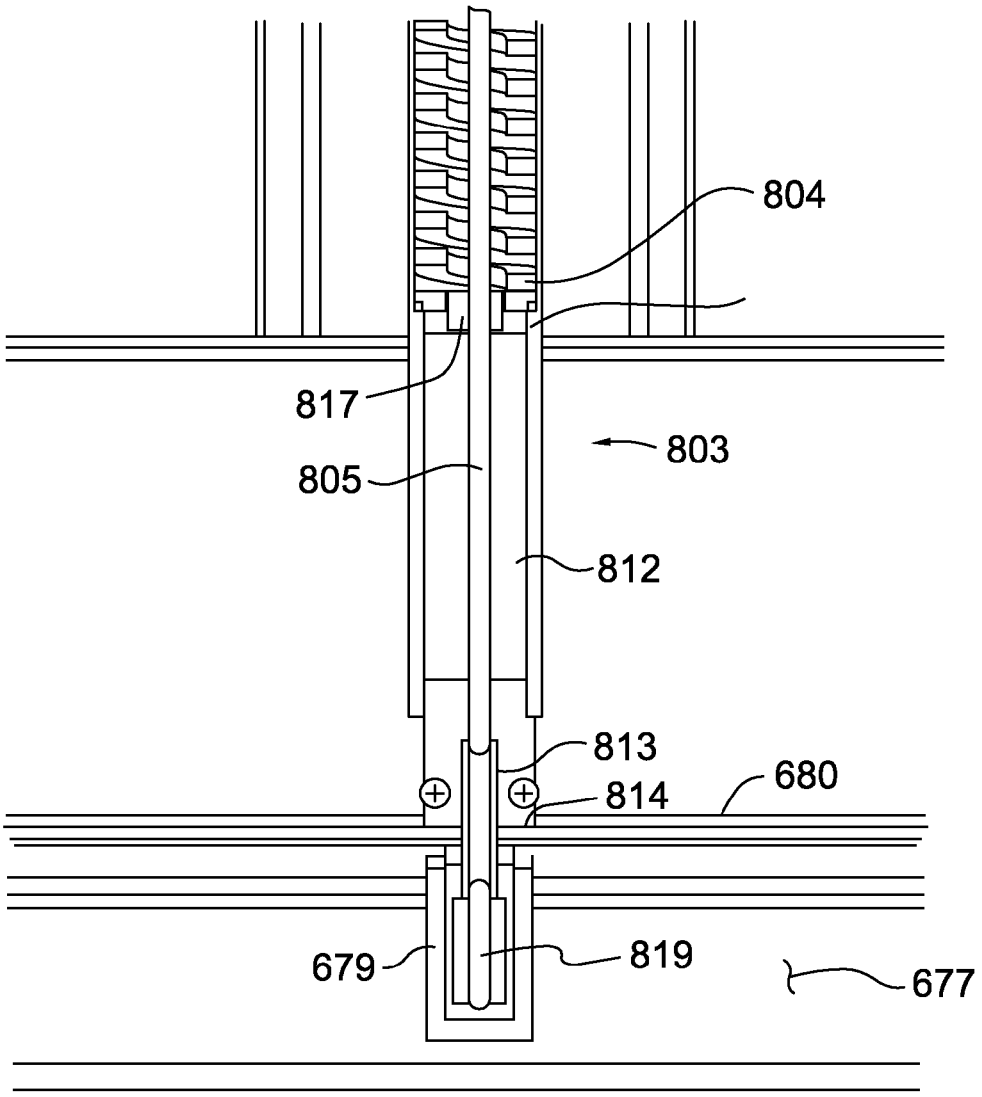
FIG. 35 is a cross sectional view of the lower end of a linear spring assembly.

As shown in FIGS. 33-35, each right side linear spring assembly 771, includes a tube 802 fixedly secured to a tube base 803 mounted within the right upper horizontal beam 123*c*. A compression spring 804, cable 805, and plunger 806 are received within each tube 802. The upper end of the cable 805 is secured to the plunger 806. Each plunger 806 has a plunger foot 808 which is in contact with the upper end 807 of the compression spring 804, and each plunger foot 808 has a diameter 809 that is at least as large as the inner diameter 810 of the compression spring 804 to prevent the plunger 806 from sliding through the compression spring 804. Referring again to FIG. 32, a tube shield 811 secured to the corrugated sheet metal 769 retains and protects the upper end 811*a* of each tube 802, as well as the plunger 806 attached thereto, during use of the container 10.

As shown in FIG. 35, each tube base 803 includes a cable channel 812 within which is rotatably mounted a cable pulley 813 adjacent the lower edge 814 thereof. The upper end 815 of each tube base 803 has a diameter 816 that is at least as large as the inner diameter 810 of the compression spring 804 to support the compression spring 804 against the force applied by the plunger foot 808 at the upper end 807 of the compression spring 804. In addition, the upper end 815 of each tube base 803 has an opening 817 through which the cable 805 passes, and the opening 817 has a diameter 818 that is smaller than the inner diameter 810 of the compression spring 804 to prevent the compression spring 804 from sliding therethrough. The lower end 819 of each cable 805 is attached to one of the cable anchors 679 secured to the base right beam upper portion 677 adjacent the upper edge 680 thereof. It is to be understood that when the container 10 is in the unfolded condition, each cable anchor 679 is vertically aligned with the tube 802 that contains the cable 805 that is attached to such cable anchor 679.

Figure 36:
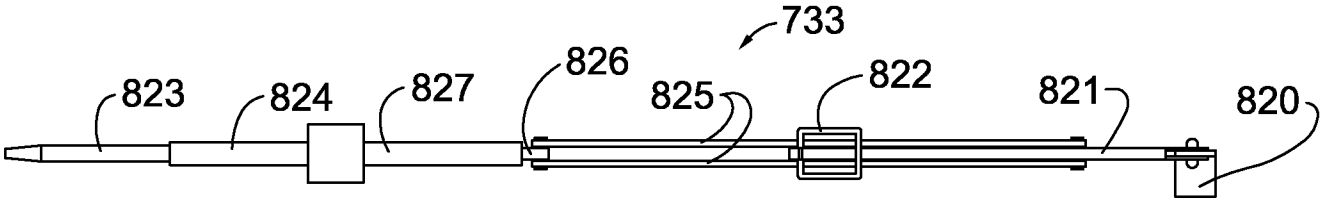
FIG. 36 is a plan view of a locking rod assembly in isolation.

As shown in FIG. 32, the plurality of locking bolt assemblies 773 are mounted to the right side panel 14 within the corrugations 772 of the corrugated sheet metal 769. As shown in FIGS. 32 & 36, each locking bolt assembly 773 includes a pivot anchor 820, a positioning lever 821 with a handle 822 attached thereto, a locking bolt 823, a locking bolt guide 824, and a pair of links 825 pivotably connecting the lower end 826 of the locking bolt 823 to the positioning lever 821. Each of the locking bolt guides 824 includes a guide tube 827 that extends through, and is fixedly secured to the right upper cap plate 122, and one locking bolt 823 is slideably received within each of the guide tubes 827. Each pivot anchor 820 is fixedly secured to the corrugated sheet metal 769, and each positioning lever 821 is pivotably connected to one of the pivot anchors 820.

As those skilled in the art will readily appreciate, each of the locking bolt assemblies 773 so described is selectively positionable between a first position in which the locking bolt 823 is received within one of the locking bolt holes 610 in the lower face 608 of the roof right beam 600, when the container 10 is in the unfolded condition, and a second position in which the locking bolt 823 is fully withdrawn from that locking bolt hole 610.

Figure 37:
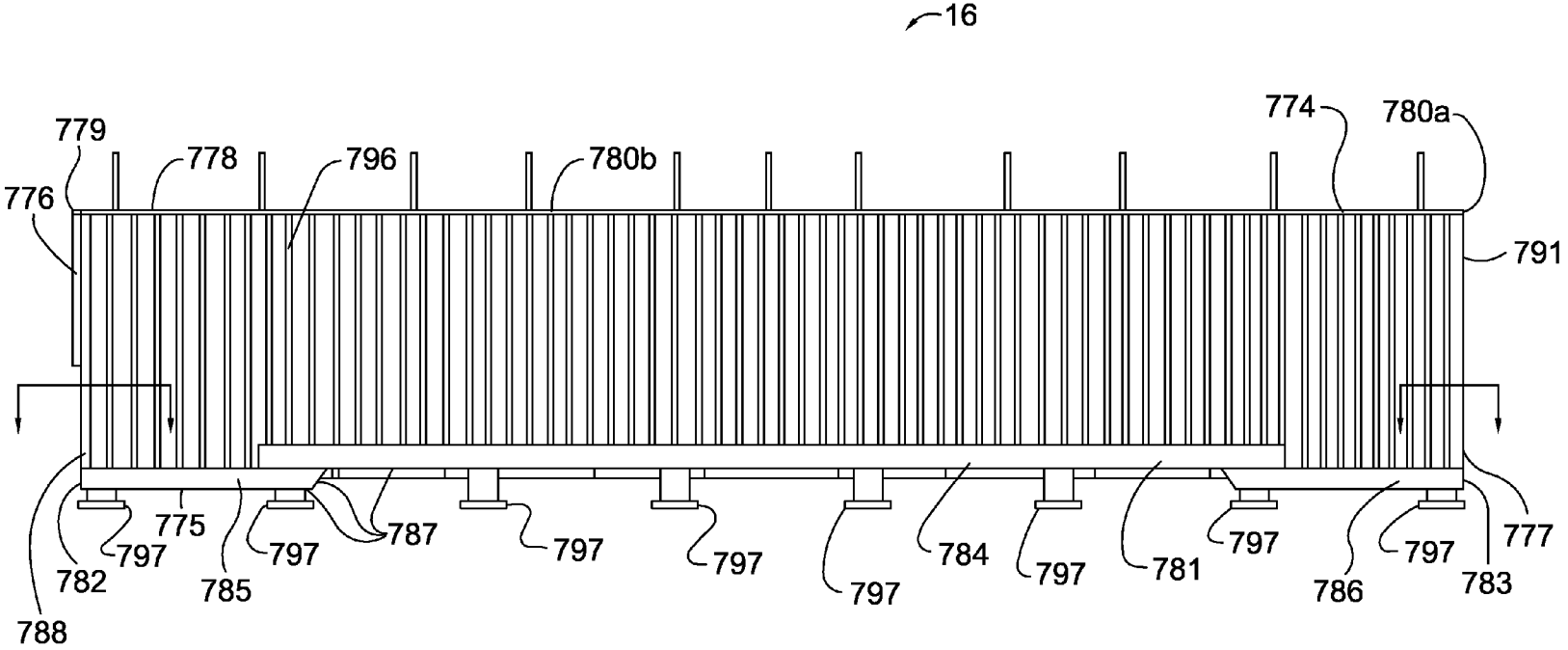
FIG. 37 is a plan view of the external surface of the left side panel.

As shown in FIG. 37, the left side panel 16 includes a top edge 774, a bottom edge 775, a front edge 776 and a door edge 777. Extending along the top edge 774 of the left side panel 16 along the length thereof is a left upper cap plate 778 having a front end 779, a door end 780*a*, and a left roof flange 780*b* extending from the front end 779 to the door end 780. Extending along the bottom edge 775 of the left side panel 16 along the length thereof is a left compound beam 781 that has a front end 782 and a door end 783. The left compound beam 781 comprises a left upper horizontal beam 784 rigidly connected to two left lower horizontal beams 785, 786, preferably by welding. As shown in FIGS. 17 & 37, the lower edge 787 of the left compound beam 781 has a profile that matches the profile formed by the upper edge 692 of the base left beam upper portion 677, the top edges 695, 696 of the base left beam lower portions 688, 689, and the sloped left transition portions 104*a*, 104*b* of the base panel 17, to provide mating sealing surfaces when the container 10 is in its unfolded condition.

Figure 38:
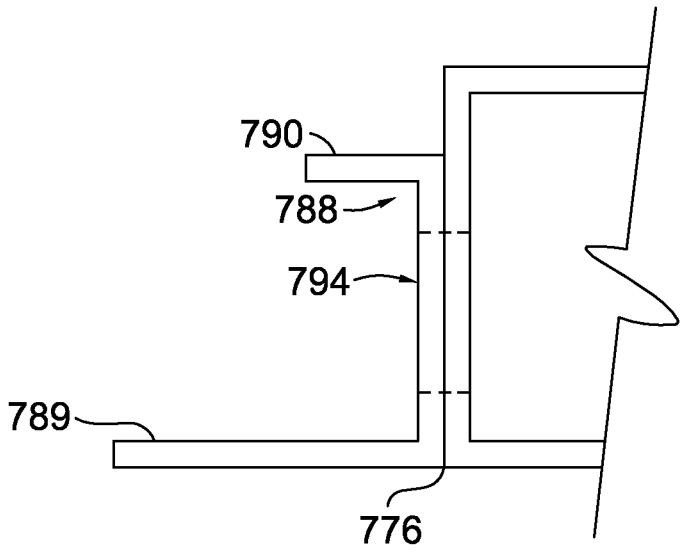
FIG. 38 is a cross sectional view of the flanges at the door edge of the left side panel.
Figure 39:
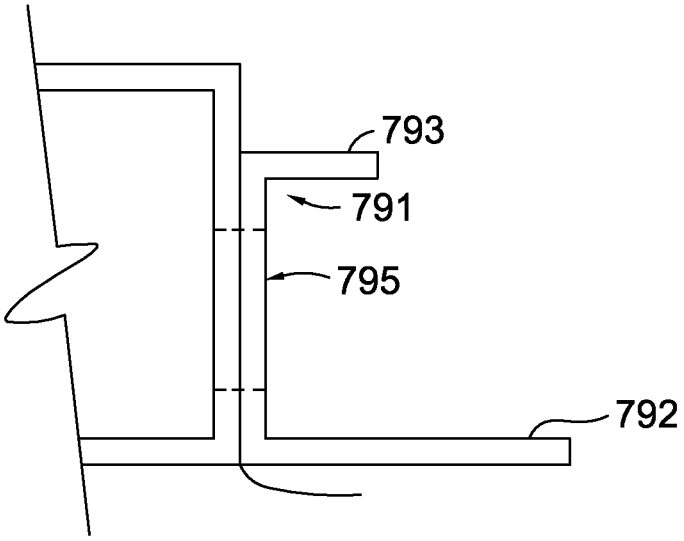
FIG. 39 is a cross sectional view of the flanges at the front.

As shown in FIG. 37, a left front member 788 extends from the front end 779 of the left upper cap plate 778 to the front end 782 of the left compound beam 781, and is fixedly secured to the front ends 779, 782, preferably by welding. As shown in FIG. 38, the left front member 788 includes a long flange 789 and a short flange 790, each of which extends along the length of the left front member 788 and towards the front edge 101 of the base panel 17. Referring again to FIG. 37, a left door member 791 extends from the door end 780*a* of the left upper cap plate 778 to the door end 783 of the left compound beam 781, and is fixedly secured to the door ends 780, 783, preferably by welding. As shown in FIG. 39, the left door member 791 includes a long flange 792 and a short flange 793, each of which extends along the length of the left door member 791 and towards the door edge 102 of the base panel 17. The left front member 788 and the left door member 791 each have a plurality, and preferably three, left side bolt holes 794, 795 for receiving locking bolts as described in greater detail below.

Figure 40:
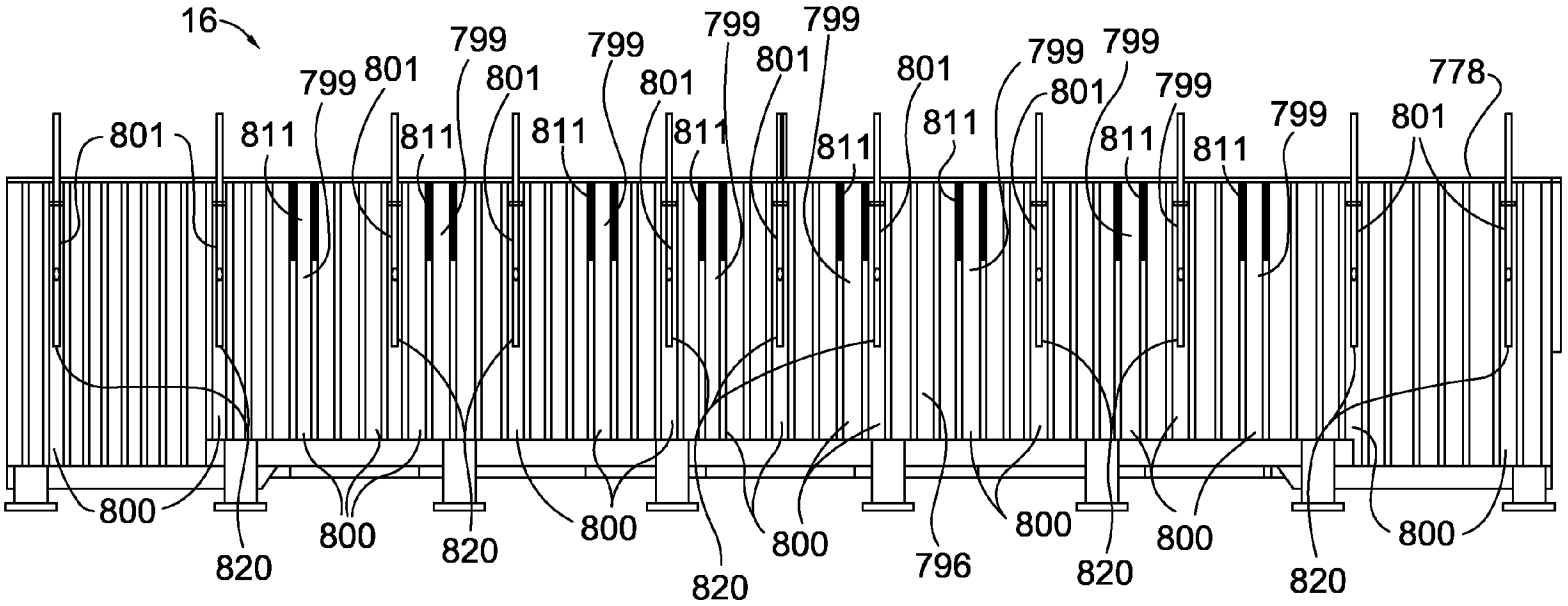
FIG. 40 is a plan view of the internal surface of the left side panel.

As shown in FIG. 40, corrugated sheet metal 796 extends from the left upper cap plate 778 to the left compound beam 781 along the entire length thereof, and from the left front member 788 to the right door member 791 along the entire length thereof. The corrugated sheet metal 796 is welded along its entire perimeter to the immediately adjacent left upper cap plate 778, left front member 788, left compound beam 781, and left door member 791. As shown in FIG. 2, the corrugated sheet metal 796 is welded to the left front member 788 and the left door member 791 such that the long flanges 789, 792 are visible from the exterior of the container 10 in its unfolded condition.

As shown in FIG. 37, extending downwardly from the bottom edge 775 of the left side panel 16 are a plurality of left side hinge members 797, each of which is fixedly secured to the left compound beam 781. Each left side hinge member 797 is rotatably connected to one of the base right hinge members 745 of the base panel 17 by one or more hinge pins 798, so as to allow the left side panel 16 to rotate relative to the base panel 17. The hinge member 797 is shown in isolation, and in greater detail, in FIGS. 41A and 41B. The design and function of hinge member 797 is the same as that of hinge member 125 on right side panel 14.

As shown in FIG. 40, a plurality of linear spring assemblies 799 are mounted to the left side panel 16 within corrugations 800 of the corrugated sheet metal 796, as are a plurality of locking bolt assemblies 801. The construction of the linear spring assemblies 799 is the same as those described with respect to the right side panel 14, except that each tube base 803 is mounted within the left upper horizontal beam 784, each tube shield 811 is secured to the corrugated sheet metal 796 of the left side panel 16, and the lower end 819 of each cable 805 is attached to one of the cable anchors 691 secured to the base left beam upper portion 690 adjacent the upper edge 692 thereof. It is to be understood that when the container 10 is in the unfolded condition, each cable anchor 691 is vertically aligned with the tube 802 that contains the cable 805 that is attached to such cable anchor 691.

Likewise, the construction of the locking bolt assemblies 801 is the same as those described with respect to the right side panel 14, except that each pivot anchor 820 is fixedly secured to the corrugated sheet metal 796 of the left side panel 16, and each guide tube 827 extends through, and is fixedly secured to, the left upper cap plate 778. As those skilled in the art will readily appreciate, each of the locking bolt assemblies 801 so described is selectively positionable between a first position in which the locking bolt 823 is received within one of the locking bolt holes 610 in the lower face 609 of the roof left beam 603, when the container 10 is in the unfolded condition, and a second position in which the locking bolt 823 is fully withdrawn from that locking bolt hole 610.

Figure 42:
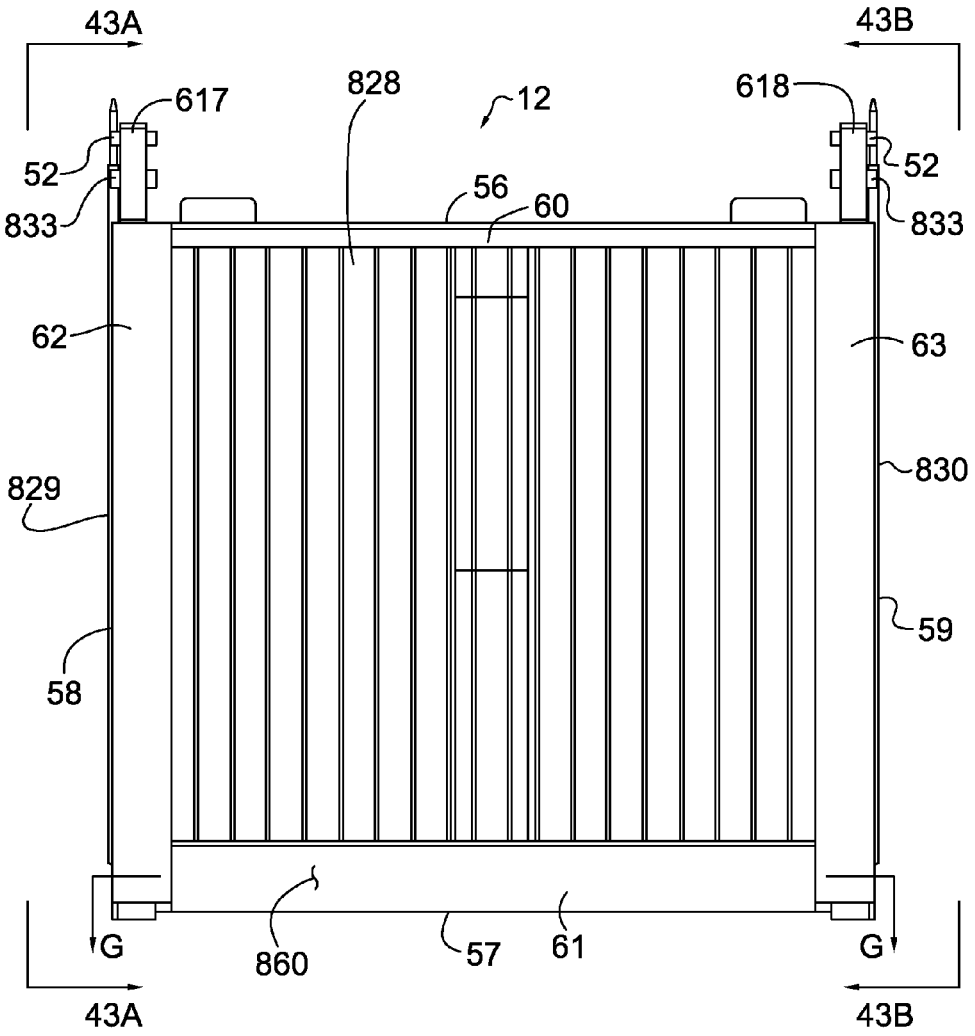
FIG. 42 is a plan view of the external surface of the front panel.
Figure 43B:
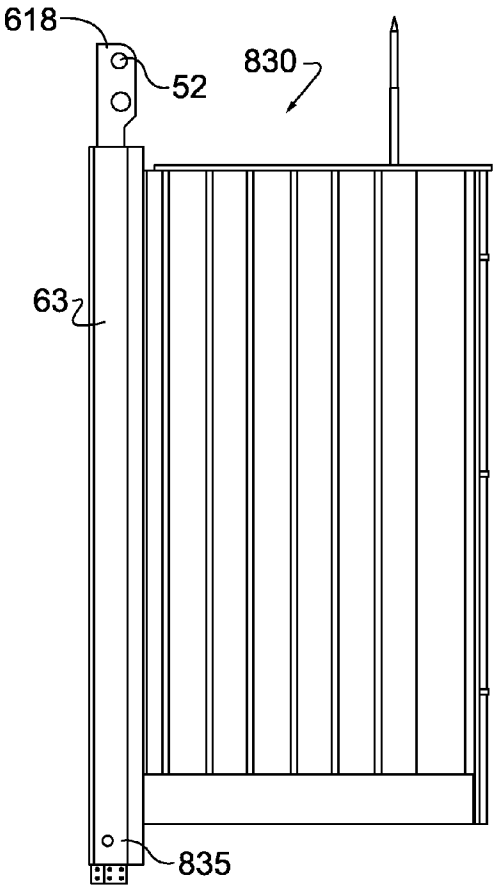
FIGS. 43A and 43B are plan views of the right and left front access panels.
Figure 43A:
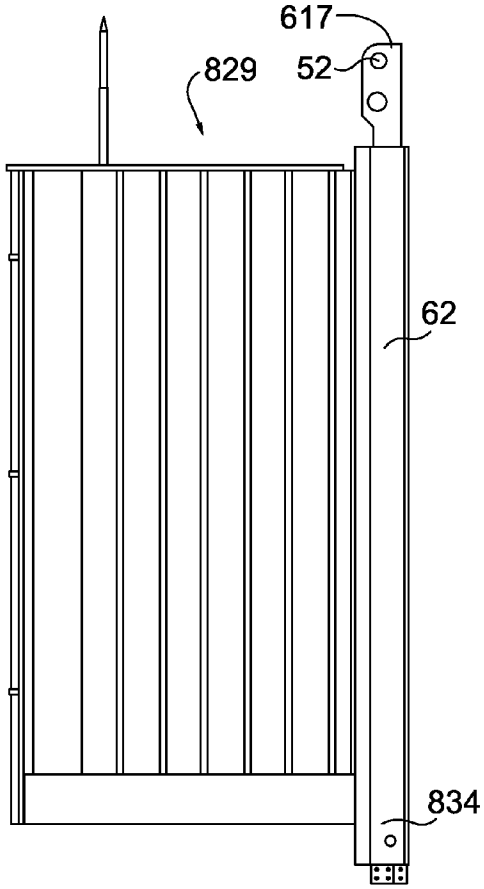

Referring now to FIGS. 42, 43A and 43B, the front panel 12 includes a front main panel 828, a front right access panel 829, and a front left access panel 830. The front main panel

828 includes a top edge 56, a bottom edge 57, a right edge 58, and a left edge 59. Extending along the top edge 56 of the front main panel 828 is a header 60 and along the bottom edge 57 is a sill panel 61, in spaced relation to the header 60. A right front post 62, hollow and rectangular in cross section, extends along the right edge 58 of the front main panel 828, and a left front post 63, also hollow and rectangular in cross section, extends along the left edge 59 of the front main panel 828. Lateral support for the front main panel 828 is provided by corrugated sheet metal which extends between the two front posts 62, 63 along the entire length thereof, and is welded around its periphery to the immediately adjacent sill panel 61, header 60, the right front post 62, and the left front post 63.

As shown in FIGS. 42, 43A, 43B and 44, extending upwardly from each of the front posts 62, 63 adjacent the top edge 56 of the front panel 828 is a front hinge pivot 617, 618. When assembled to the roof panel 11, each front hinge pivot 617, 618 is rotatably connected to one of the sets 613, 614 of front first hinge members 31*a*, 31*b*, 31*c*, 31*d* located adjacent the front edge 22 of the roof panel 11 by means of a hinge pin 52, so as to allow the front panel 12 to rotate relative to the roof panel 11.

Figure 44:
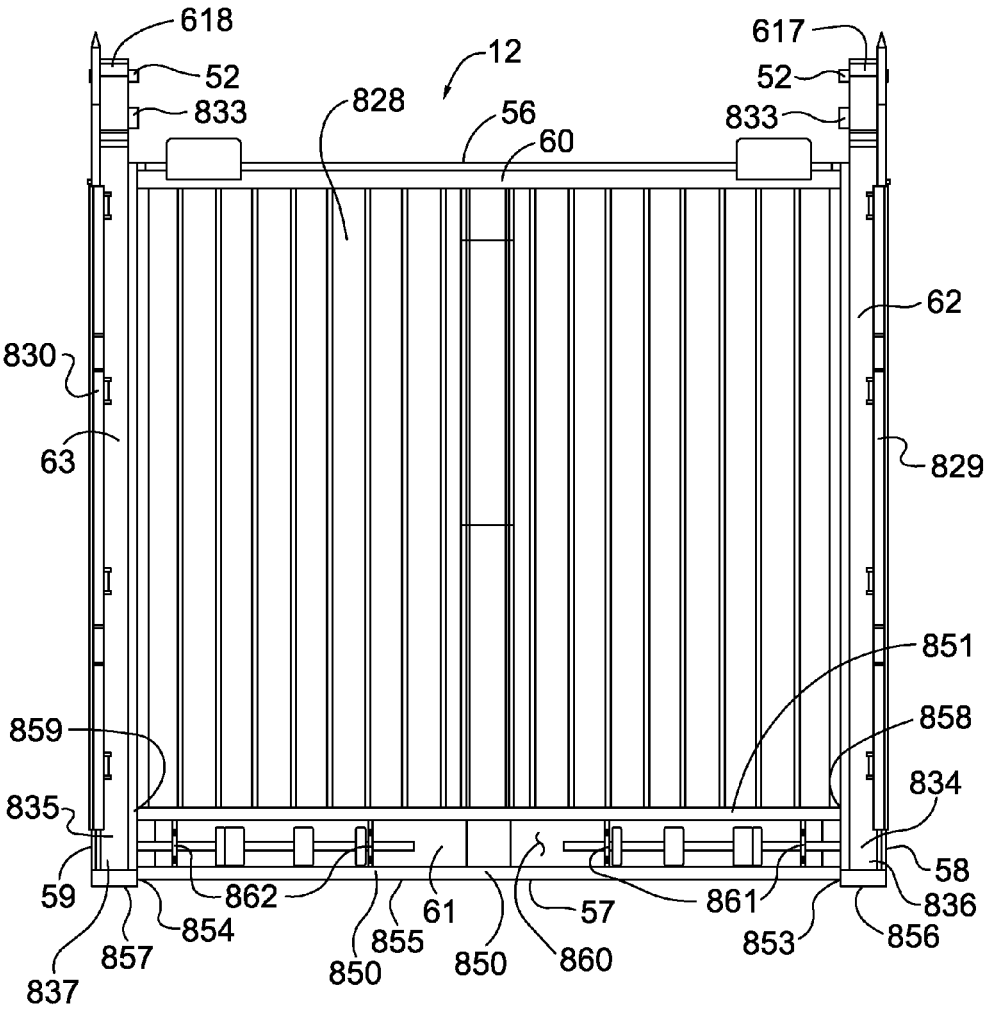
FIG. 44 is a plan view of the internal surface of the front panel.
Figure 45A:
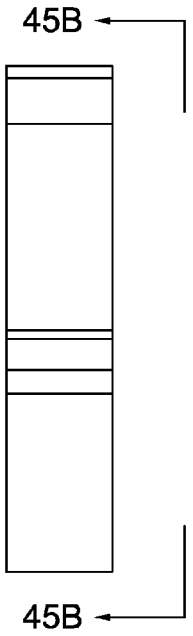
FIGS. 45A, 45B, 45C and 45D are views of the front pivot hinge.
Figure 45B:
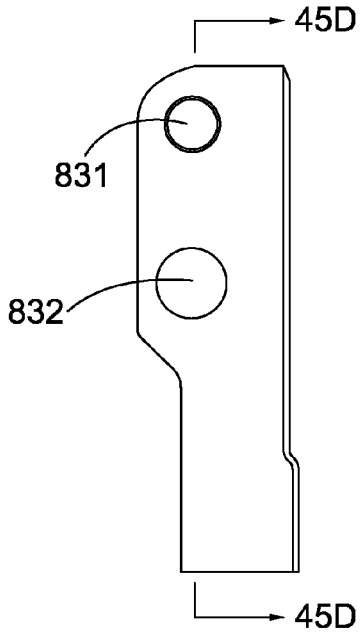
Figure 45C:
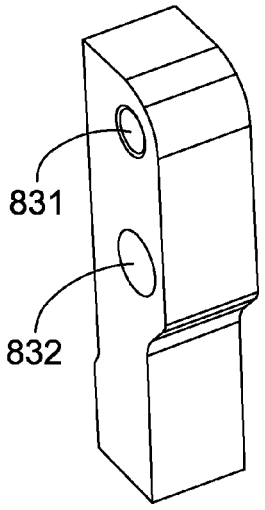
Figure 45D:
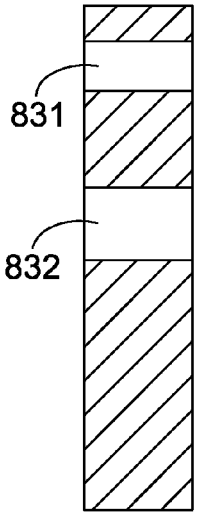
Figure 46:
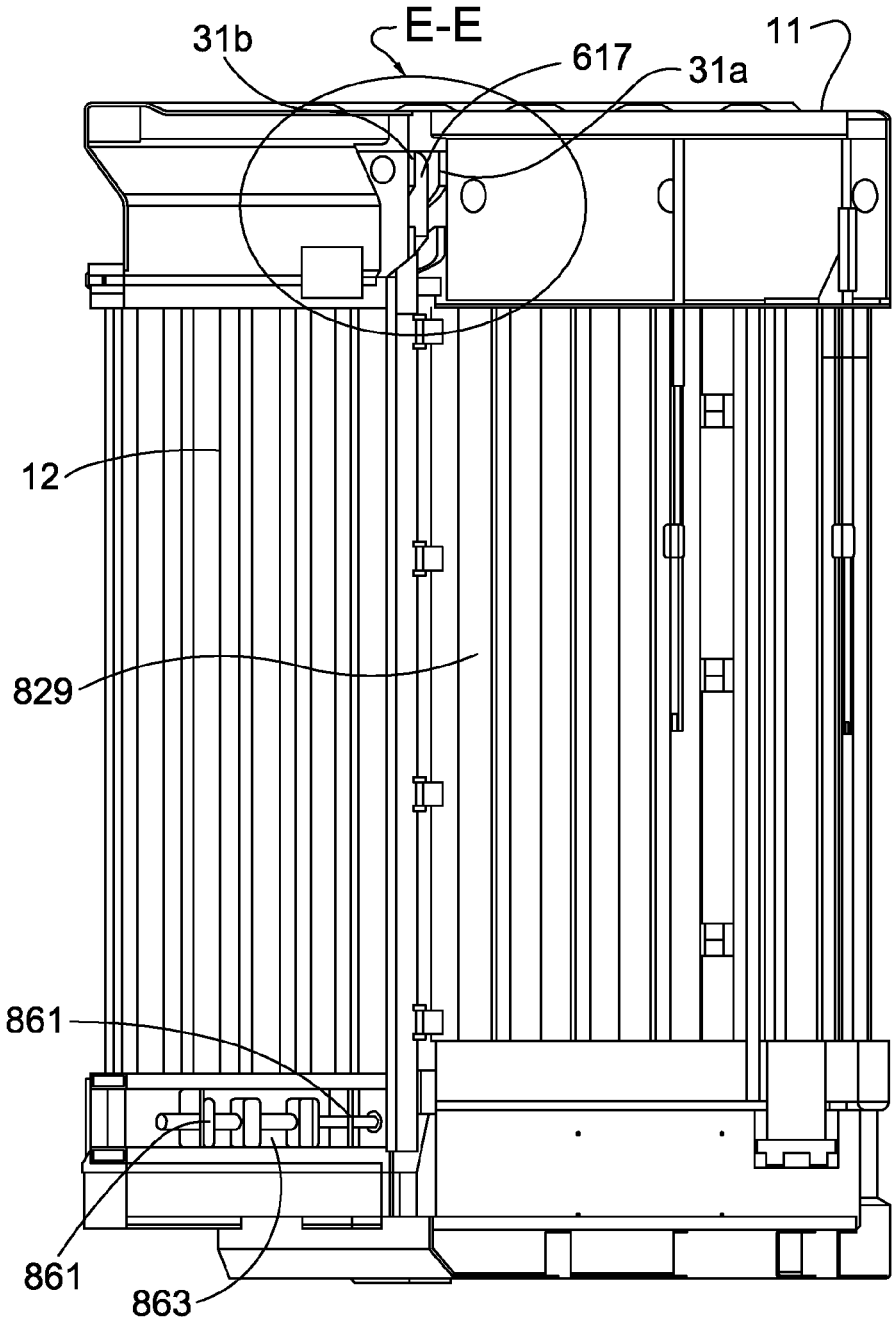
FIG. 46 is an internal view of the front end panel and right access panel.
Figure 47:
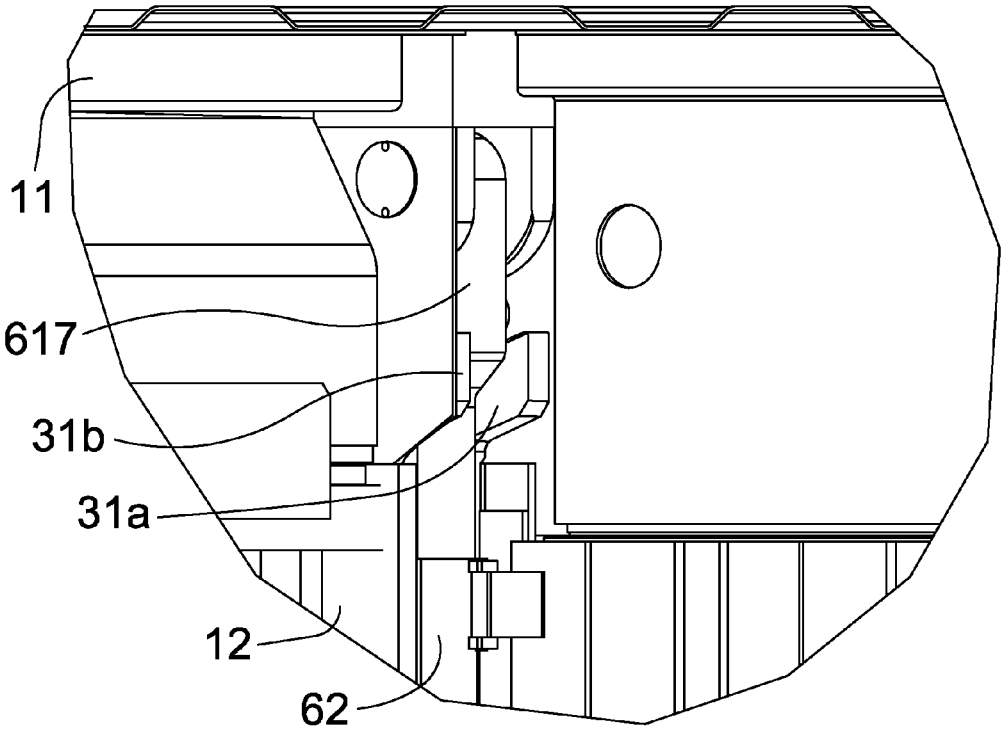
FIG. 47 is an enlarged view of section E-E of FIG. 46.
Figure 48:
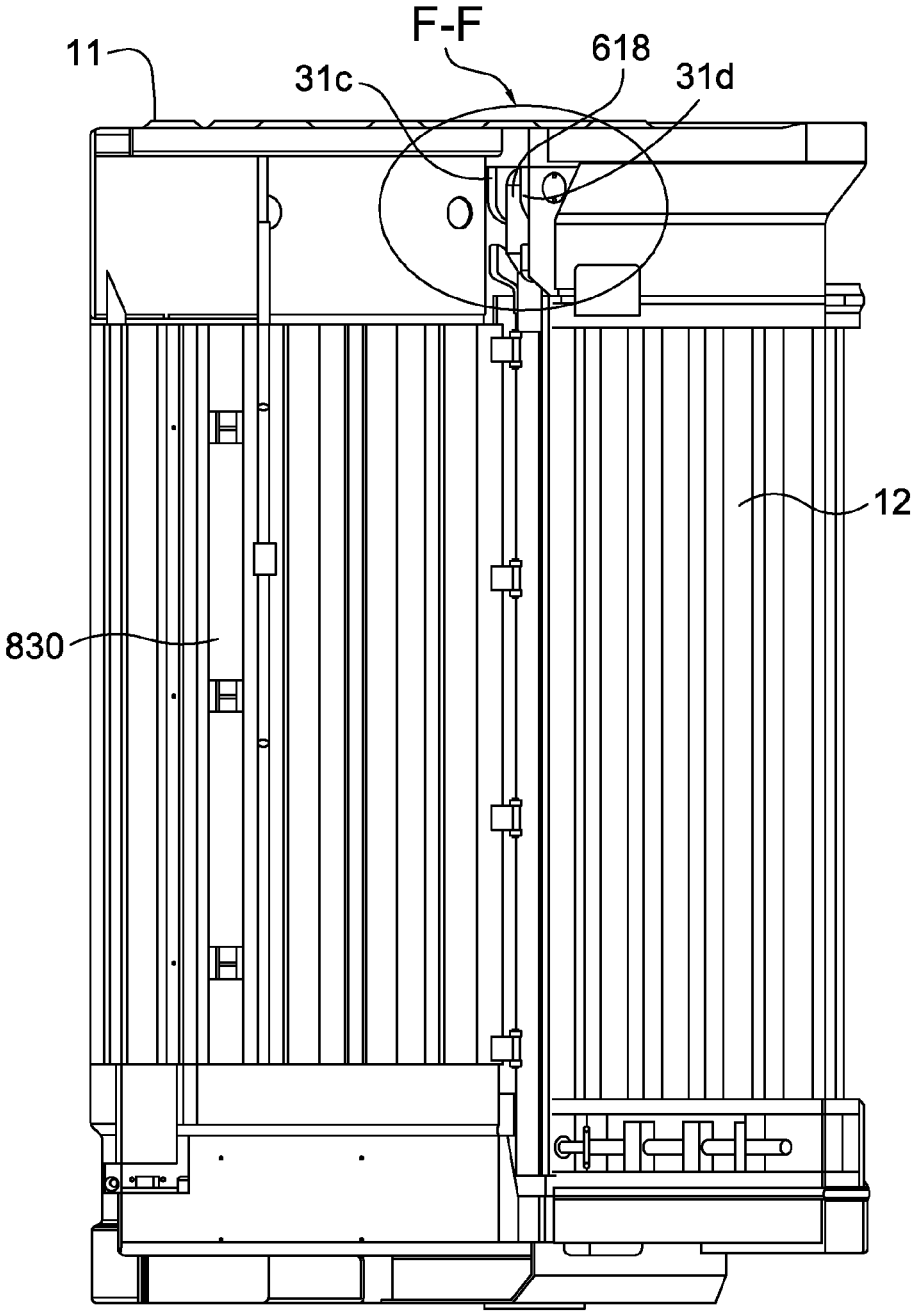
FIG. 48 is an internal view of the front end panel and left access panel.
Figure 49:
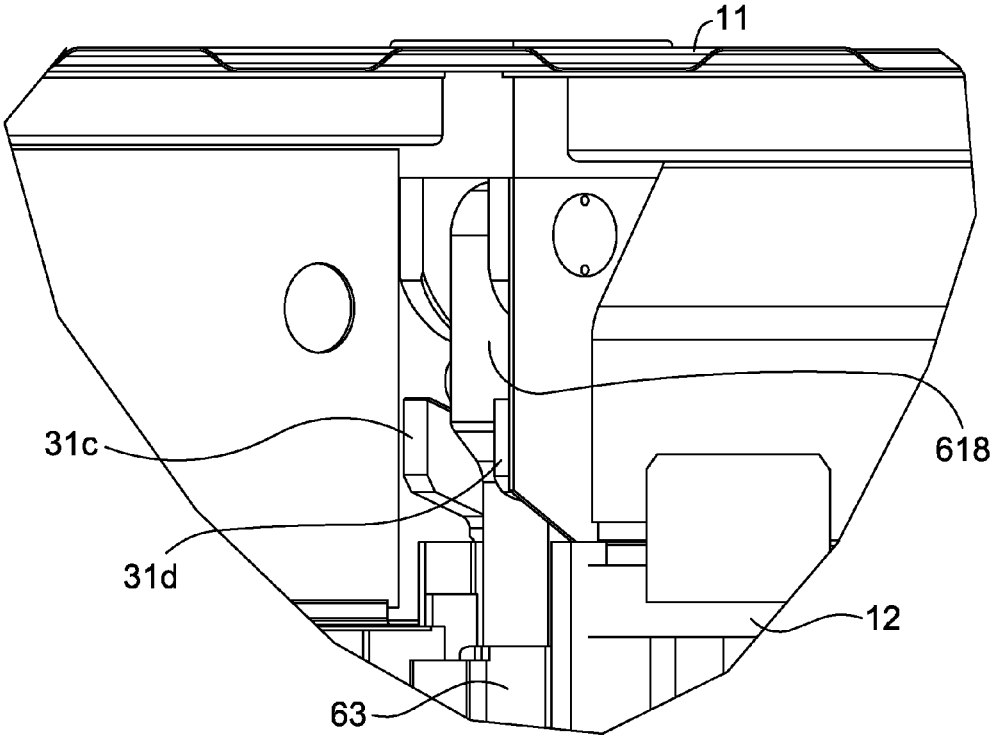
FIG. 49 is an enlarged view of section F-F of FIG. 48.
Figure 50:
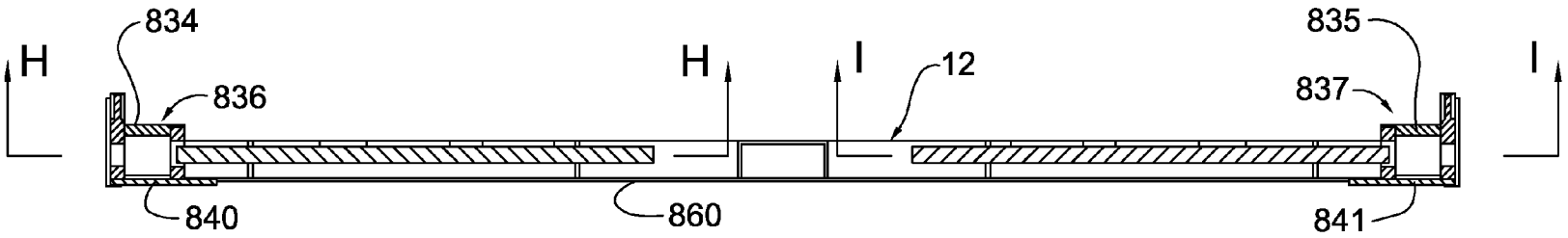
FIGS. 50, 51 and 52 are horizontal cross sectional views of the front panel interlocks.
Figure 52:
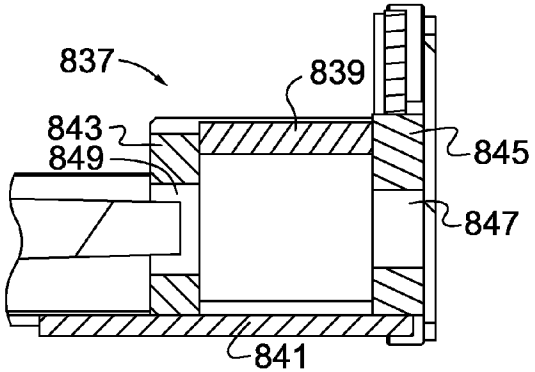
Figure 51:
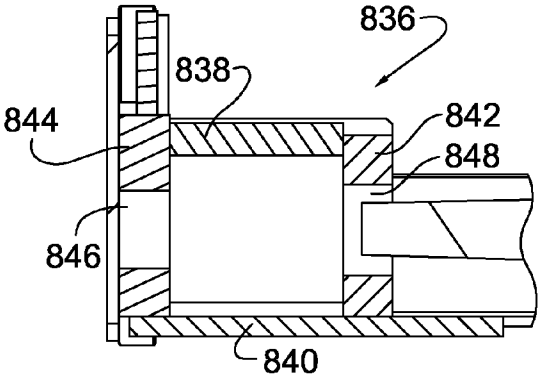
Figure 53:
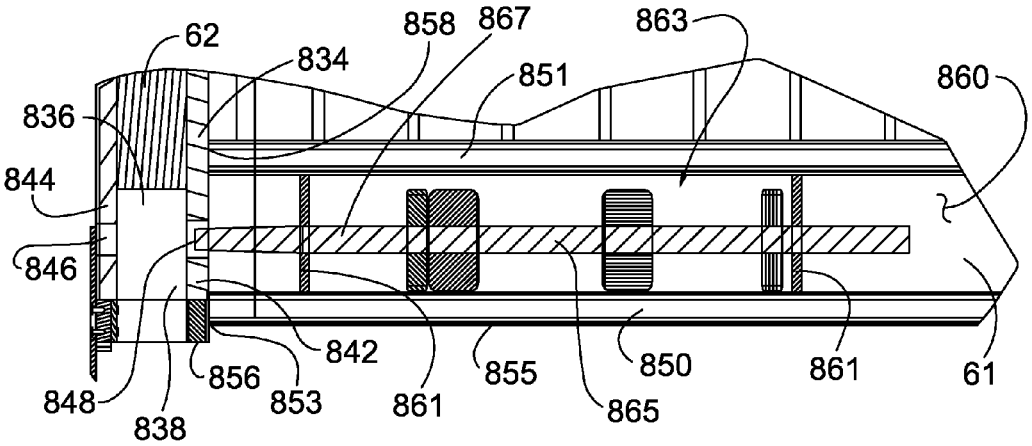
FIG. 53 is a cross sectional view taken along line H-H of FIG. 50.
Figure 54:
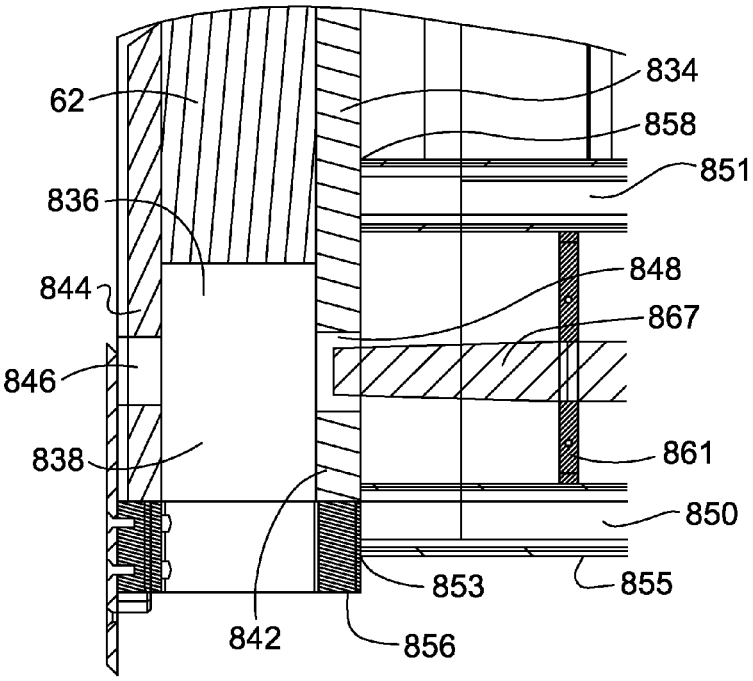
FIG. 54 is a cross sectional view of the right side interlock of the front panel.
Figure 55:
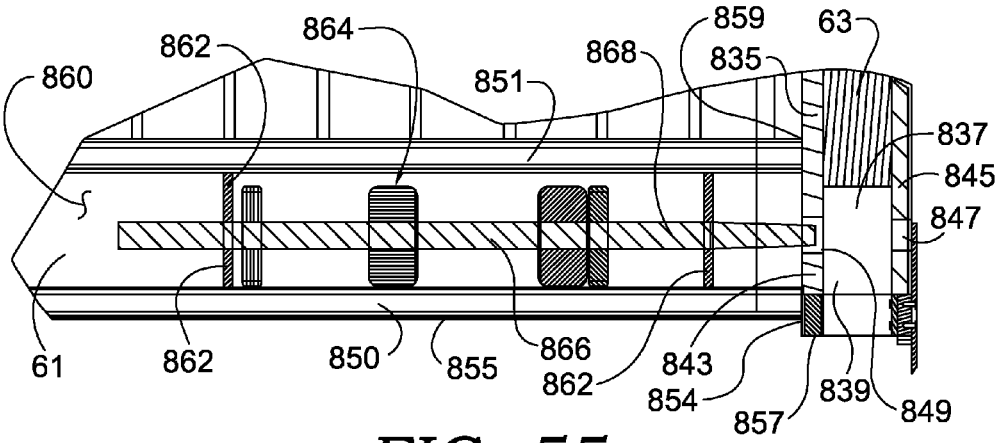
FIG. 55 is a cross sectional view taken along line I-I of FIG. 50.
Figure 56:
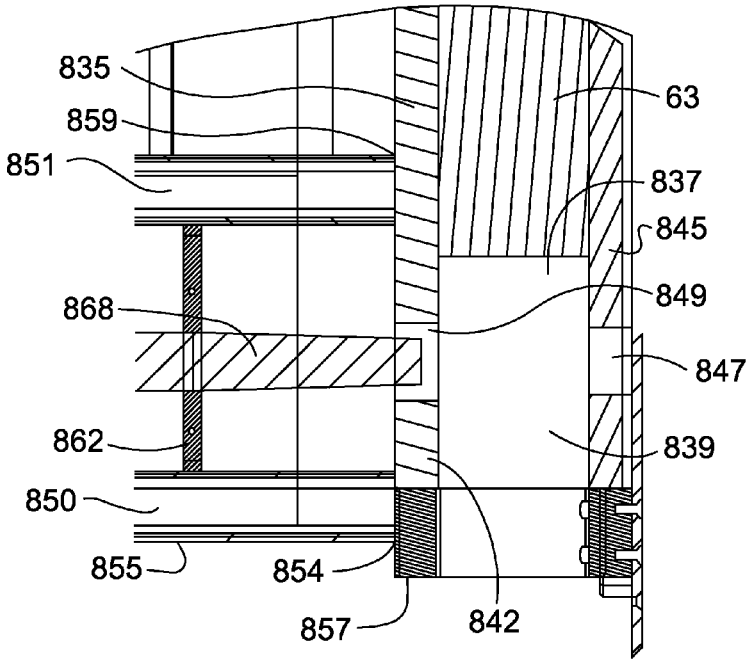
FIG. 56 is a cross sectional view of the left side interlock of the front panel.
Figure 57:
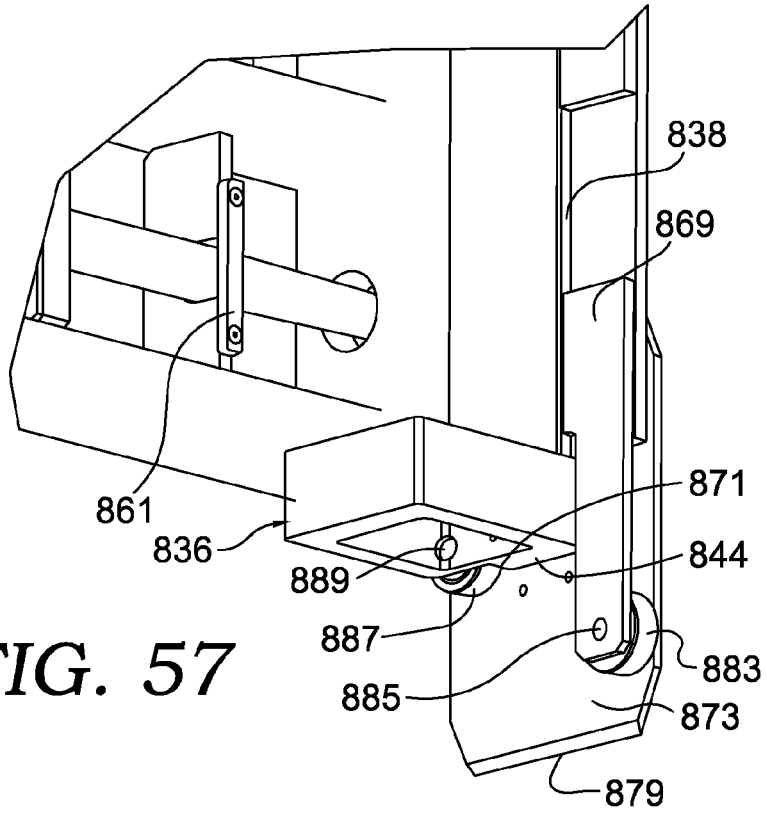
FIG. 57 is a perspective view of the right interlock of the front panel.
Figure 58:
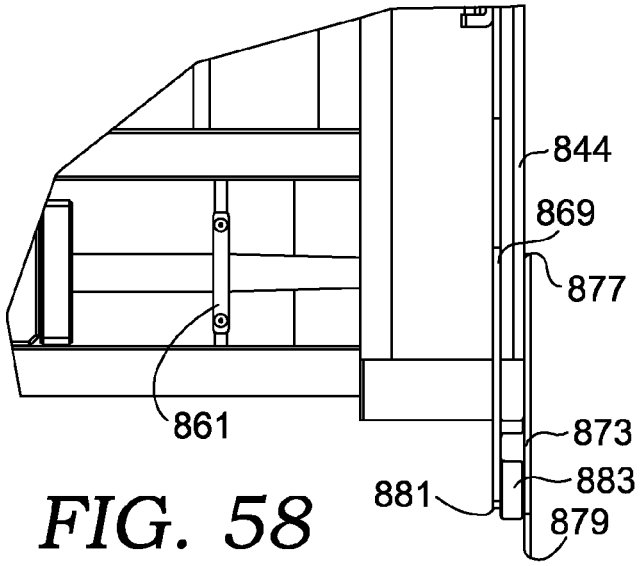
FIG. 58 is an inside view of the right interlock of the front panel.
Figure 61:
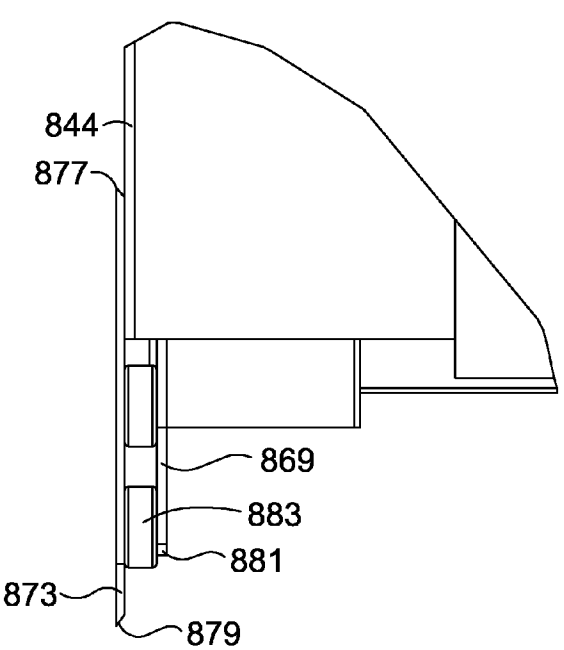
FIG. 61 is an end view of the roller arm cover plate of the front right post.
Figure 60:
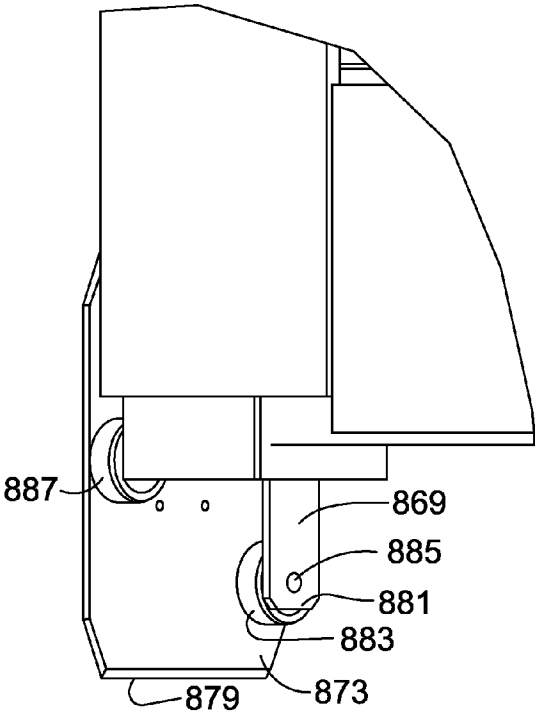
FIG. 60 is a perspective view of the roller arm cover plate of the front right post.
Figure 59:
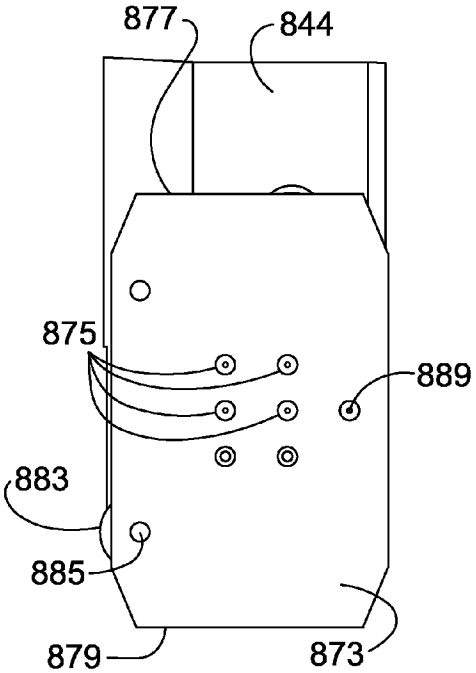
FIG. 59 is an external view of the roller arm cover plate of the front right post.
Figure 62:
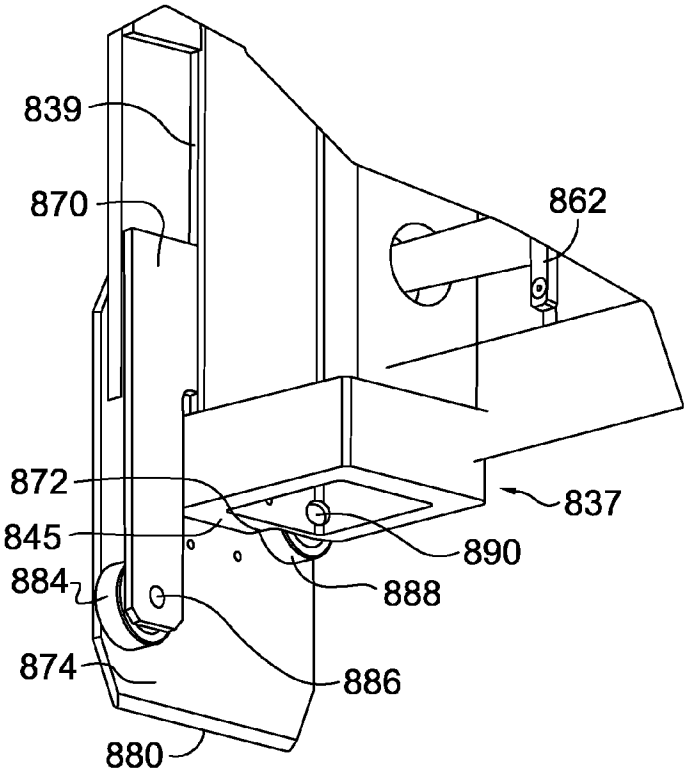
FIG. 62 is a perspective view of the left interlock of the front panel.
Figure 63:
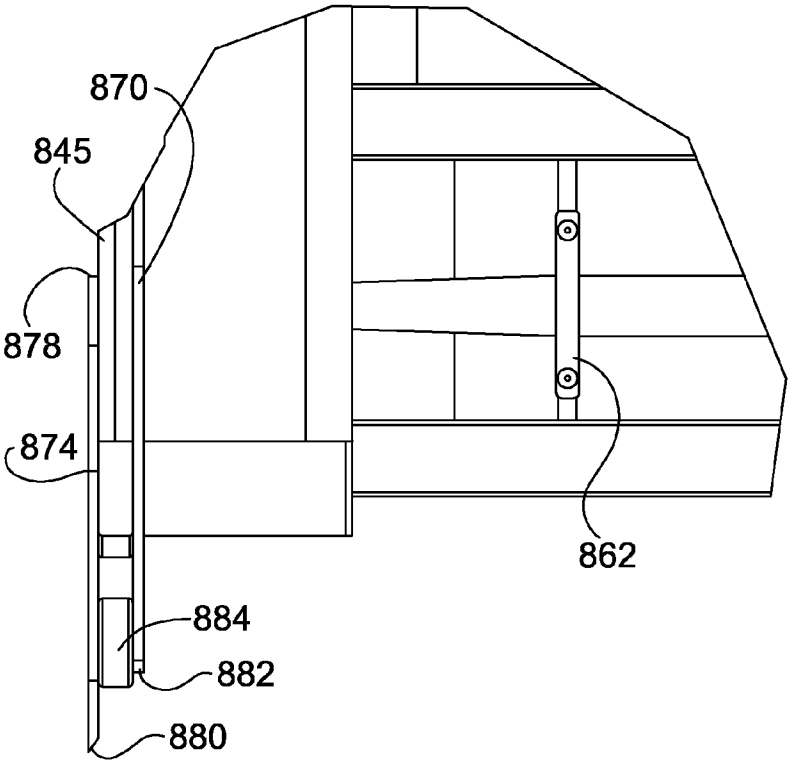
FIG. 63 is an inside view of the left interlock of the front panel.
Figure 66:
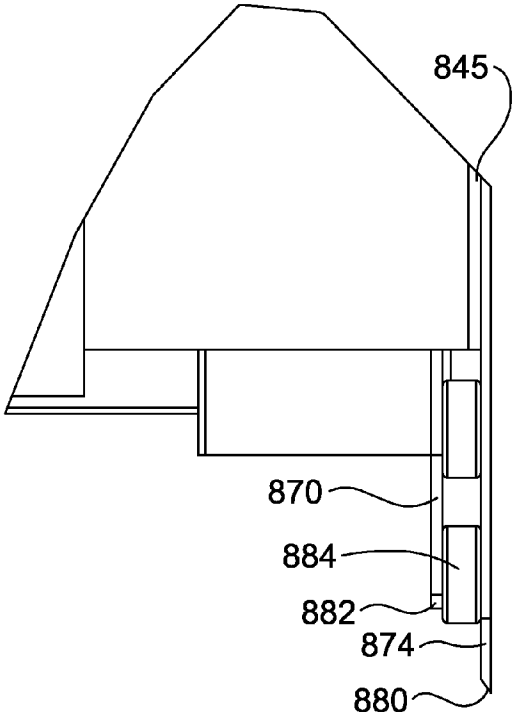
FIG. 66 is an end view of the roller arm cover plate of the front left post.
Figure 65:
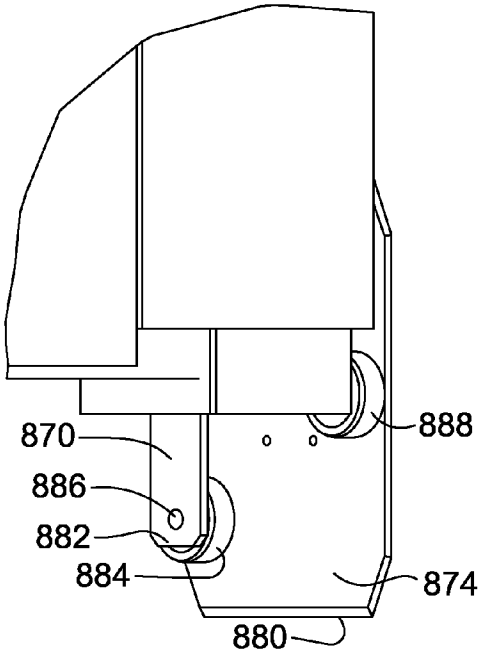
FIG. 65 is a perspective view of the roller arm cover plate of the front left post.
Figure 64:
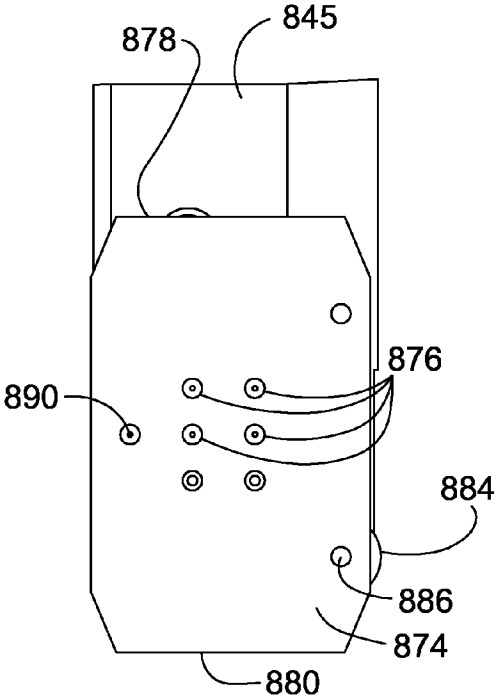
FIG. 64 is an external view of the roller arm cover plate of the front left post.

The front hinge pivot 617 adjacent the right edge 58 of the front main panel 828, and the front hinge pivot 618 adjacent the left edge 59 of the front main panel 828 are identical, and a representative front hinge pivot 617 is shown in isolation in FIGS. 45A, 45B, 45C, and 45D. As shown in FIGS. 45A, 45B, 45C, and 45D, each front hinge pivot 617 has a pivot hinge pin hole 831 extending therethrough, and a cylindrical lug hole 832 extending therethrough as well. As shown in FIGS. 42 and 44, a cylindrical lug 833 extends through each cylindrical lug hole 832 and protrudes from each side of the front hinge pivots 617. Each cylindrical lug 833 has a diameter that is only slightly less than the height 834*b* of the front lug receiving slot 621 on each of the front first hinge members 31*a*, 31*b*, 31*c* and 31*d* of the roof panel 11. When incorporated into the present invention, the hinge pin 52 extends through the front pivot hole 619 of one of the front first hinge members 31*a*, 31*c*, through the pivot hinge pin hole 831 of one of the front hinge pivots 617, and through the front pivot hole 619 of another one of the front first hinge members 31*b*, 31*d* adjacent to the other front first hinge member 31*a*, 31*c* to allow for rotation between the front panel 12 and the roof panel 11. As those skilled in the art will readily appreciate, when the front hinge pivots 617 are rotatably secured between two of the front first hinge members 31*a*, 31*b*, 31*c* and 31*d* by a hinge pin 52, rotation of the cylindrical lugs 833 into the lug receiving slots 621 of the immediately adjacent front first hinge members 31*a*, 31*b*, 31*c* and 31*d*, shifts much of the load carried by the front hinge pivots 617 from the hinge pins 52 to the cylindrical lugs 833, allowing each of the front hinge pivots 617 to support more weight than either could carry on the hinge pin 52 alone. The construction and function of the front hinge pivot 618 adjacent the left edge 59 of the front main panel 828 is the same as that described for the front hinge pivot 617 adjacent the right edge 58, except that the front hinge pivot 618 is received between the front first hinge members 31*c*, 31*d* adjacent the left edge 19 of the roof panel 11. Front hinge pivot 617 is shown assembled to the front first hinge members 31*a*, 31*b* of the roof panel 11 in perspective in FIG. 46, and in greater detail in FIG. 47. Likewise, front hinge pivot 618 is shown assembled to the front first hinge members 31*c*, 31*d* of the roof panel 11 in perspective in FIG. 48, and in greater detail in FIG. 49.

As shown in FIGS. 50-56, incorporated into the lower end portion 834, 835 of each of the front posts 62, 63 on the front panel 12 is a front panel interlock 836, 837. Each front panel interlock 836, 837 has a door wall 838, 839 which faces the door panel 18, a front wall 840, 841 that is parallel to, and in spaced relation with, the door wall 838, 839, an inner wall 842, 843 that is perpendicular to the front wall 840, 841, and the door wall 838, 839 and faces the inner wall 842, 843 of the other front panel interlock, and an outer wall 844, 845 which is parallel to, and in spaced relation with, the inner wall 842, 843.

Each front panel interlock 836, 837 has a first bolt hole 846, 847 in the outer wall 844, 845, and a second bolt hole 848, 849 in the inner wall 842, 843. The diameters of the second bolt holes 848, 849 are slightly larger than the diameters of the first bolt holes 846, 847, and the first bolt holes 846, 847 and the second bolt holes 848, 849 are located on the inner walls 842, 843 and the outer walls 844, 845 of the front panel interlocks 836, 837, such that when one of the base front tangs 108*a*, 108*b* of the base panel 17 is received therein, the upper tapered locking hole 110*a*, 110*b* in the base front tang 108*a*, 108*b* is aligned with the first bolt hole 846, 847 and the second bolt hole 848, 849 of the respective front panel interlock 836, 837, such that the first bolt hole 846, 847 is immediately adjacent the smaller diameter end of the upper tapered locking hole 110*a*, 110*b*, and the second bolt hole 848, 849 is immediately adjacent the larger diameter end of the upper tapered locking hole 110*a*, 110*b*.

Referring now to FIGS. 44, 50, 53 and 55, the sill panel 61 includes a lower sill beam 850 and an upper sill beam 851, each of which extends between the fronts posts 62, 63 adjacent the lower end portions 834, 835 thereof. Each end 853, 854 of the lower sill beam 850 is fixedly secured to the inner wall 842, 843 of the front panel interlock 836, 837 immediately adjacent thereto, preferably by welding, such that the lower edge 855 of the lower sill beam 850 is approximately aligned with the lower ends 856, 857 of the front posts 62, 63. Each end 858, 859 of the upper sill beam 851 is likewise fixedly secured to the inner wall 842, 843 of the front panel interlock 836, 837 immediately adjacent thereto, preferably by welding, such that upper sill beam 851 is parallel, and in spaced relation, to the lower sill beam 850. A sill plate 860, which is substantially aligned with the front walls 840, 841 of the front panel interlocks, extends from the upper sill beam 851 to the lower sill beam 850, and from front left post 63 to the front right post 62, and is welded about its periphery to the upper sill beam 851, the lower sill beam 850, the front left post 63, and the front right post 62.

Adjacent each front panel interlock 836, 837, and aligned with the bolt holes 846, 848, 847, 849 therein, are hammer lock retainers 861, 862 mounted to the sill panel 61. As shown in FIGS. 46, 48, 53 and 55, a hammer locking mechanism 863, 864, including a slide hammer 865, 866, and a hammer locking bolt 867, 868, is slideably secured to each of the hammer lock retainers 861, 862, within the sill panel 61 such that each hammer locking mechanism 863, 864 is positionable by use of one of the slide hammers 865, 866 slideably mounted on one of the hammer locking bolts 867, 868, between an unlocked position in which the respective hammer locking bolt 867, 868, is in a retracted position substantially outside of the front panel interlock 836, 837, and a locked position in which the respective hammer locking bolt 867, 868 extends through the bolt holes 846, 848, 847, 849 of the front panel interlock 836, 837 immediately adjacent thereto.

As shown in FIGS. 57-66, a front roller arm 869, 870 is fixedly secured to the door wall 838, 839 of each of the front interlocks 836, 837, and extends downward therefrom, and the outer wall 844, 845 of each of the front interlocks 836, 837 includes a roller recess 871, 872. A roller cover plate 873, 874 is removably secured to the outer wall 844, 845 of each of the front interlocks 836, 837, preferably with bolts 875, 876. The upper edge 877, 878 of each roller cover plate 873, 874 extends upward along the outer wall 844, 845 to which it is attached so as to cover the roller recess 871, 872 immediately adjacent thereto, and the lower edge 879, 880 of each roller cover plate 873, 874 extends downward along the outer wall 844, 845 to which it is attached about 2 inches below the lower end 881, 882 of the immediately adjacent front roller arm 869, 870. A first front roller 883, 884 is rotatably attached to each of the front roller arms 869, 870 adjacent the lower end thereof, and is secured in place by an axle pin 885, 886 that extends between each roller arm 869, 870 and the roller cover plate 873, 874 immediately adjacent thereto. Likewise, a second front roller 887, 888 is rotatably attached to each of the outer walls 844, 845 of the front interlocks 836, 837 within the roller recess 871, 872 therein, and is secured in place by an axle pin 889, 890 that extends between the outer wall 844, 845 of the respective front interlock 836, 837 and the roller cover plate 873, 874 immediately adjacent thereto. Each of the first front rollers 883, 884 and the second front rollers 887, 888 is aligned with one of the rails 401, 403 of the base panel 17 and rides on such rails 401, 403 during the folding, and unfolding, of the container 10 as described in more detail below.

Figure 67:
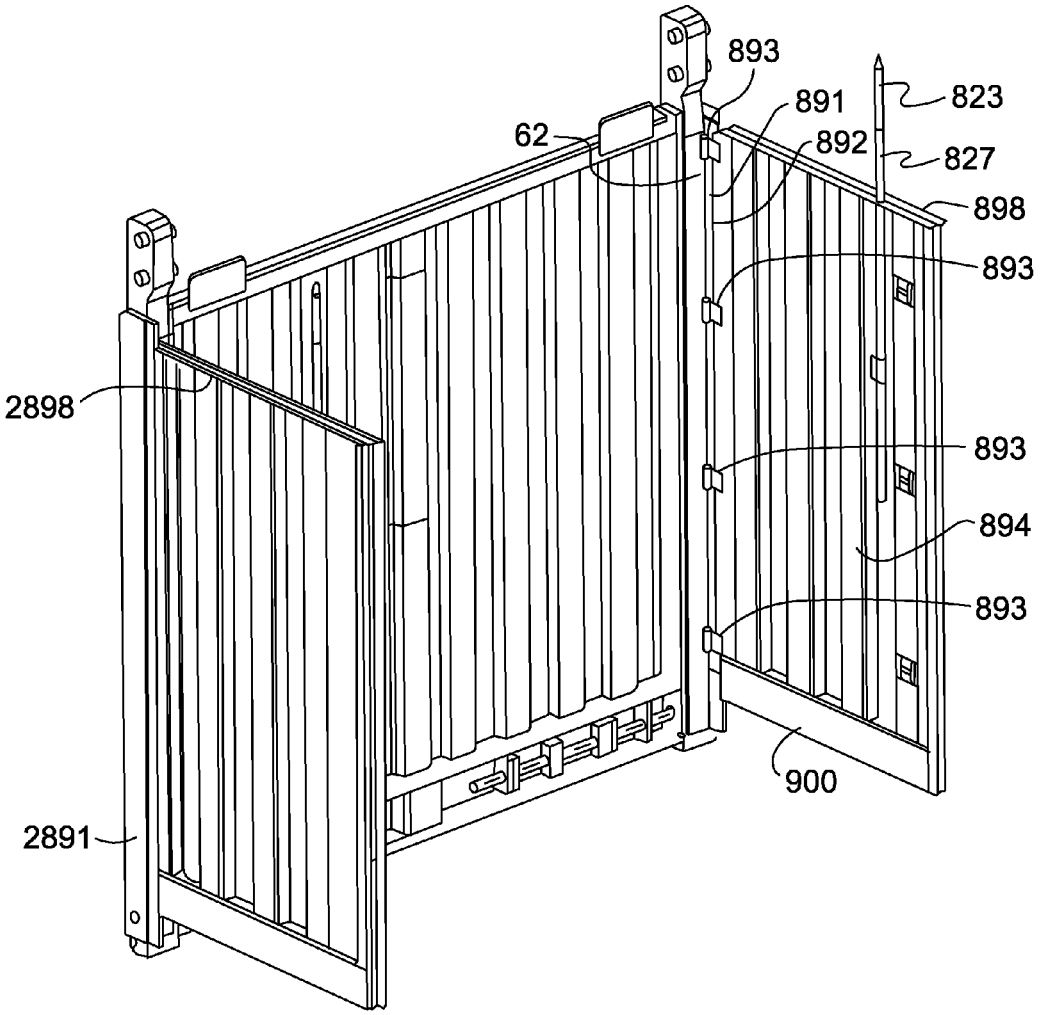
FIG. 67 is a perspective view of the front panel and right and left access panels.
Figure 68:
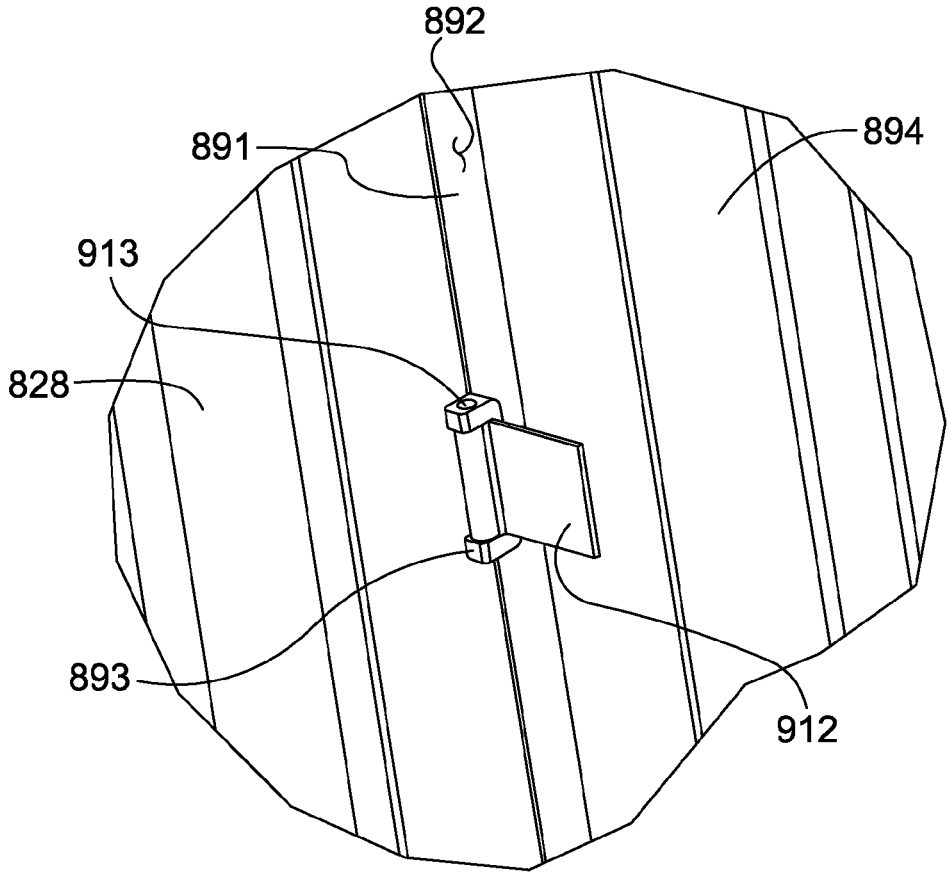
FIG. 68 is a view of a front right access panel hinge.
Figure 74:
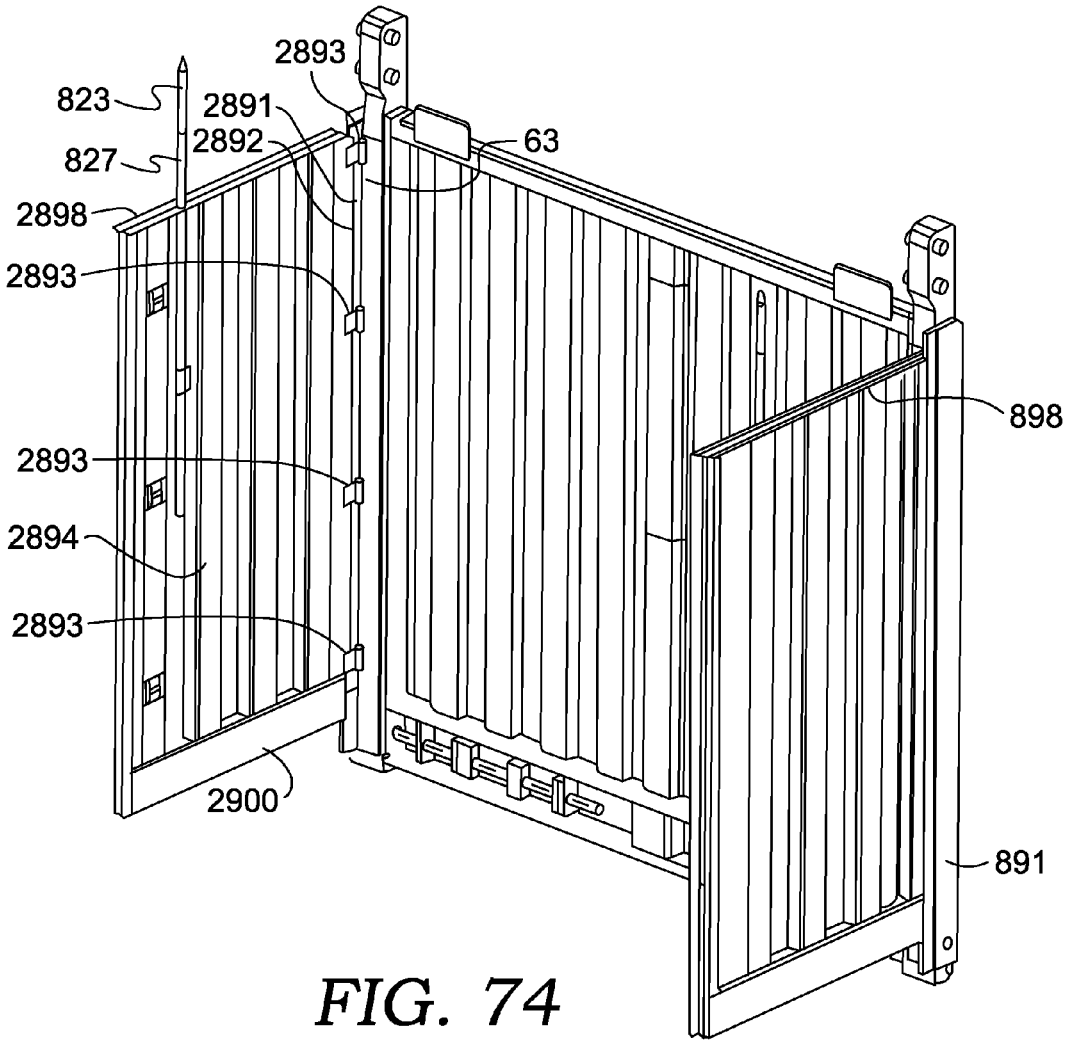
FIG. 74 is a perspective view of the front panel and right and left access panels.

Referring to FIGS. 67, 68 and 74, the front right post 62 includes a front right hinge plate 891 that extends towards the door edge 21 of the roof panel 11 when the container 10 is in the unfolded condition. Attached to the inward surface 892 of the front right hinge plate 891, in spaced relation to each other, are a plurality of, and preferably four, first front right hinge members 893. Each of the first front right hinge members 893 is fixedly secured to the inward surface 892 of the front right hinge plate 891, preferably by welding.

Figure 69:
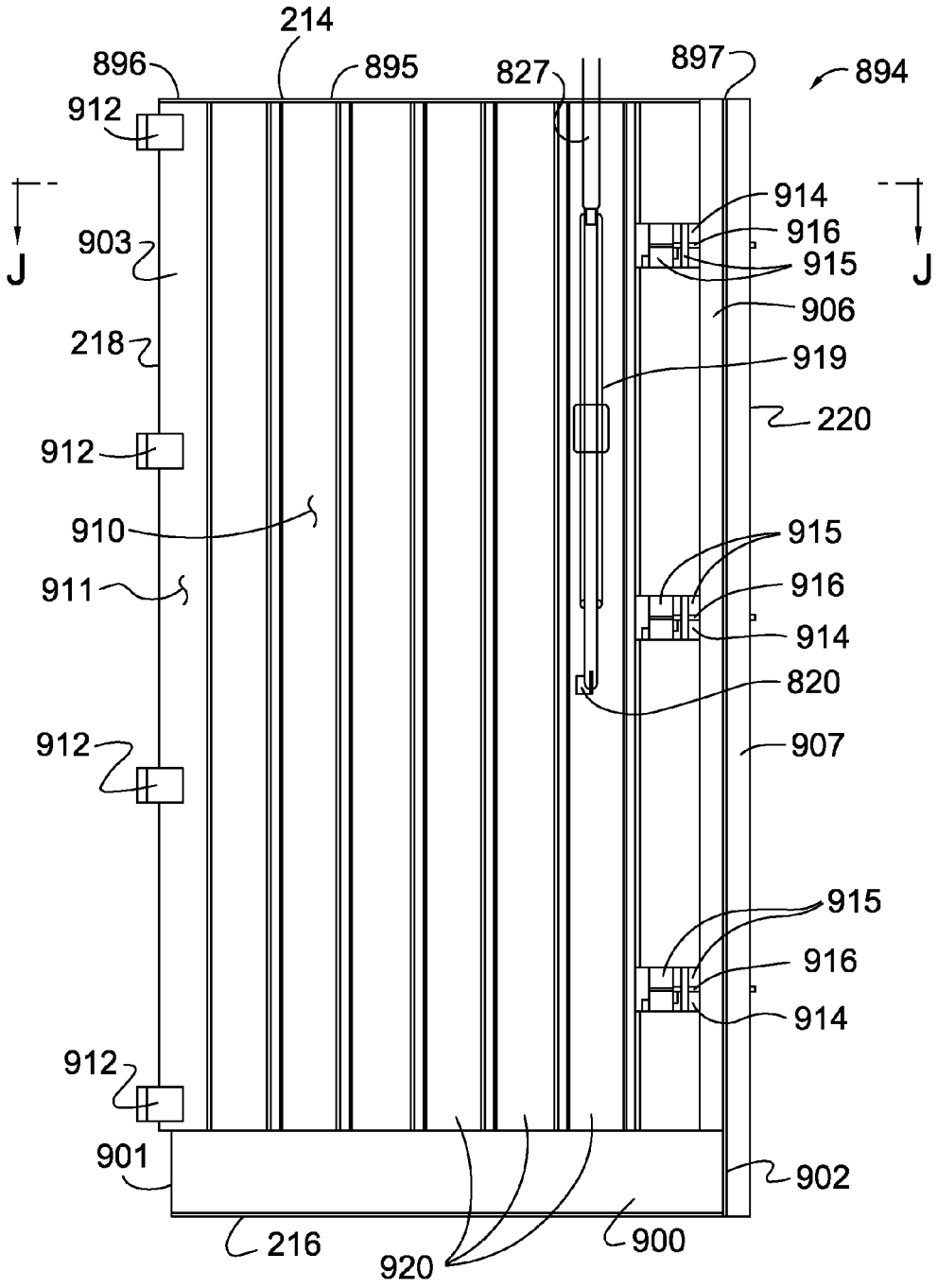
FIG. 69 is a plan view of the inner surface of the front right access panel.

As shown in FIG. 67, a front right access panel 894 is pivotably attached to the front right post 62, and as shown in FIG. 69, the front right access panel 894 includes a top edge 214, a bottom edge 216, a front edge 218, and a door edge 220. Extending along the top edge 214 of the front right access panel 894 along the length thereof is a front right upper cap plate 895 having a front end 896, a door end 897, and preferably, as shown in FIGS. 67 and 74, a front right roof flange 898 extends from the front end 896 to the door end 897. Extending along the bottom edge 216 of the front right access panel 894 along the length thereof is a front right beam 900 that has a front end 901 and a door end 902.

Figure 70:
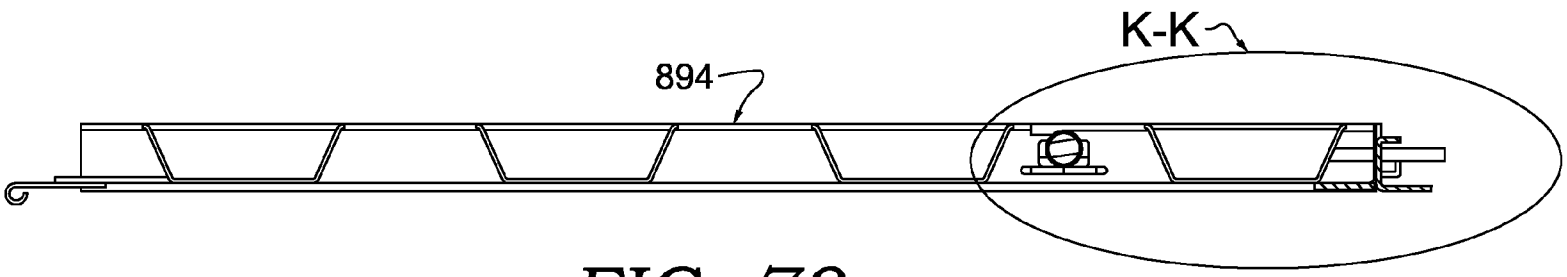
FIG. 70 is a cross sectional view of the front right access panel.
Figure 71:
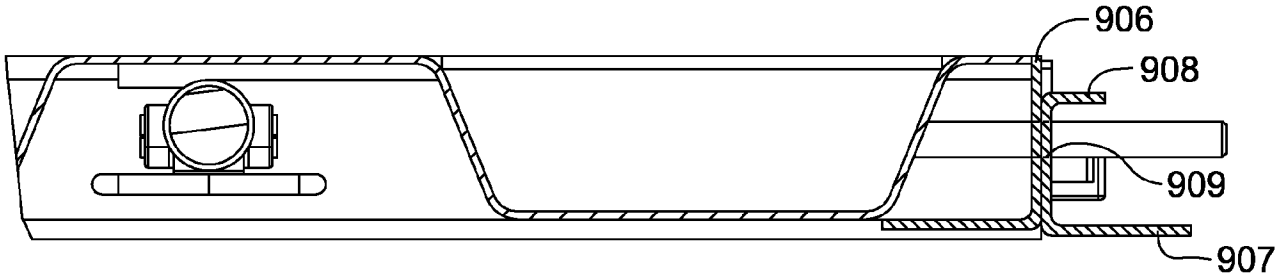
FIG. 71 is an enlarged view of section K-K of FIG. 70.

As shown in FIG. 69, a first front right access member 903 extends from the front end 896 of the front right upper cap plate 895 to the front end 901 of the front right beam 900, and is fixedly secured to the front ends 896, 901, preferably by welding. As shown in FIG. 69, a second front right access member 906 extends from the door end 897 of the front right upper cap plate 895 to the door end 902 of the front right beam 900, and is fixedly secured to the door ends 897, 902, preferably by welding. As shown in FIGS. 69, 70 and 71, the second front right access member 906 includes a long flange 907 and a short flange 908, each of which extends along the length of the second front right access member 906 and towards the door edge 21 of the roof panel 11 when the container 10 is in the unfolded condition. Located between the long flange 907 and the short flange 908 are a plurality of locking bolt holes 909, preferably three, that extend through the second front right access member 906. When the container 10 is in the unfolded condition, the locking bolt holes 909 are aligned with the right side bolt holes 767 of the right side panel 14

Referring again to FIG. 69, corrugated sheet metal 910 extends from the front right upper cap plate 895 to the front right beam 900 along the entire length thereof, and from the first front right access member 903 to the second front right access member 906 along the entire length thereof. The corrugated sheet metal 910 is welded all along its entire perimeter to the immediately adjacent front right upper cap plate 895, first front right access member 903, front right beam 900, and second front right access member 906. As those skilled in the art will readily appreciate, the second front right access member 906 is welded to the corrugated sheet metal 910 such that the long flange 907 is visible from the interior of the container 10 when the container 10 is in its unfolded condition. As shown in FIGS. 67-69, attached to the inward surface 911 of the first front right access member 903 in spaced relation to each other, are a plurality of second front right hinge members 912. As shown in FIG. 68, each of the second front right hinge members 912 is rotatably secured to one of the first front right hinge members 893 by a hinge pin 913 so as to allow the front right access panel 894 to swing relative to the front main panel 828.

Figure 72:
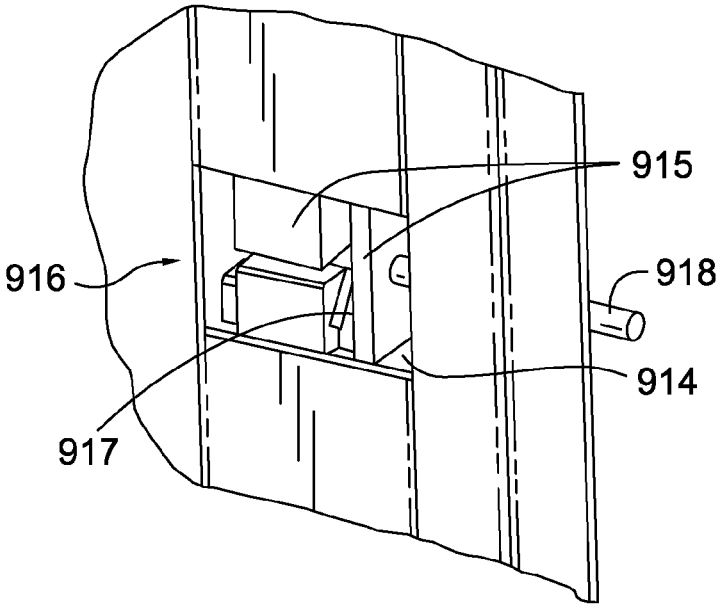
FIG. 72 is a view of the slide locking mechanism of the front right access panel.

Referring again to FIG. 69, immediately adjacent each of the locking bolt holes 909 in the second front right access member 906 is a recess 914 in the corrugated sheet metal 910, and within each recess 914 and aligned with the locking bolt holes 909 in the second front right access member 906 are slide lock retainers 915. As shown in FIGS. 69 and 72, a slide locking mechanism 916, including a slide lock lever 917, and a slide locking bolt 918, is slideably secured to each of the slide lock retainers 915 within the recesses 914 such that each slide locking mechanism 916 is positionable by use of one of the slide lock levers 917 between an unlocked position in which the respective slide locking bolt 918 is in a retracted position outside of the right side bolt holes 767 of the right side panel 14, and a locked position in which the respective slide locking bolt 918 extends through the immediately adjacent locking bolt hole 909 of the second front right access member 906 and one of the right side bolt holes 767 of the right side panel 14.

Figure 73:
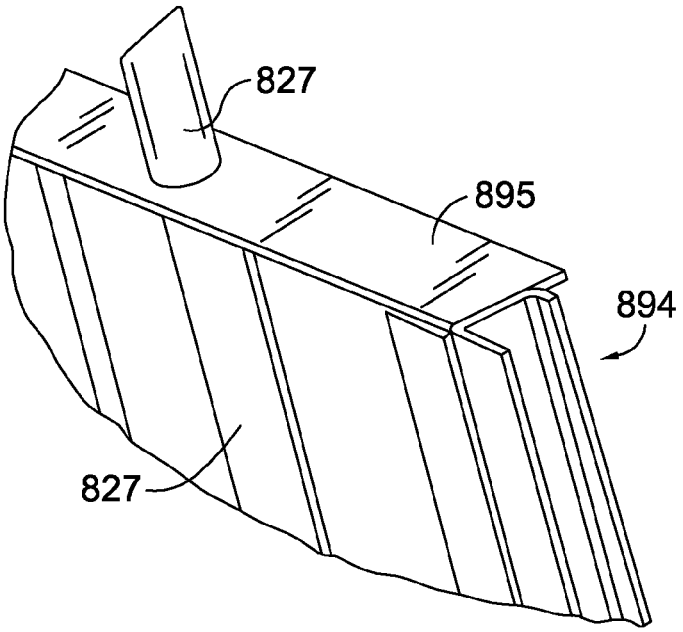
FIG. 73 is a perspective view of the upper cap plate of the front right access panel.

Referring again to FIGS. 67 and 69, at least one locking bolt assembly 919 is mounted to the front right access panel 894 within corrugations 920 of the corrugated sheet metal 910. The construction of the locking bolt assembly 919 is the same as those described with respect to the right side panel 14, except that each pivot anchor 820 is fixedly secured to the corrugated sheet metal 910 of the front right access panel 894, and each guide tube 827 extends through, and is fixedly secured to, the front right upper cap plate 895, as shown in FIG. 73. As those skilled in the art will readily appreciate, each of the locking bolt assemblies 919 so described is selectively positionable between a first position in which the locking bolt 823 is received within one of the locking bolt holes 610 in the lower face 608 of the roof right beam 600 when the container 10 is in the unfolded condition, and a second position in which the locking bolt 823 is fully withdrawn from that locking bolt hole 610.

Figure 75:
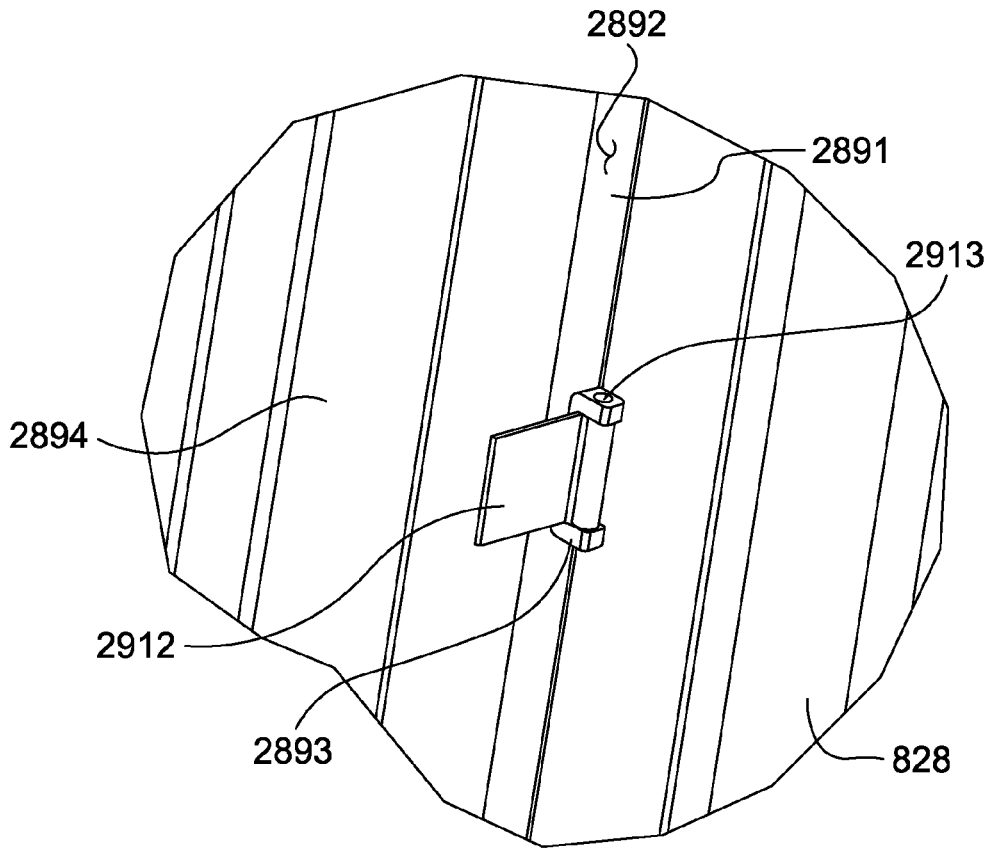
FIG. 75 is a view of a front left access panel hinge.

As shown in FIGS. 67, 74 and 75, the front left post 63 includes a front left hinge plate 2891 that extends towards the door edge 21 of the roof panel 11 when the container 10 is in the unfolded condition. Attached to the inward surface 2892 of the front left hinge plate 2891, in spaced relation to each other, are a plurality of, and preferably four, first front left hinge members 2893. Each of the first front left hinge members 2893 is fixedly secured to the inward surface 2892 of the front left hinge plate 2891, preferably by welding.

Figure 76:
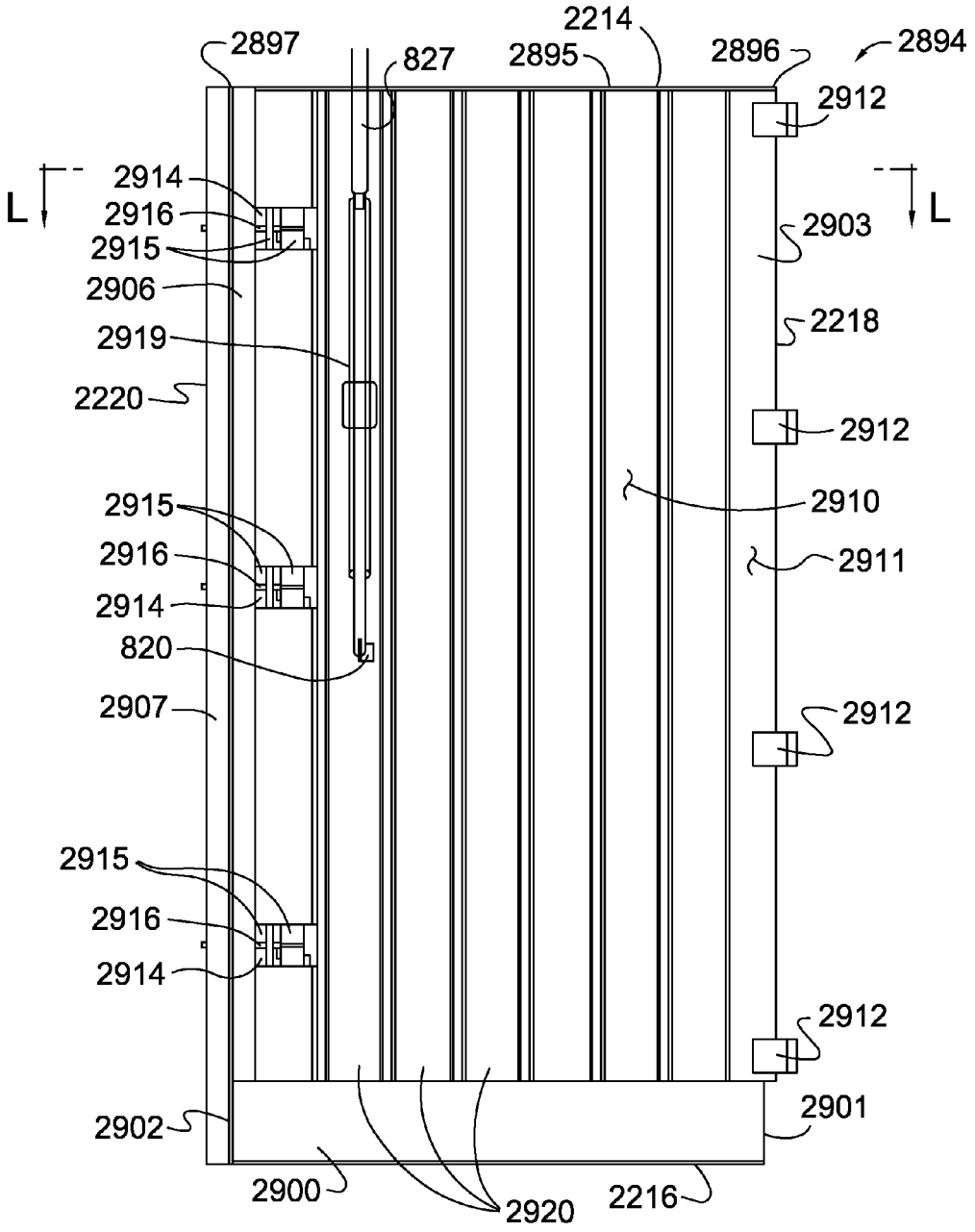
FIG. 76 is a plan view of the inner surface of the front left access panel.

As shown in FIG. 74, a front left access panel 2894 is pivotably attached to the front left post 63, and as shown in FIG. 76, the front left access panel 2894 includes a top edge 2214, a bottom edge 2216, a front edge 2218, and a door edge 2220. Extending along the top edge 2214 of the front left access panel 2894 along the length thereof is a front left upper cap plate 2895 having a front end 2896, a door end 2897, and preferably as shown in FIGS. 67 & 74 a front left roof flange 2898 extends from the front end 2896 to the door end 2897. Extending along the bottom edge 2216 of the front left access panel 2894 along the length thereof is a front left beam 2900 that has a front end 2901 and a door end 2902.

Figure 77:
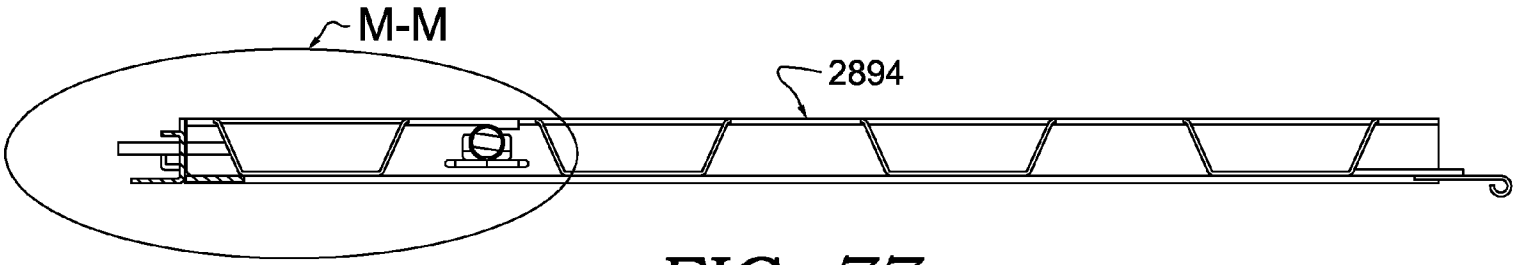
FIG. 77 is a cross sectional view of the front left access panel.
Figure 78:
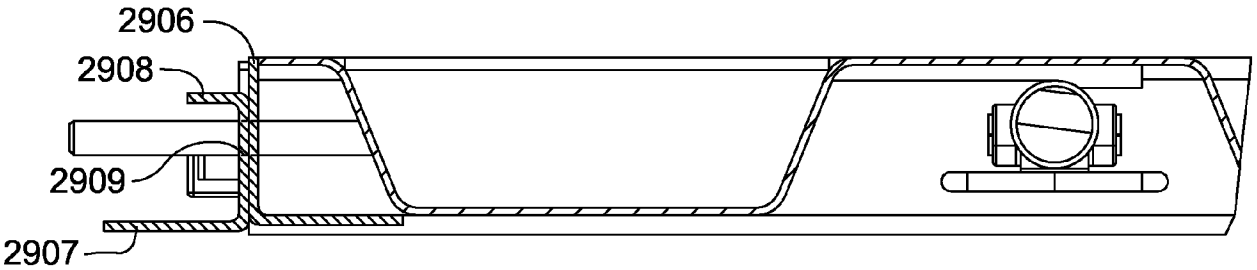
FIG. 78 is an enlarged view of section M-M of FIG. 77.

As shown in FIG. 76, a first front left access member 2903 extends from the front end 2896 of the front left upper cap plate 2895 to the front end 2901 of the front left beam 2900, and is fixedly secured to the front ends 2896, 2901, preferably by welding. As shown in FIG. 76, a second front left access member 2906 extends from the door end 2897 of the front left upper cap plate 2895 to the door end 2902 of the front left beam 2900, and is fixedly secured to the door ends 2897, 2902, preferably by welding. As shown in FIGS. 76, 77 and 78, the second front left access member 2906 includes a long flange 2907 and a short flange 2908, each of which extends along the length of the second front left access member 2906 and towards the door edge 21 of the roof panel 11 when the container 10 is in the unfolded condition. Located between the long flange 2907 and the short flange 2908 are a plurality of locking bolt holes 2909, preferably three, that extend through the second front left access member 2906. When the container 10 is in the unfolded condition, the locking bolt holes 2909 are aligned with the left side bolt holes 794 of the left side panel 16.

Referring again to FIG. 76, corrugated sheet metal 2910 extends from the front left upper cap plate 2895 to the front left beam 2900 along the entire length thereof, and from the first front left access member 2903 to the second front left access member 2906 along the entire length thereof. The corrugated sheet metal 2910 is welded all along its entire perimeter to the immediately adjacent front left upper cap plate 2895, first front left access member 2903, front left beam 2900, and second front left access member 2906. As those skilled in the art will readily appreciate, the second front left access member 2906 is welded to the corrugated sheet metal 2910 such that the long flange 2907 is visible from the interior of the container 10 when the container 10 is in its unfolded condition. As shown in FIGS. 74-76, attached to the inward surface 2911 of the first front left access member 2903 in spaced relation to each other, are a plurality of second front left hinge members 2912. Each of the second front left hinge members 2912 is rotatably secured to one of the first front left hinge members 2893 by a hinge pin 2913 so as to allow the front left access panel 2894 to swing relative to the front main panel 828.

Figure 79:
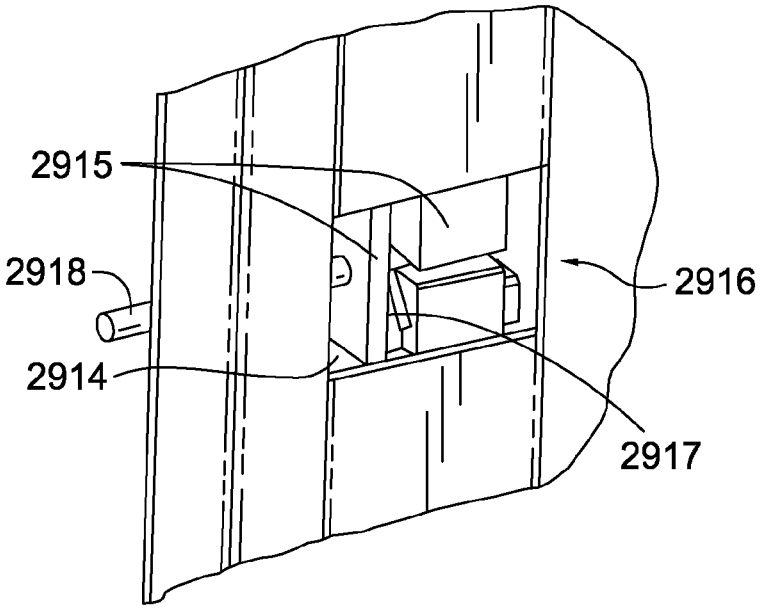
FIG. 79 is a view of the slide locking mechanism of the front left access panel.

Referring again to FIGS. 74 & 76, immediately adjacent each of the locking bolt holes 2909 in the second front left access member 2906 is a recess 2914 in the corrugated sheet metal 2910, and within each recess 2914 and aligned with the locking bolt holes 2909 in the second front left access member 2906 are slide lock retainers 2915. As shown in FIGS. 76 and 79, a slide locking mechanism 2916, including a lock lever 2917, and a slide locking bolt 2918, is slideably secured to each of the slide lock retainers 2915 within the recesses 2914 such that each slide locking mechanism 2916 is positionable by use of one of the slide lock levers 2917 between an unlocked position in which the respective slide locking bolt 2918 is in a retracted position outside of the left side bolt holes 794 of the left side panel 16, and a locked position in which the respective slide locking bolt 2918 extends through the immediately adjacent locking bolt hole 2909 of the second front left access member 2906 and one of the left side bolt holes 794 of the left side panel 16.

Figure 80:
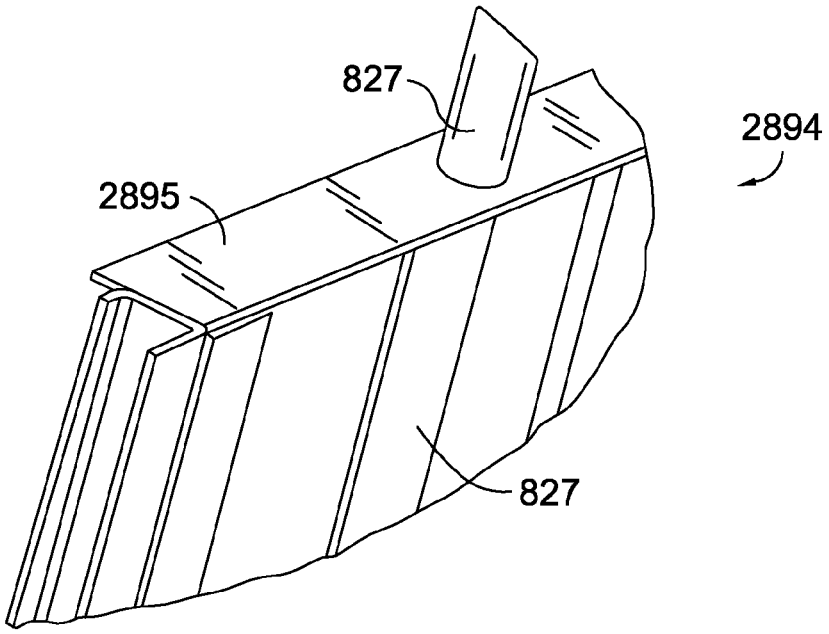
FIG. 80 is a perspective view of the upper cap plate of the front left access panel.

Referring again to FIG. 76, at least one locking bolt assembly 2919 is mounted to the front left access panel 2894 within corrugations 2920 of the corrugated sheet metal 2910. The construction of the locking bolt assembly 2919 is the same as those described with respect to the right side panel 14, except that each pivot anchor 820 is fixedly secured to the corrugated sheet metal 2910 of the front left access panel 2894, and each guide tube 827 extends through, and is fixedly secured to, the front left upper cap plate 2895, as shown in FIG. 80. As those skilled in the art will readily appreciate, each of the locking bolt assemblies 2919 so described is selectively positionable between a first position in which the locking bolt 823 is received within one of the locking bolt holes 610 in the lower face 609 of the roof left beam 603 when the container 10 is in the unfolded condition, and a second position in which the locking bolt 823 is fully withdrawn from that locking bolt hole 610.

Figure 81:
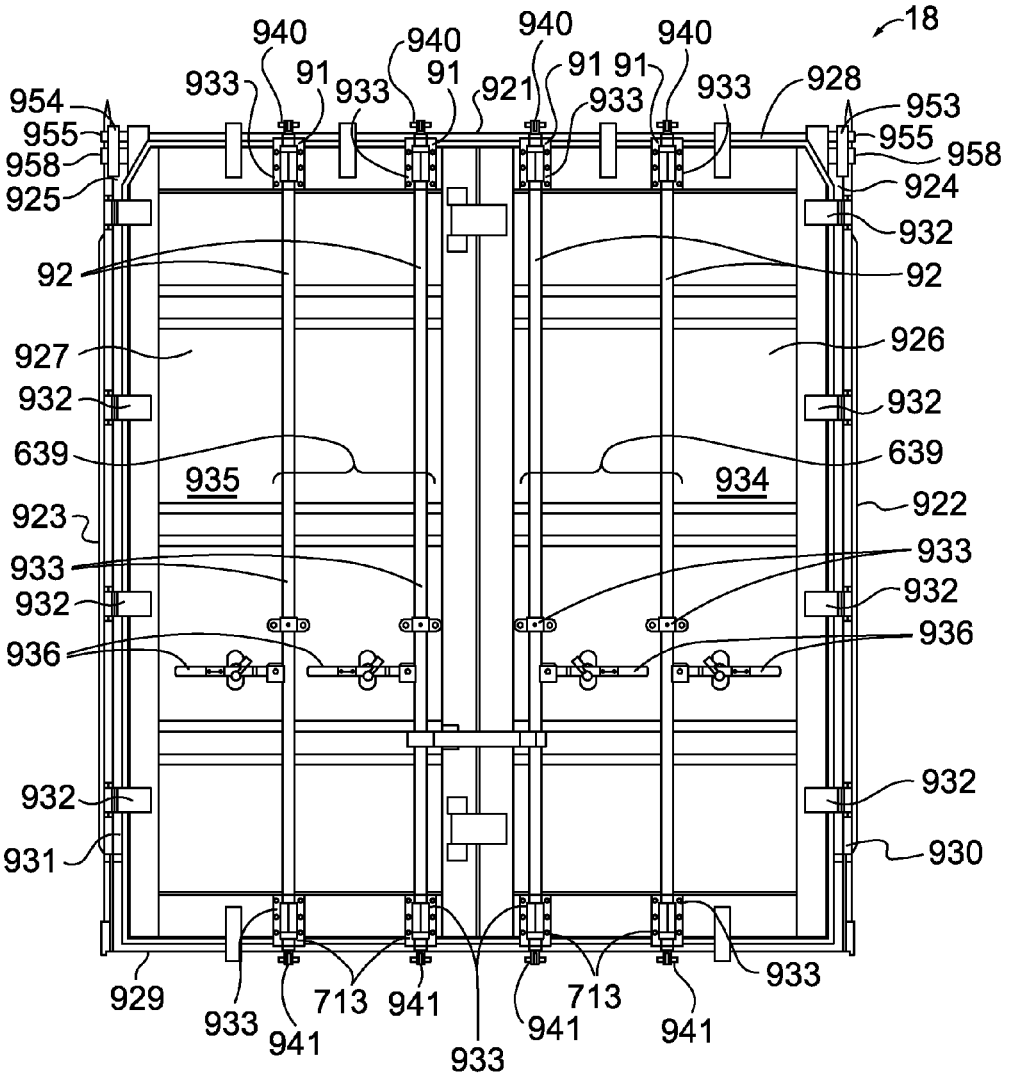
FIG. 81 is a plan view of the external surface of the door panel.
Figure 84:
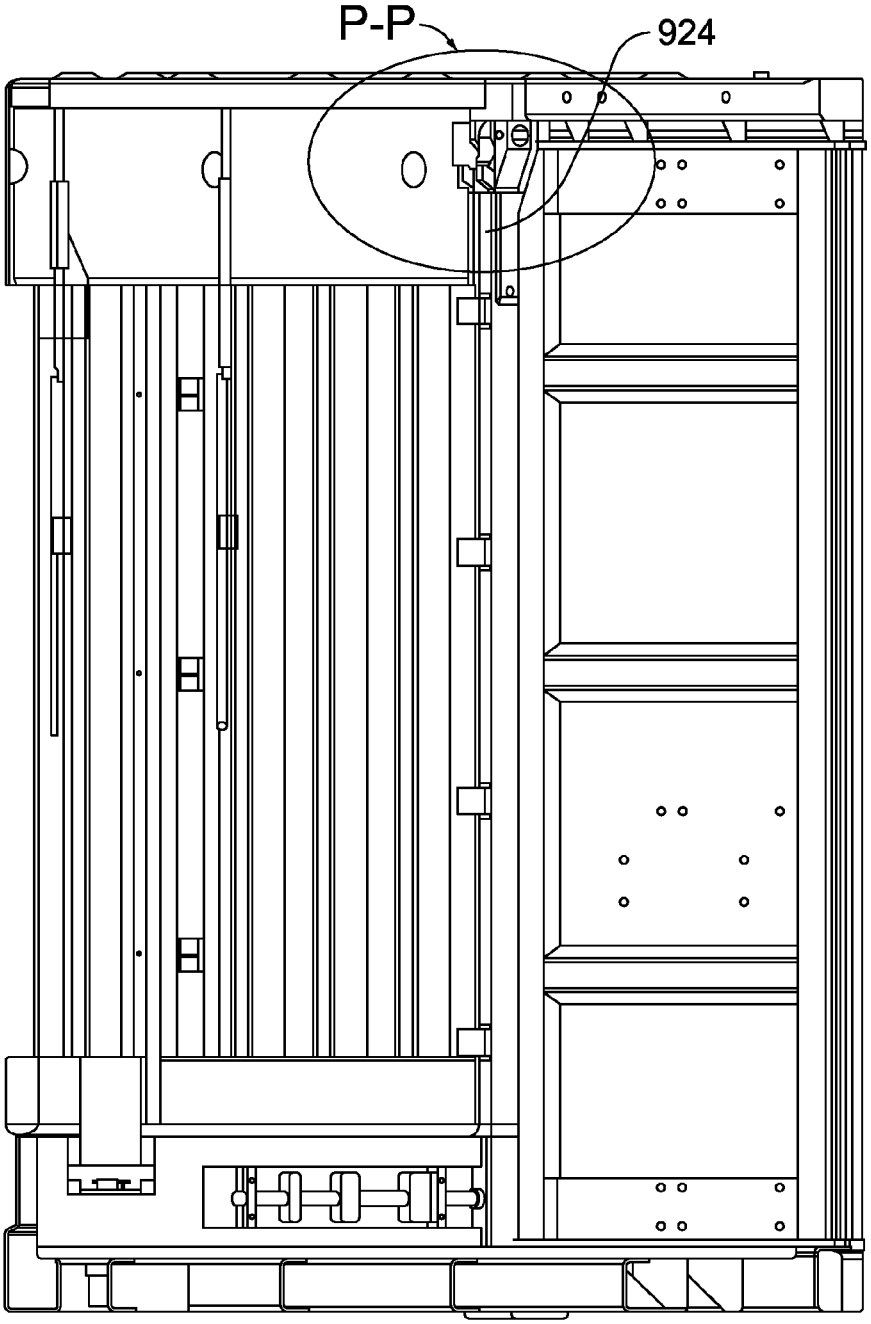
FIG. 84 is an internal view of the door end panel and right access panel.
Figure 85:
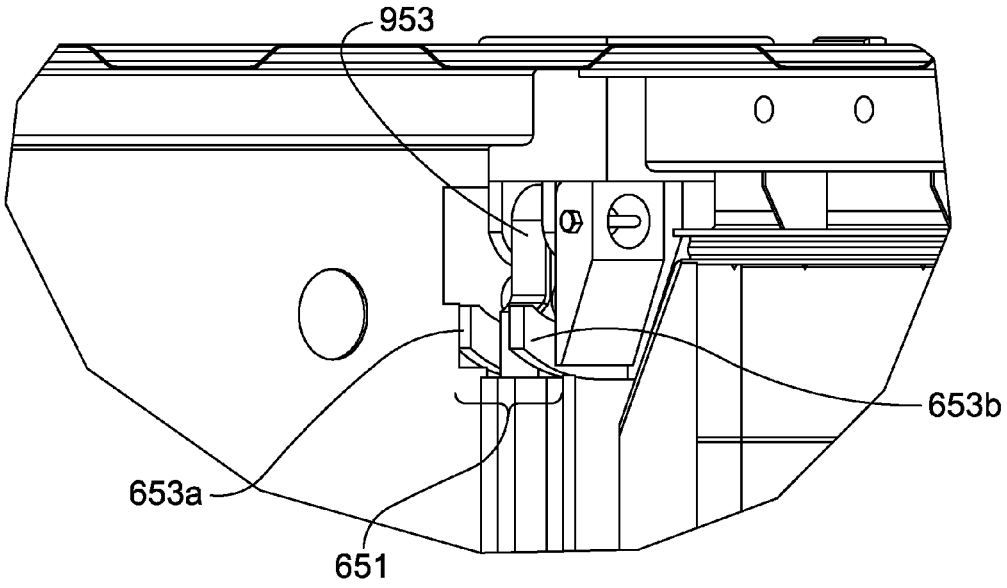
FIG. 85 is an enlarged view of section P-P of FIG. 84.
Figure 86:
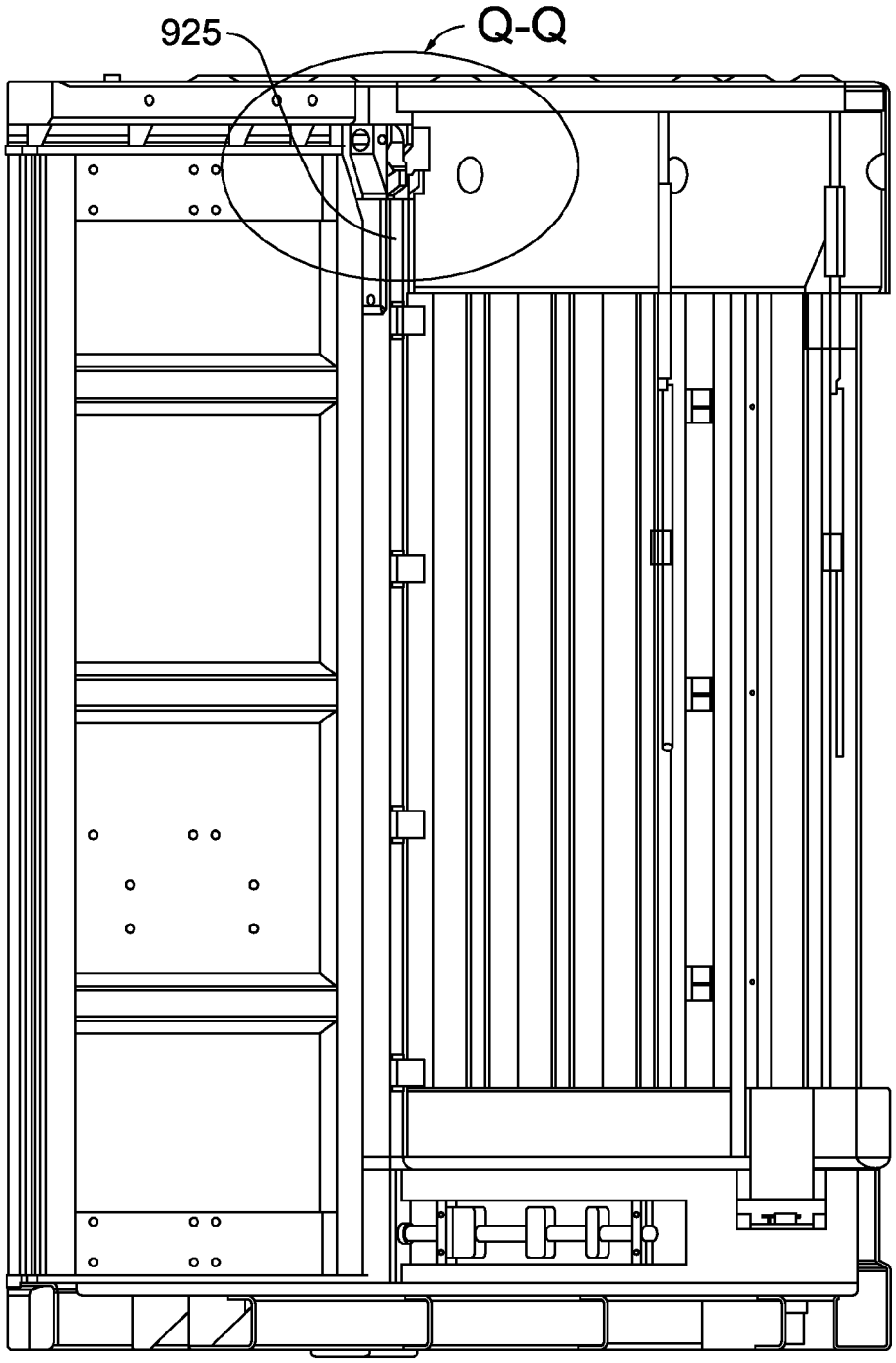
FIG. 86 is an internal view of the door end panel and left access panel.
Figure 87:
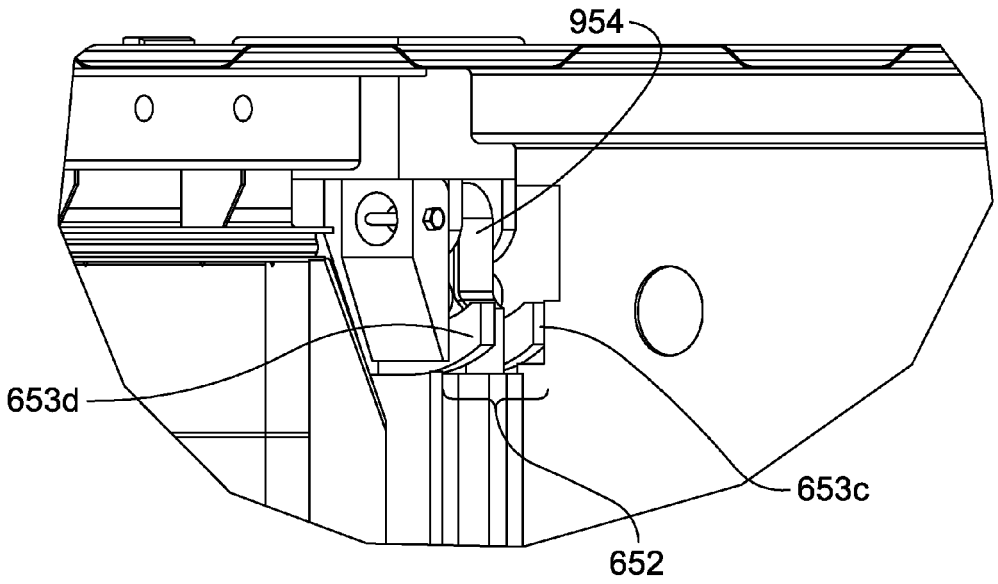
FIG. 87 is an enlarged view of section Q-Q of FIG. 86.

As shown in FIGS. 81, 84 and 86, the door panel 18 includes a door main panel 921, a door right access panel 922, and a door left access panel 923. The door main panel 921 includes a top edge 928, a bottom edge 929, a right edge 930, a left edge 931, two door posts 924, 925, and two doors 926, 927. The right door post 924, hollow and rectangular in cross section, extends along the right edge 930 of the door main panel 921, and a left door post 925, also hollow and rectangular in cross section, extends along the left edge 931 of the door main panel 921.

Referring again to FIG. 81, each door 926, 927 is of the type known in the shipping container art, and is hinged to one of the door posts 924, 925 by a plurality of door hinges 932 so as to be rotatable between a first position in which such door 926, 927 is closed, and a second position in which such door 926, 927 is open. Each door 926, 927 has a door latch assembly 639 attached thereto, and each door latch assembly preferably includes two locking rods 92 rotatably attached to the outer surface 934, 935 of such door 926, 927 by rod guides 933. The locking rods 933 of the present invention are of the type known in the art and commonly used on shipping containers. Such locking rods 92 have knuckles 940 at the upper ends 91 thereof, and knuckles 941 at the lower ends 713 thereof, and each locking rod 92 has a handle 936 attached thereto to rotate such locking rod 92 approximately 180 degrees. As those skilled in the art will readily appreciate, when the container 10 is in the unfolded condition and the doors 926, 927 are closed, rotating each of the locking rods 92 by means of the handles 936 attached thereto causes the knuckles 940 at the upper ends 91 of such locking rods 92 to rotate into one of the lock hasps **90*a* on the roof panel 11 while simultaneously causing the knuckles 941 at the lower ends 713 of such locking rods 92 to rotate into one of the lock hasps 90*b* on the base panel 11, thereby securing the doors 926, 927** in the closed position.

Figure 83:
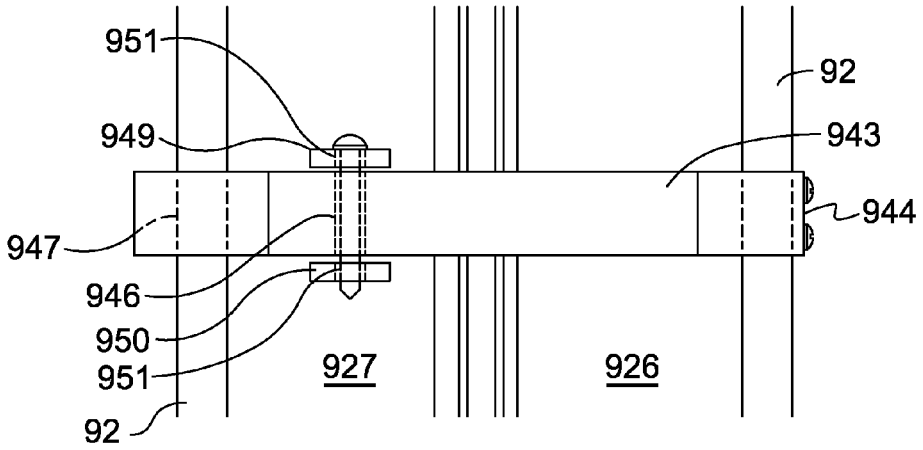
FIG. 83 is a plan view of the locking bar on the door panel.
Figure 82:
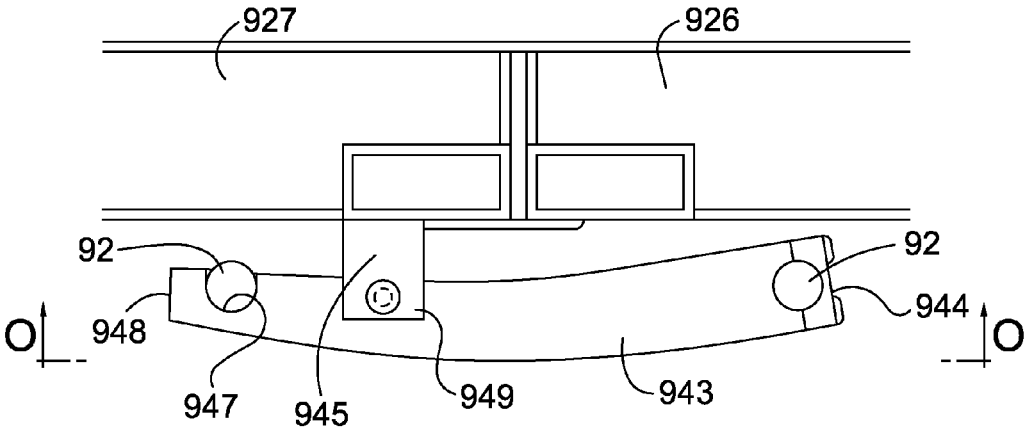
FIG. 82 is a top view of the locking bar on the door panel.

As shown in FIGS. 82 and 83, a locking bar 943 is pivotably connected at one end 944 to one of the locking rods 92 of the right door 926, and a locking block 945 is fixedly secured to the left door 927 at a location that is aligned with the locking bar 943 when both of the doors 926, 927 are closed. The locking bar 943 further includes a lock pin hole 946 that extends vertically through the locking bar 943, and the locking bar 943 has a locking rod recess 947 adjacent the distal end 948 of the locking bar 943. The locking block 945 has an upper flange 949 and a lower flange 950 in spaced relation to each other for receiving the locking bar 943, and a pin receiving hole 951 that is the same diameter as the lock pin hole 946 extends vertically through the upper flange 949 and lower flange 950. The lock pin hole 946 is located on the locking bar 943 such that, when the locking bar 943 is received within the flanges 949, 950 of the locking block 945 and a locking rod 92 on the left door 927 is received within the locking rod recess 947 (the "locked position"), the lock pin hole 946 of the locking bar 943 and pin receiving hole 951 of the locking block 945 are substantially coaxial, so as to allow a locking pin 952 to be inserted through the pin receiving hole 951 of the upper flange 949, through the lock pin hole 946 of the locking bar 945, and into the pin receiving hole 951 of the lower flange 950.

As shown in FIG. 81, extending upwardly from each of the door posts 924, 925 adjacent the top edge 928 of the door main panel 921 is a door hinge pivot 953, 954, and as shown in FIGS. 84-87, each door hinge pivot 953, 954 is rotatably connected to one of the sets 651, 652 of door first hinge members 653*a*, 653*b*, 653*c*, 653*d* located adjacent the door edge 21 of the roof panel 11. Each door hinge pivot 953, 954 has a hinge pin 955, as shown in FIG. 81, that extends through one of the door hinge pivots 953, 954 and the door pivot holes 668 of the immediately adjacent door first hinge members 653*a*, 653*b*, 653*c* and 653*d* so as to allow the door panel 12 to rotate relative to the roof panel 11.

Figure 88B:
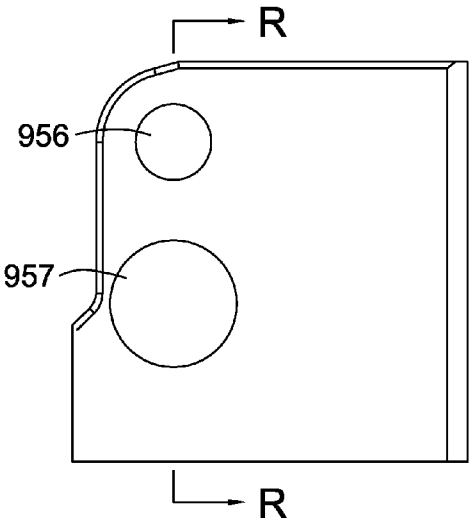
FIGS. 88A, 88B and 88C are views of the door pivot hinge.
Figure 88C:
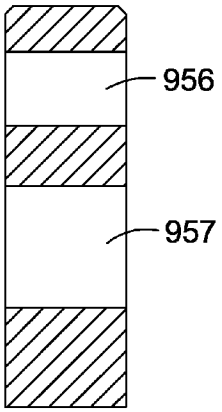
Figure 88A:
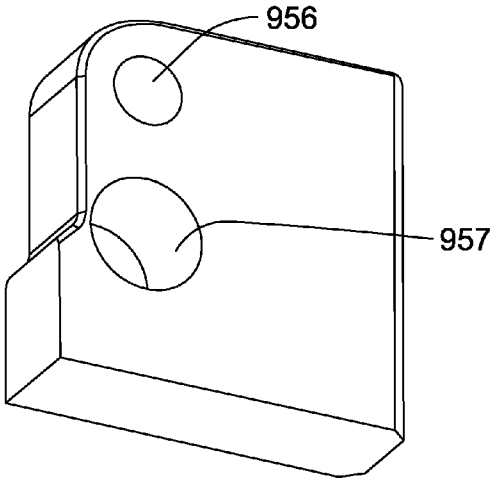

The door hinge pivot 953 adjacent the right edge 930 of the door main panel 921 and the door hinge pivot 954 adjacent the left edge 931 of the door main panel 921 are identical, and a representative door hinge pivot is shown in isolation in FIGS. 88A-88C. Each door hinge pivot 953, 954 has a pivot hinge pin hole 956 extending therethrough, and a cylindrical lug hole 957 extending therethrough as well. As shown in FIG. 81, a cylindrical lug 958 extends through each cylindrical lug hole 957 and protrudes from each side of the door hinge pivots 953, 954. Each cylindrical lug 958 has a diameter that is only slightly less than the height 959 of the door lug receiving slot 669 on each of the door first hinge members 653*a*, 653*b*, 653*c*, 653*d* of the roof panel 11. When incorporated into the present invention, the hinge pin 955 extends through the door pivot hole 668 of one of the door first hinge members 653*a*, 653*c* through the pivot hinge pin hole 956 of the door hinge pivot 953, and through the door pivot hole 668 of another one of the door first hinge members 653*b*, 653*d* adjacent to the other door first hinge member 653*a*, 653*c* to allow for rotation between the door panel 18 and the roof panel 11. As those skilled in the art will readily appreciate, when the door hinge pivots 953, 954 are rotatably secured between two of the door first hinge members 653*a*, 653*b*, 653*c*, 653*d* by a hinge pin 955, rotation of the cylindrical lugs 958 into the lug receiving slots 669 of the immediately adjacent door first hinge members 653*a*, 653*b*, 653*c*, 653*d*, shifts much of the load carried by the door hinge pivots 953, 954 from the hinge pins 955 to the cylindrical lugs 958, allowing the door hinge pivots 953, 954 to support more weight than either could carry on the hinge pins 955 alone. The construction and function of the door hinge pivot 954 adjacent the left edge 931 of the door main panel 921 is the same as that described for the door hinge pivot 953 adjacent the right edge 930, except that the door hinge pivot 954 is received between the door first hinge members 653*c*, 653*d* adjacent the left edge 20 of the roof panel 11.

Figure 93:
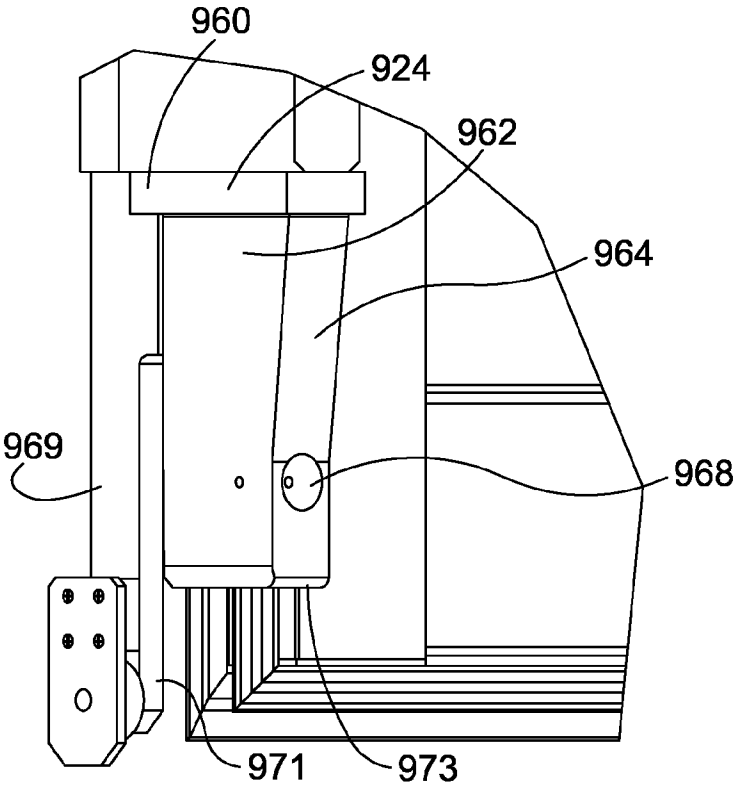
FIG. 93 is a view of the front face of the door right post locking tang.
Figure 94:
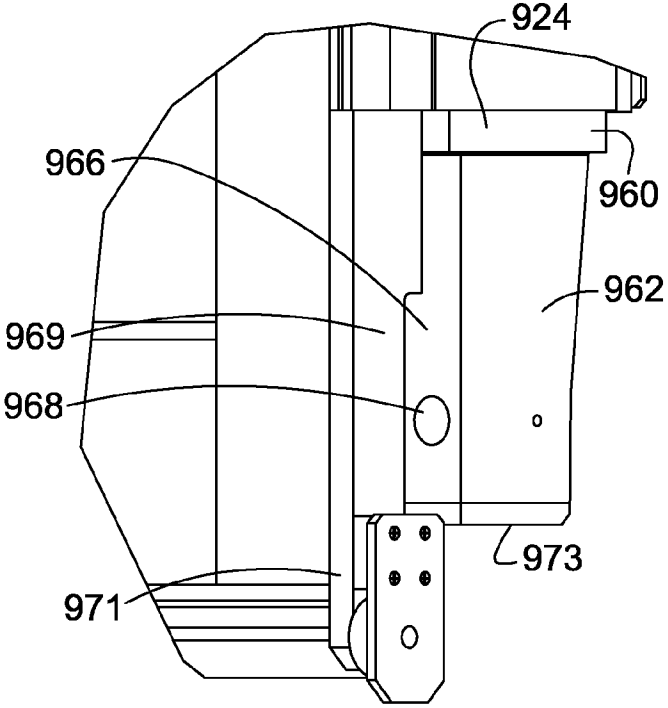
FIG. 94 is a view of the door face of the door right post locking tang.
Figure 96:
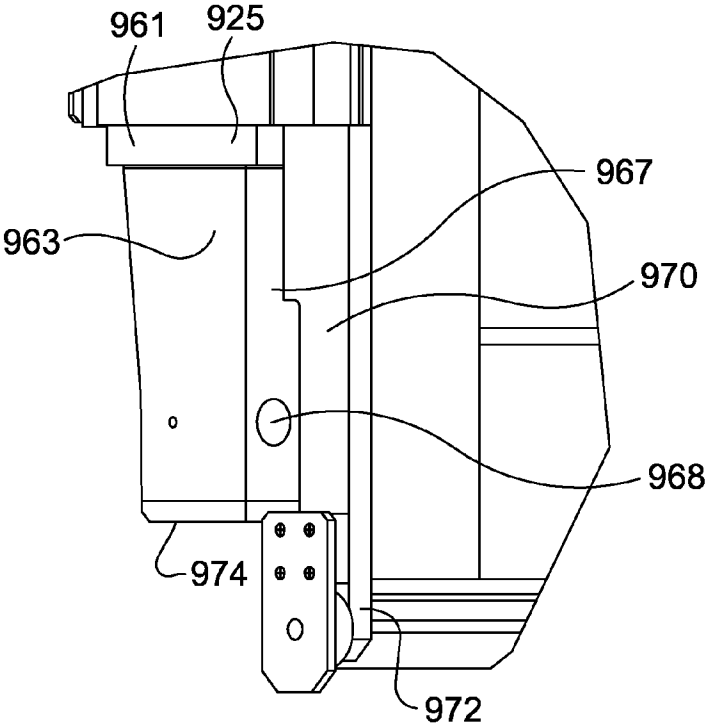
FIG. 96 is a view of the door face of the door left post locking tang.
Figure 95:
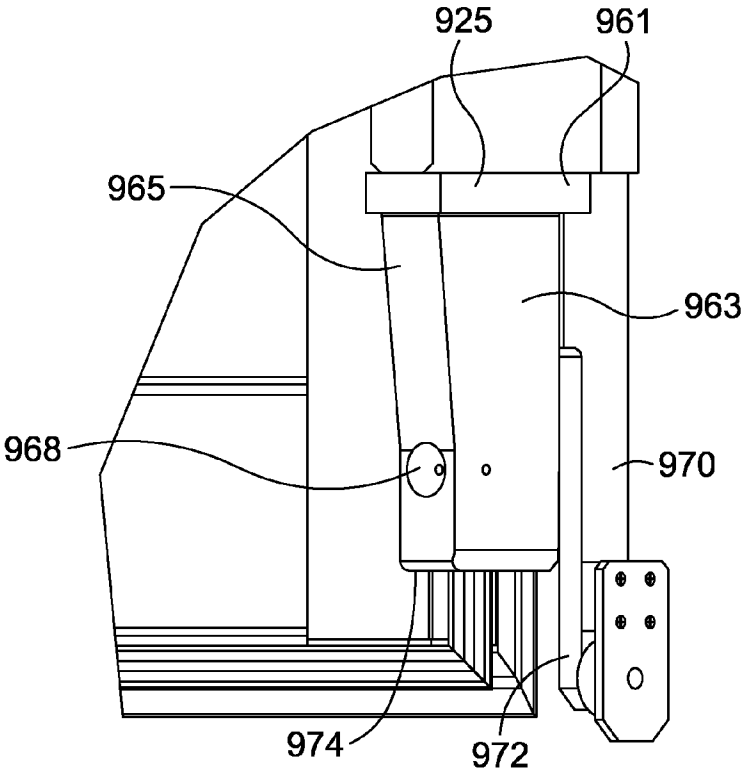
FIG. 95 is a view of the front face of the door left post locking tang.
Figure 97:
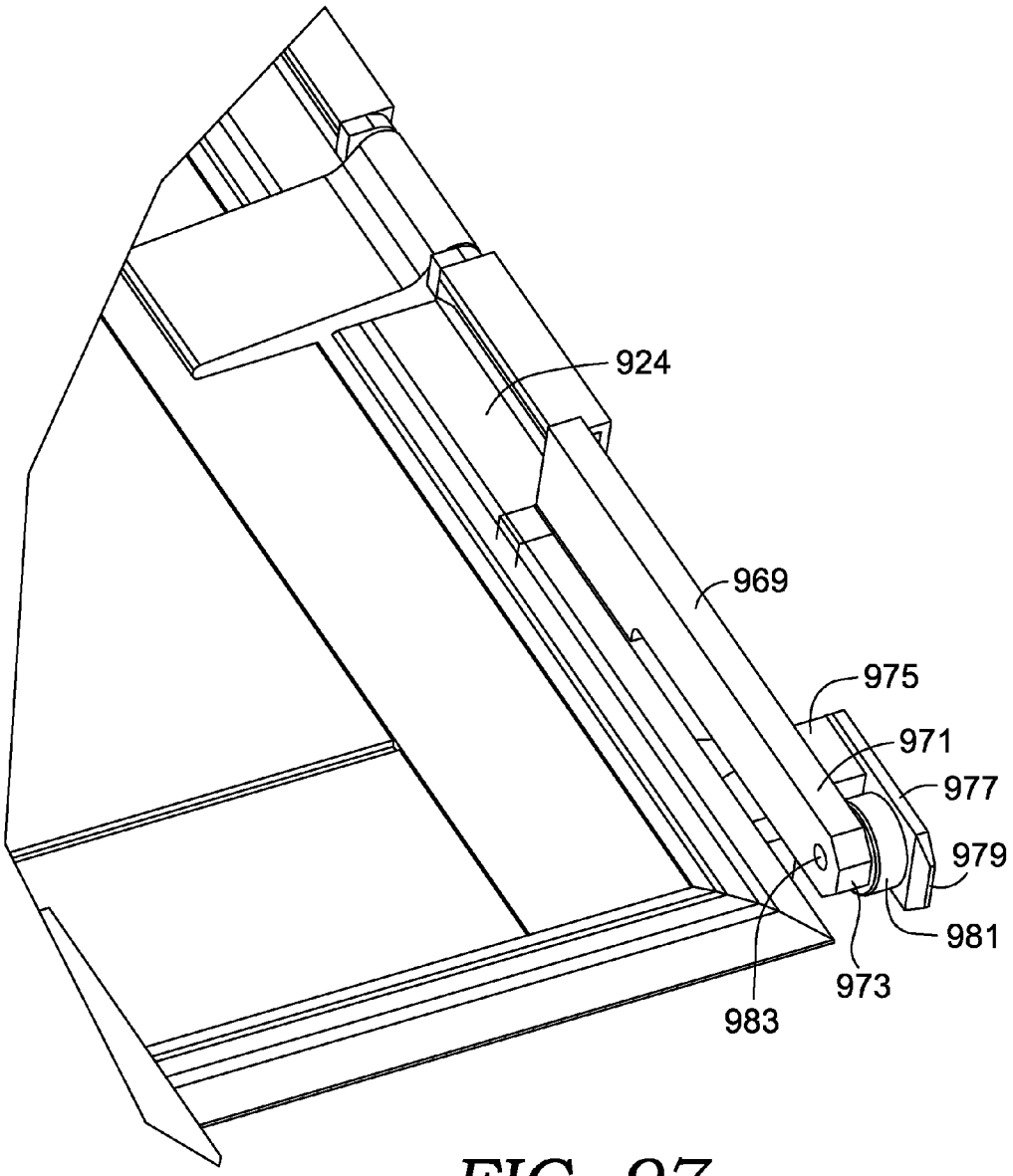
FIG. 97 is a view of the door right post roller arm.
Figure 98:
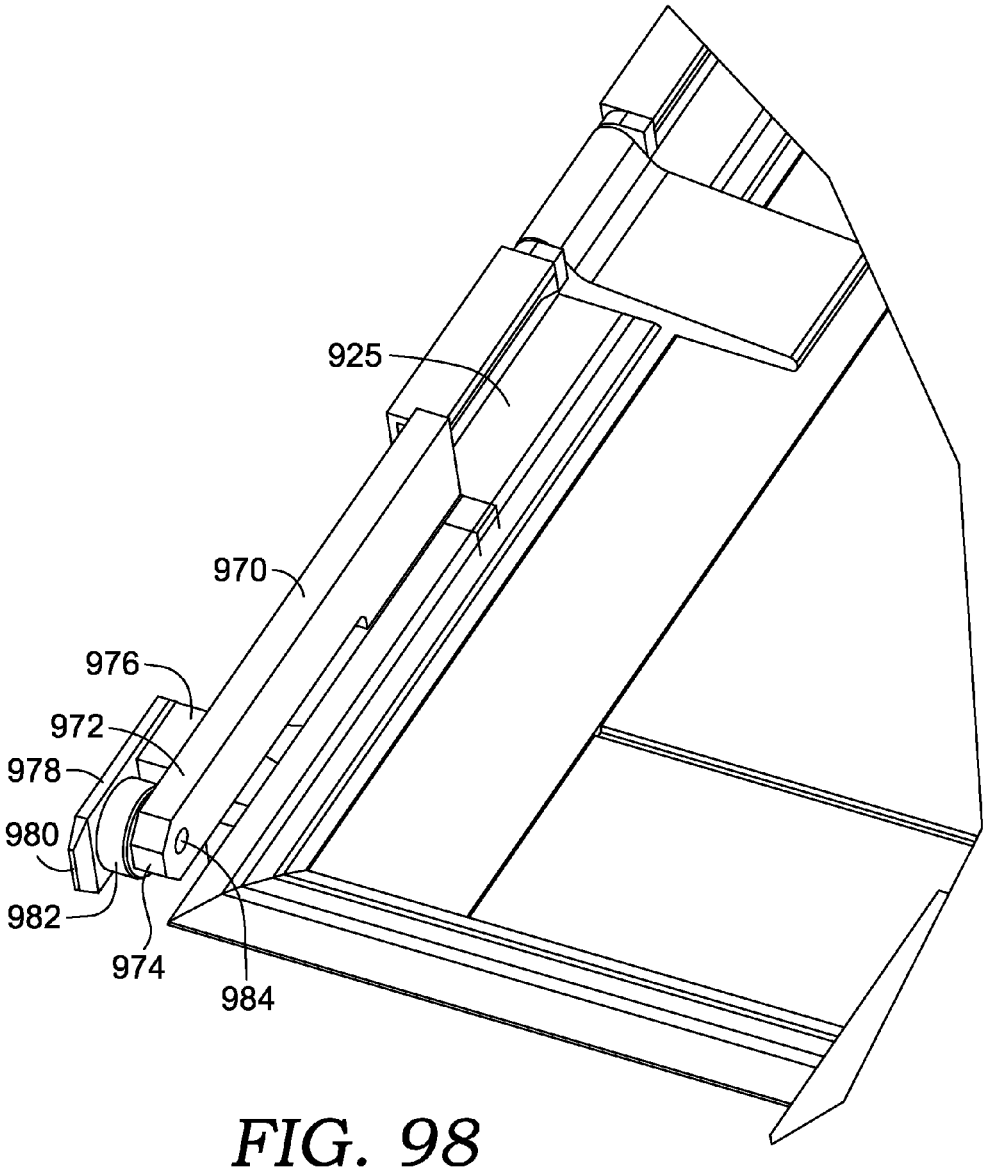
FIG. 98 is a view of the door left post roller arm.

As shown in FIGS. 89-92, at the lower end 960, 961 of each of the door posts 924, 925 of the door panel 18 is a tang 962, 963. Each door tang 962, 963 has a front face 964, 965 which faces the front panel 12, and a door face 966, 967 which faces away from the front panel 12. As shown in greater detail in FIGS. 93 and 94, the door tang 962 attached to the door right post 924 includes a hole 968, which extends from the front face 964 to the door face 966 of the door tang 962, and the hole 968 tapers from a first diameter at the front face 964 to a slightly smaller diameter at the door face 966. As shown in FIGS. 95 and 96, the construction of the door tang 963 attached to the door left post 925 is the same as that for the tang 962 attached to the door right post 924, except that the hole 968 extends from the front face 965 of the door tang 963 attached to the door left post 925 to the door face 967 of the door tang 963 attached to the door left post 925.

As shown in FIGS. 93-96, each of the door posts 924, 925 has a door roller arm 969, 970 fixedly secured thereto adjacent the lower end thereof 960, 961, and each door roller arm 969, 970 extends downward along the immediately adjacent tang 962, 963, but in spaced relation thereto. The lower end 971, 972 of each door roller arm 969, 970 extends about two inches below the lower end 973, 974 of the immediately adjacent door tang.

As shown in FIGS. 93-98, a spacer 975, 976 is secured to each door roller arm 969, 970 adjacent the lower end 971, 972 thereof, and each spacer 975, 976 has a roller cover plate 977, 978 removably secured thereto in spaced relation to the immediately adjacent door roller arm 969, 970. The lower edge 979, 980 of each roller cover plate 977, 978 extends downward along the immediately adjacent door roller arm 969, 970 and then about half an inch to an inch below the lower end 973, 974 thereof. A door roller 981, 982 is rotatably attached to each of the roller arms 969, 970 adjacent the lower end 973, 974 thereof, and is secured in place by an axle pin 983, 984 that extends between the door roller arm 969, 970 and the roller cover plate 977, 978 immediately adjacent thereto. Each of the door rollers 981, 982 is aligned with one of the rails 402, 404 of the base panel 17 and rides on such rails 402, 404 during the folding, and unfolding, of the container 10 as described in more detail below.

Referring back to FIGS. 89 and 90, the door right post 924 includes a door right hinge plate 3891 that extends towards the front edge 22 of the roof panel 11 when the container 10 is in the unfolded condition. Attached to the inward surface 3892 of the door right hinge plate 3891, in spaced relation to each other, are a plurality of, and preferably four, first door right hinge members 3893. Each of the first door right hinge members 3893 is fixedly secured to the inward surface 3892 of the door right hinge plate 3891, preferably by welding.

Figure 90:
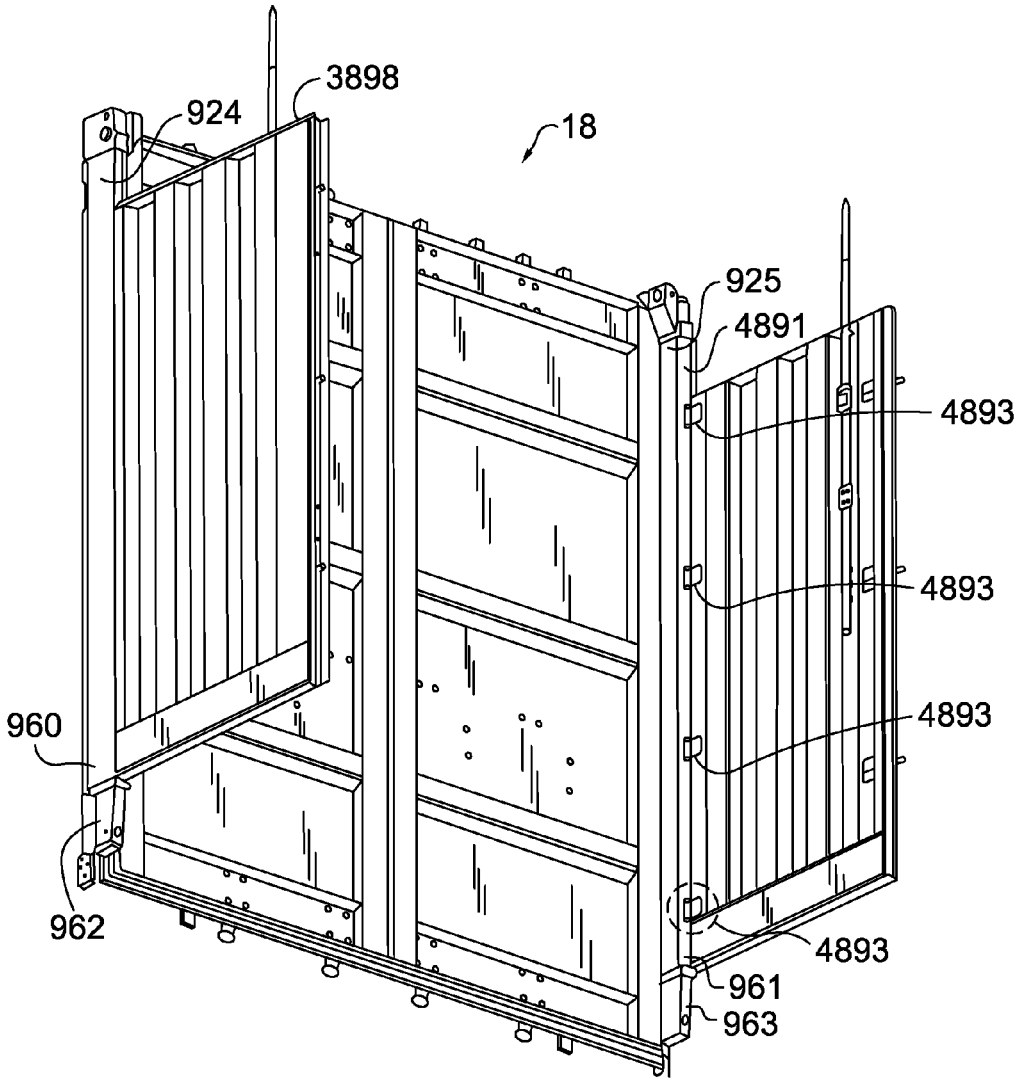
FIG. 90 is a perspective view of the door panel and right and left access panels.
Figure 99:
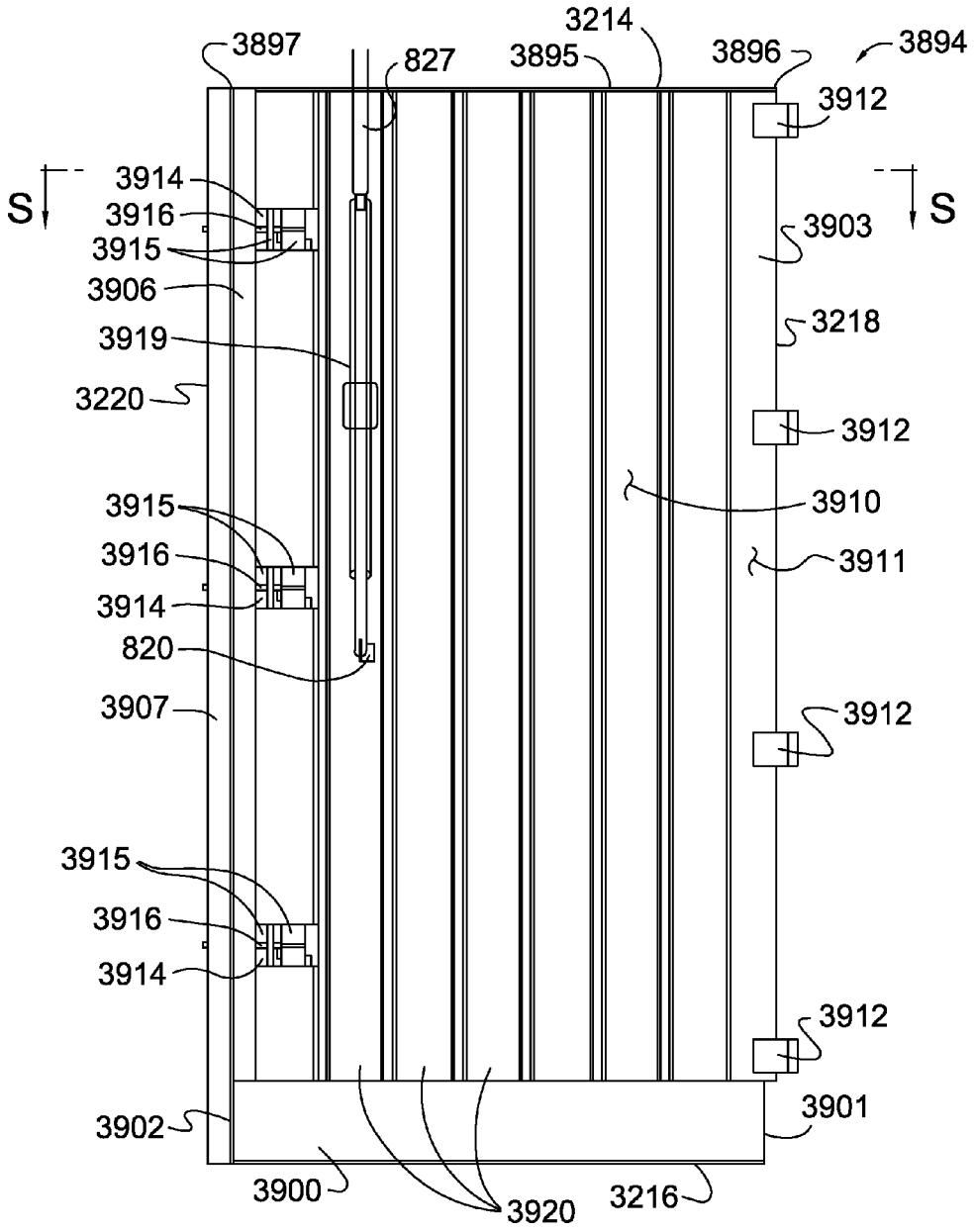
FIG. 99 is a plan view of the inner surface of the door right access panel.
Figure 105:
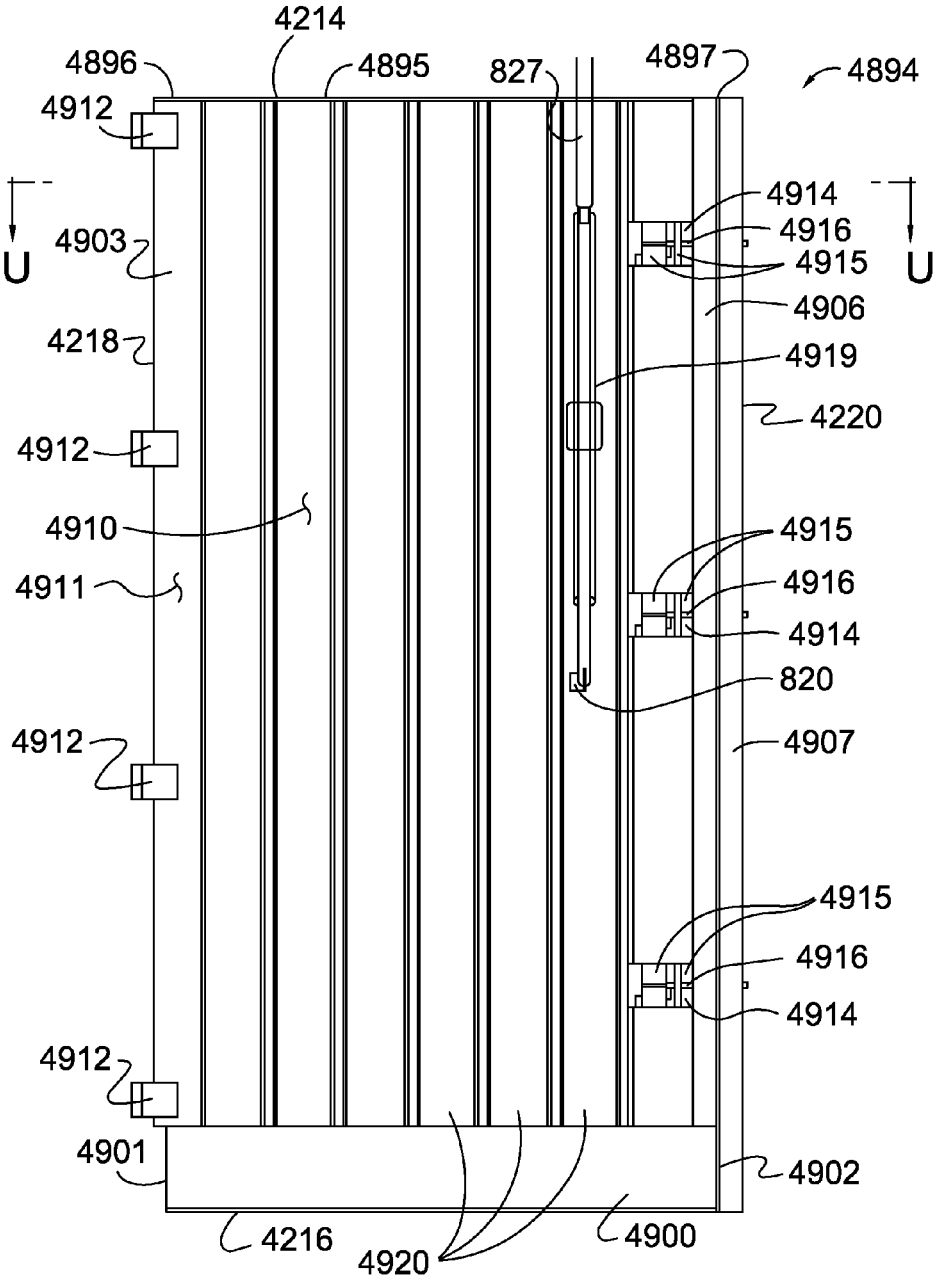
FIG. 105 is a plan view of the inner surface of the door left access panel.

A door right access panel 3894 is pivotably attached to the door right post 924, and as shown in FIGS. 99 and 105, the door right access panel 3894 includes a top edge 3214, a bottom edge 3216, a front edge 3218, and a door edge 3220. Extending along the top edge 3214 of the door right access panel 3894 along the length thereof is a door right upper cap plate 3895 having a front end 3896, a door end 3897, and preferably as shown in FIG. 90, a door right roof flange 3898 extends from the front end 3896 to the door end 3897. Extending along the bottom edge 3216 of the door right access panel 3894 along the length thereof is a front right beam 3900 that has a front end 3901 and a door end 3902.

Figure 91:
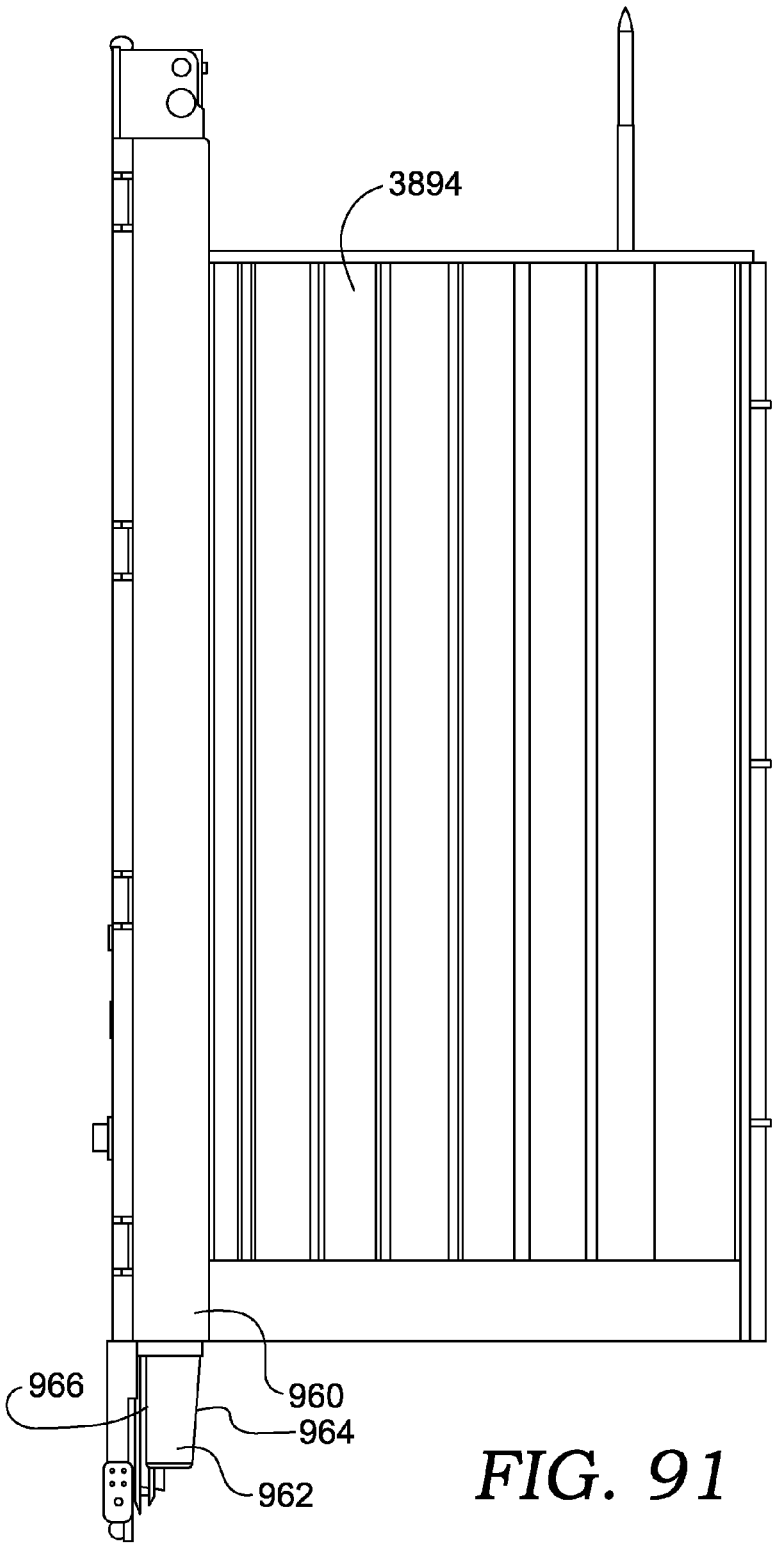
FIG. 91 is a plan view of the external surface of the door right access panel.
Figure 100:
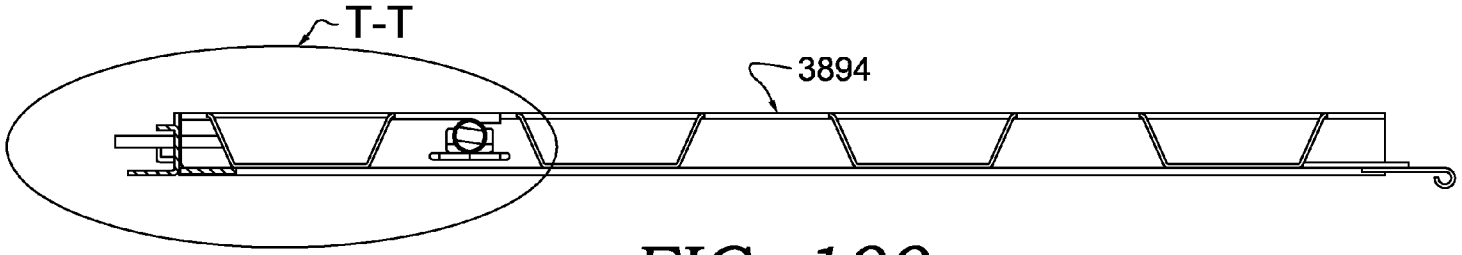
FIG. 100 is a cross sectional view of the door right access panel.
Figure 101:
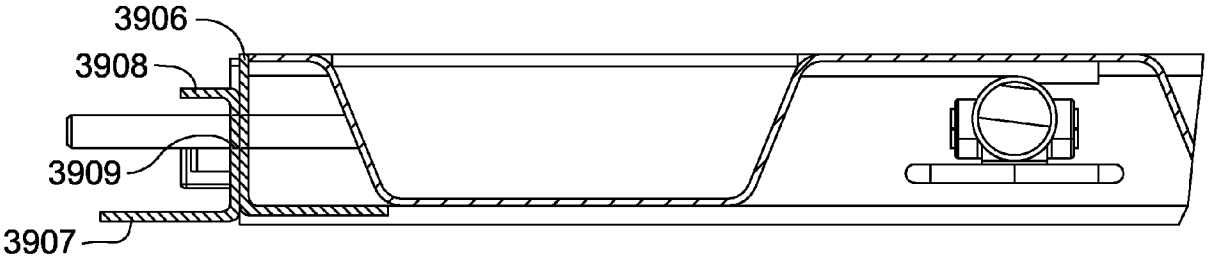
FIG. 101 is an enlarged view of section T-T of FIG. 100.

As shown in FIG. 99, a first door right access member 3903 extends from the door end 3897 of the door right upper cap plate 3895 to the door end 3902 of the door right beam 3900, and is fixedly secured to the door ends 3897, 3902, preferably by welding. As shown in FIGS. 91 and 99, a second door right access member 3906 extends from the front end 3896 of the door right upper cap plate 3895 to the front end 3901 of the door right beam 3900, and is fixedly secured to the front ends 3896, 3901, preferably by welding. As shown in FIGS. 99-101, the second door right access member 3906 includes a long flange 3907 and a short flange 3908, each of which extends along the length of the second door right access member 3906 and towards the door edge 21 of the roof panel 11 when the container 10 is in the unfolded condition. Located between the long flange 3907 and the short flange 3908 are a plurality of locking bolt holes 3909, preferably three, that extend through the second door right access member 3906. When the container 10 is in the unfolded condition, the locking bolt holes 3909 are aligned with the right side bolt holes 768 of the right side panel 14

Figure 89:
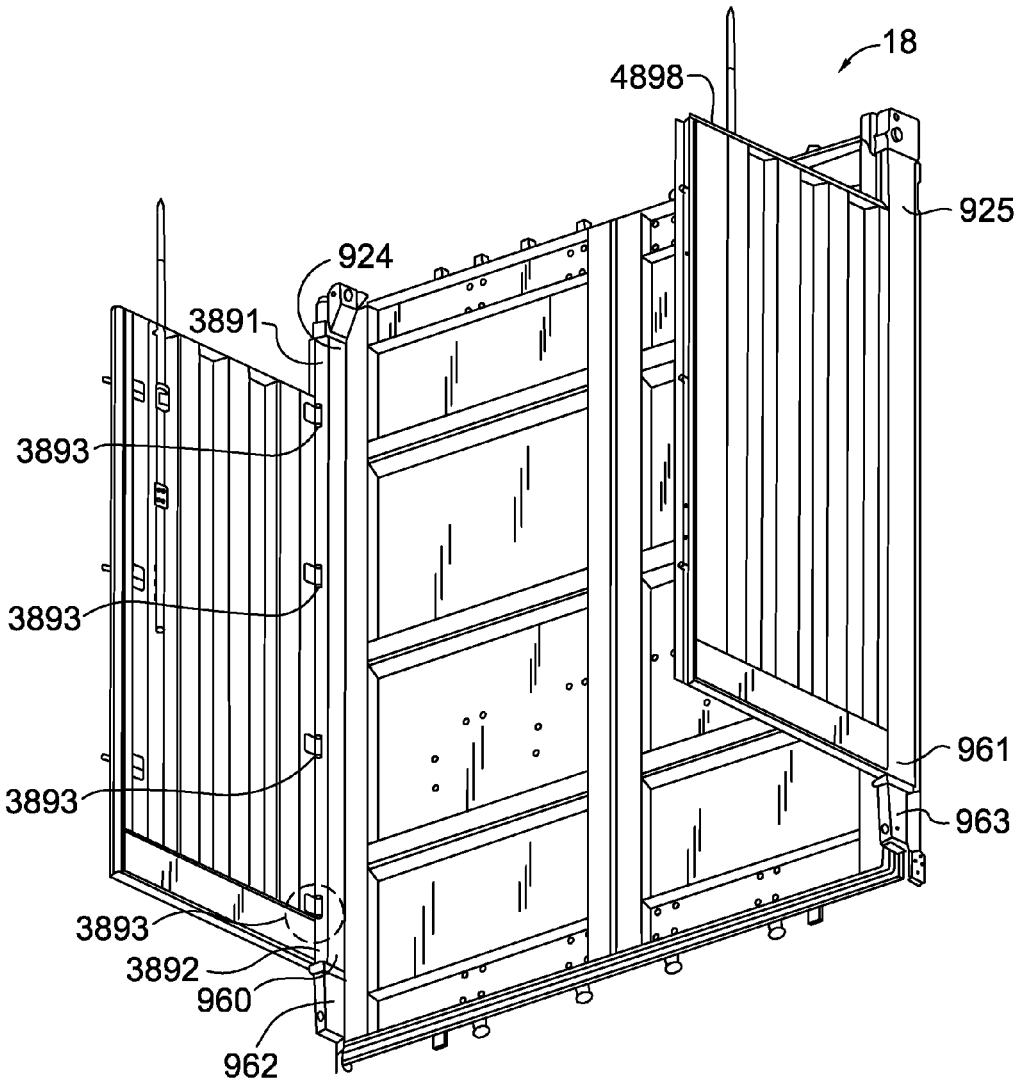
FIG. 89 is a perspective view of the door panel and right and left access panels.
Figure 102:
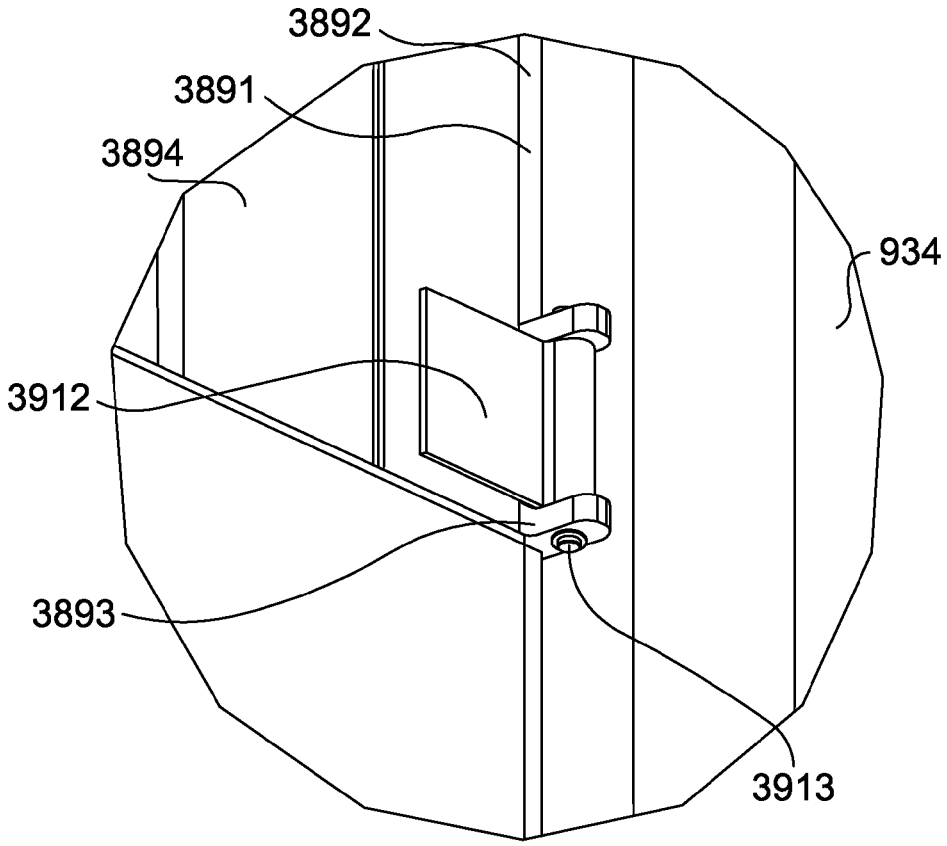
FIG. 102 is a view of a door right access panel hinge.

Referring again to FIG. 99, corrugated sheet metal 3910 extends from the door right upper cap plate 3895 to the door right beam 3900 along the entire length thereof, and from the first door right access member 3903 to the second door right access member 3906 along the entire length thereof. The corrugated sheet metal 3910 is welded all along its entire perimeter to the immediately adjacent door right upper cap plate 3895, first door right access member 3903, door right beam 3900, and second door right access member 3906. As those skilled in the art will readily appreciate, the second door right access member 3906 is welded to the corrugated sheet metal 3910 such that the long flange 3907 is visible from the interior of the container 10 when the container 10 is in its unfolded condition. As shown in FIGS. 89, 99 and 102, attached to the inward surface 3911 of the door right access panel 3894 and the first door right access member 3903 in spaced relation to each other, are a plurality of second door right hinge members 3912. Each of the second door right hinge members 3912 is rotatably secured to one of the first door right hinge members 3893 by a hinge pin 3913 so as to allow the door right access panel 3894 to swing relative to the door main panel 921.

Figure 103:
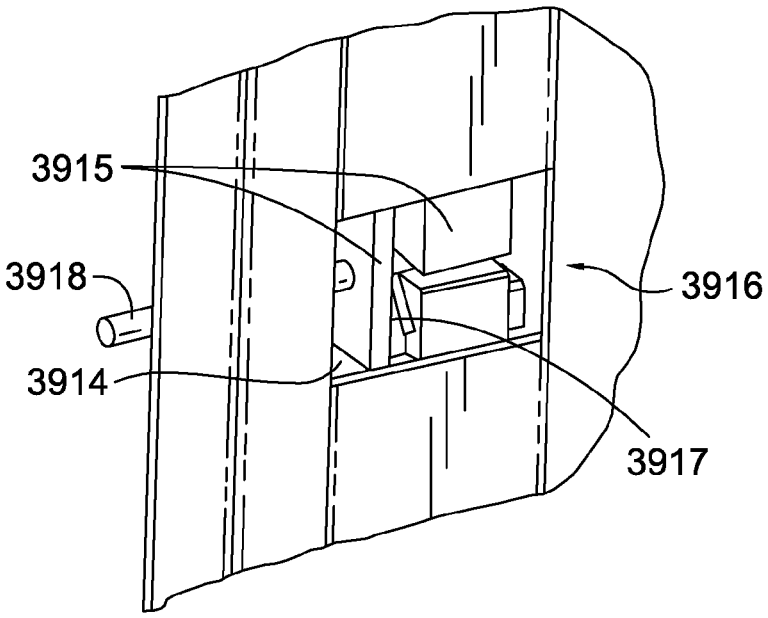
FIG. 103 is a view of the slide locking mechanism of the door right access panel.

Immediately adjacent each of the locking bolt holes 3909 in the second door right access member 3906 is a recess 3914 in the corrugated sheet metal 3910, and within each recess 3914 and aligned with the locking bolt holes 3909 in the second door right access member 3906 are slide lock retainers 3915. As shown in FIGS. 99 and 103, a slide locking mechanism 3916, including a lock lever 3917, and a slide locking bolt 3918, is slideably secured to each of the slide lock retainers 3915 within the recesses 3914 such that each slide locking mechanism 3916 is positionable by use of one of the slide lock levers 3917 between an unlocked position in which the respective slide locking bolt 3918 is in a retracted position outside of the right side bolt holes 768 of the right side panel 14, and a locked position in which the respective slide locking bolt 3918 extends through the immediately adjacent locking bolt hole 3909 of the second door right access member 3906 and one of the right side bolt holes 768 of the right side panel 14.

Figure 104:
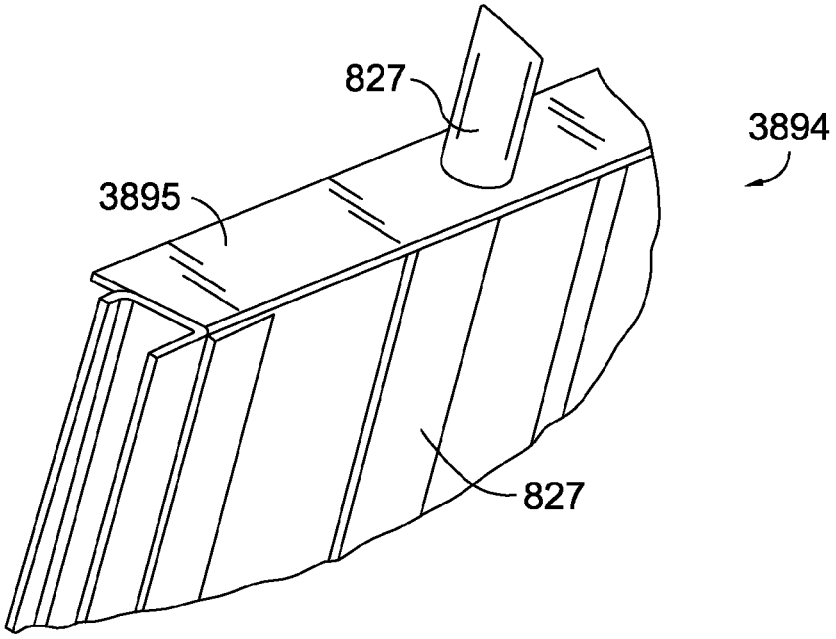
FIG. 104 is a perspective view of the upper cap plate of the door right access panel.

Referring again to FIG. 99, at least one locking bolt assembly 3919 is mounted to the door right access panel 3894 within corrugations 3920 of the corrugated sheet metal 3910. The construction of the locking bolt assembly 3919 is the same as those described with respect to the right side panel 14, except that each pivot anchor 820 is fixedly secured to the corrugated sheet metal 3910 of the door right access panel 3894, and each guide tube 827 extends through, and is fixedly secured to, the front right upper cap plate 3895, as shown in FIG. 104. As those skilled in the art will readily appreciate, each of the locking bolt assemblies 3919 so described is selectively positionable between a first position in which the locking bolt 823 is received within one of the locking bolt holes 610 in the lower face 608 of the roof right beam 600 when the container 10 is in the unfolded condition, and a second position in which the locking bolt 823 is fully withdrawn from that locking bolt hole 610.

Referring back to FIGS. 89 and 90, the door left post 925 includes a door left hinge plate 4891 that extends towards the front edge 22 of the roof panel 11 when the container 10 is in the unfolded condition. Attached to the inward surface 4892 of the door left hinge plate 4891, in spaced relation to each other, are a plurality of, and preferably four, first door left hinge members 4893. Each of the first door left hinge members 4893 is fixedly secured to the inward surface 4892 of the door left hinge plate 4891, preferably by welding.

A door left access panel 4894 is pivotably attached to the door left post 925, and as shown in FIG. 105, the door left access panel 4894 includes a top edge 4214, a bottom edge 4216, a front edge 4218, and a door edge 4220. Extending along the top edge 4214 of the door left access panel 4894 along the length thereof is a door left upper cap plate 4895 having a front end 4896, a door end 4897, and preferably as shown in FIG. 89, a door left roof flange 4898 extends from the front end 4896 to the door end 4897. Extending along the bottom edge 4216 of the front left access panel 4894 along the length thereof is a door left beam 4900 that has a front end 4901 and a door end 4902.

Figure 92:
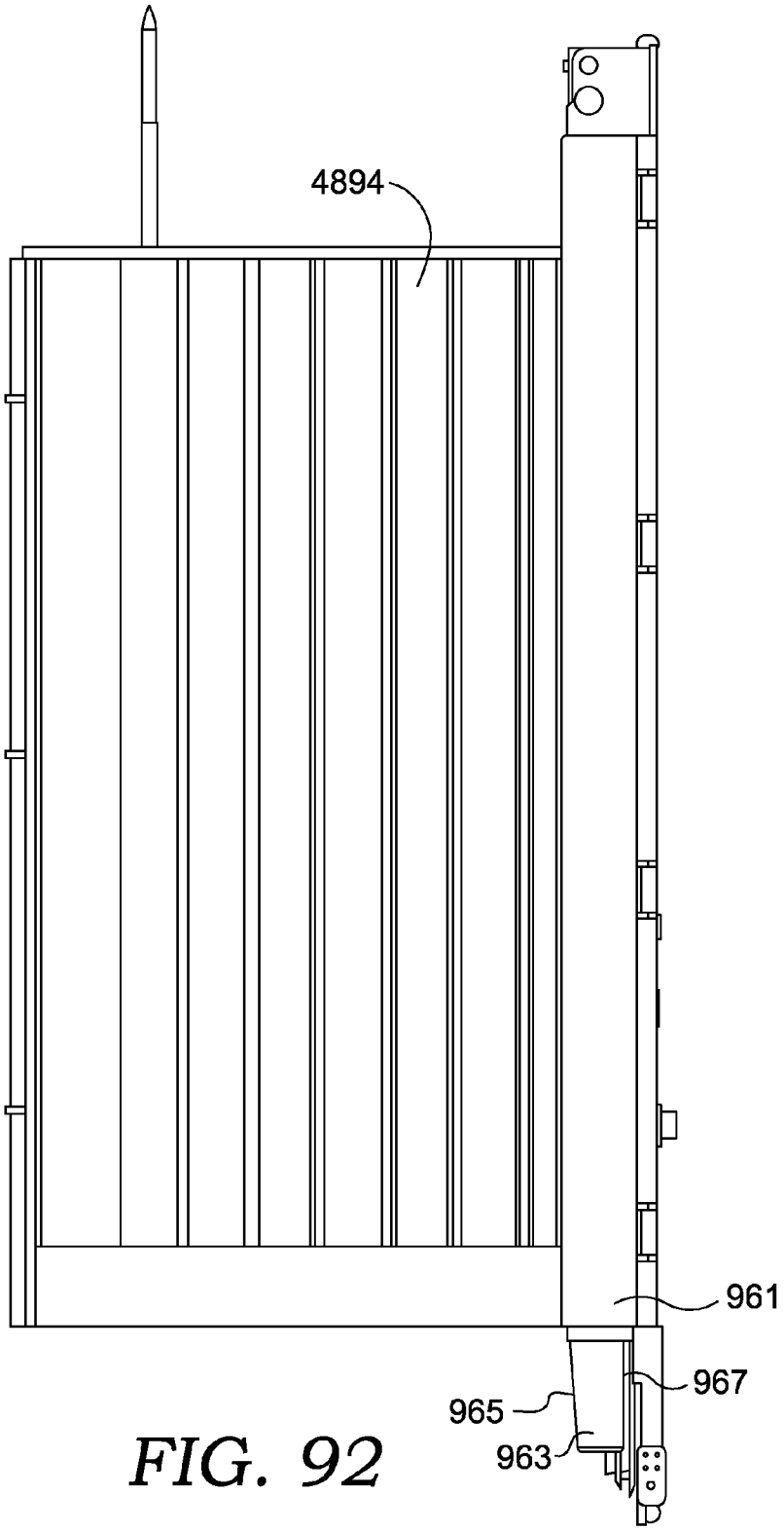
FIG. 92 is a plan view of the external surface of the door left access panel.
Figure 106:
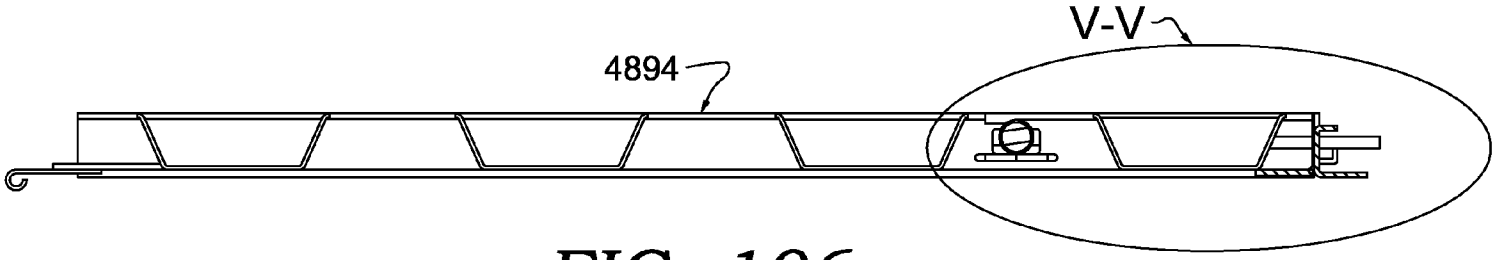
FIG. 106 is a cross sectional view of the door left access panel.
Figure 107:
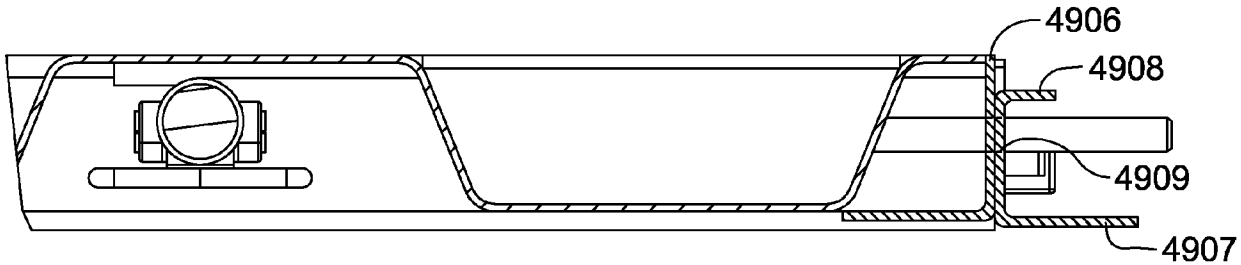
FIG. 107 is an enlarged view of section V-V of FIG. 106.

As shown in FIG. 105, a first door left access member 4903 extends from the door end 4897 of the door left upper cap plate 4895 to the door end 4902 of the door left beam 4900, and is fixedly secured to the door ends 4897, 4902, preferably by welding. As shown in FIGS. 92 and 105, a second door left access member 4906 extends from the front end 4896 of the door left upper cap plate 4895 to the front end 4901 of the door left beam 4900, and is fixedly secured to the front ends 4896, 4901, preferably by welding. As shown in FIGS. 105-107, the second door left access member 4906 includes a long flange 4907 and a short flange 4908, each of which extends along the length of the second front left access member 4906 and towards the front edge 22 of the roof panel 11 when the container 10 is in the unfolded condition. Located between the long flange 4907 and the short flange 4908 are a plurality of locking bolt holes 4909, preferably three, that extend through the second front left access member 4906. When the container 10 is in the unfolded condition, the locking bolt holes 4909 are aligned with the left side bolt holes 795 of the left side panel 16

Figure 108:
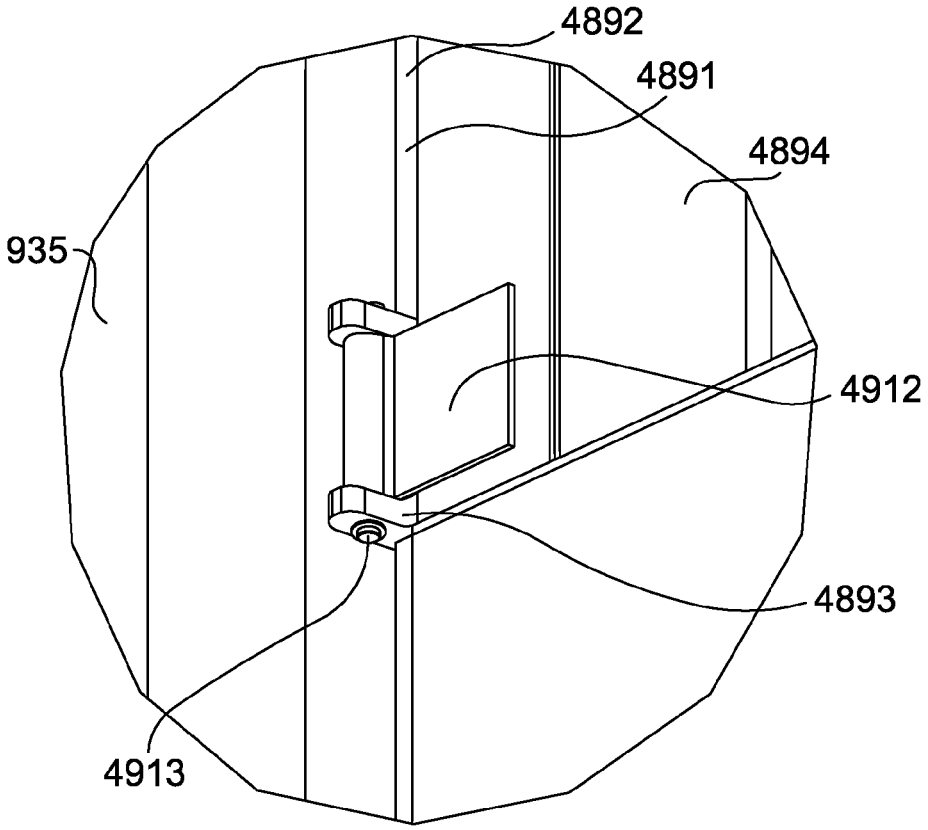
FIG. 108 is a view of a door left access panel hinge.

Referring again to FIG. 105, corrugated sheet metal 4910 extends from the door left upper cap plate 4895 to the door left beam 4900 along the entire length thereof, and from the first door left access member 4903 to the second door left access member 4906 along the entire length thereof. The corrugated sheet metal 4910 is welded all along its entire perimeter to the immediately adjacent door left upper cap plate 4895, first door left access member 4903, door left beam 4900, and second door left access member 4906. As those skilled in the art will readily appreciate, the second door left access member 4906 is welded to the corrugated sheet metal 4910 such that the long flange 4907 is visible from the interior of the container 10 when the container 10 is in its unfolded condition. As shown in FIGS. 90, 105 and 108, attached to the inward surface 4911 of the door left access panel 4894 and the first door left access member 4903 in spaced relation to each other, are a plurality of second door left hinge members 4912. Each of the second door left hinge members 4912 is rotatably secured to one of the first door left hinge members 4893 by a hinge pin 4913 so as to allow the door left access panel 4894 to swing relative to the door main panel 921.

Figure 109:
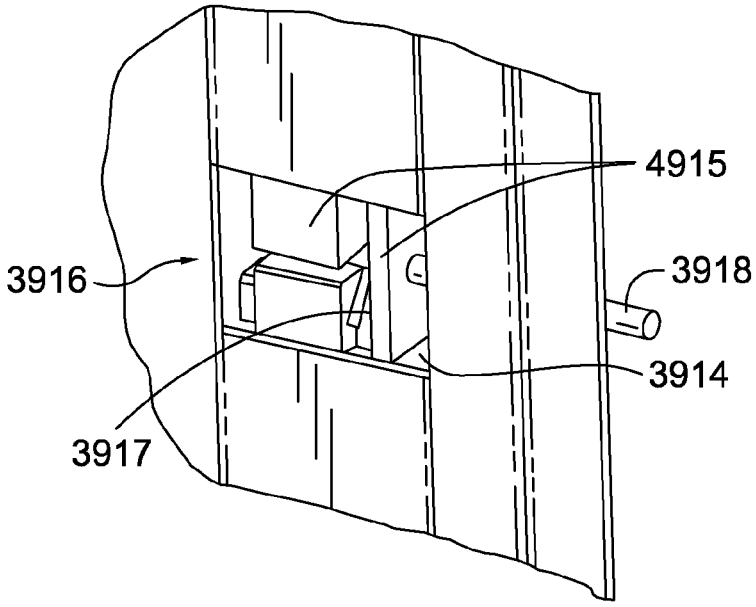
FIG. 109 is a view of the slide locking mechanism of the door left access panel.

Immediately adjacent each of the locking bolt holes 3909 in the second door left access member 4906 is a recess 4914 in the corrugated sheet metal 4910, and within each recess 4914 and aligned with the locking bolt holes 4909 in the second front left access member 4906 are slide lock retainers 4915. As shown in FIGS. 105 and 109, a slide locking mechanism 4916, including a slide lock lever 4917, and a slide locking bolt 4918, is slideably secured to each of the slide lock retainers 4915 within the recesses 4914 such that each slide locking mechanism 4916 is positionable by use of one of the slide lock levers 4917 between an unlocked position in which the respective slide locking bolt 4918 is in a retracted position outside of the left side bolt holes 795 of the left side panel 16, and a locked position in which the respective slide locking bolt 4918 extends through the immediately adjacent locking bolt hole 4909 of the second door left access member 4906 and one of the left side bolt holes 795 of the left side panel 16.

Figure 110:
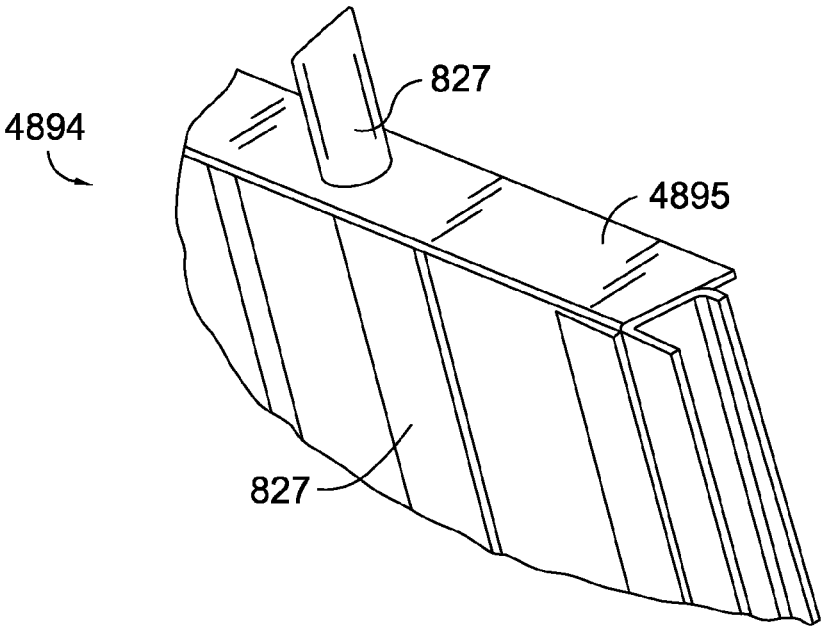
FIG. 110 is a perspective view of the upper cap plate of the door left access panel.

As shown in FIG. 105, at least one locking bolt assembly 4919 is mounted to the door left access panel 4894 within corrugations 4920 of the corrugated sheet metal 4910. The construction of the locking bolt assembly 4919 is the same as those described with respect to the right side panel 14, except that each pivot anchor 820 is fixedly secured to the corrugated sheet metal 4910 of the door left access panel 4894, and each guide tube 827 extends through, and is fixedly secured to, the door left upper cap plate 4895, as shown in FIG. 110. As those skilled in the art will readily appreciate, each of the locking bolt assemblies 4919 so described is selectively positionable between a first position in which the locking bolt 823 is received within one of the locking bolt holes 610 in the lower face 609 of the roof left beam 603 when the container 10 is in the unfolded condition, and a second position in which the locking bolt 823 is fully withdrawn from that locking bolt hole 610.

As those skilled in the art will readily appreciate, further embodiments can be incorporated to reduce cost and weight. One of these embodiments includes elimination of the access panels, replacing the side hinge members and linear spring assemblies with a torsion pin hinge, and increasing the height of the side panels to provide more strength to the base panel and reduction of weight from the top panel.

Figure 113:
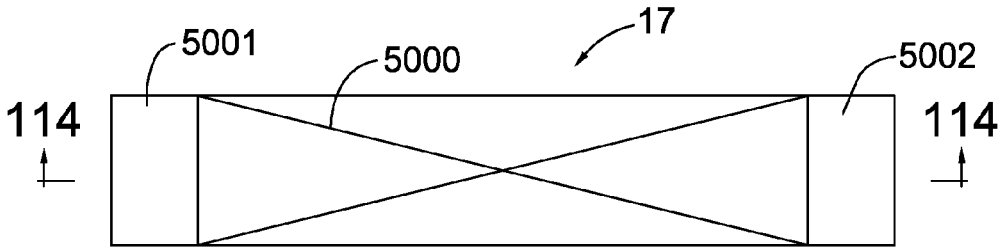
FIG. 113 is a schematic plan view showing the base panel with the side panels folded down and laying on top of it.
Figure 114:
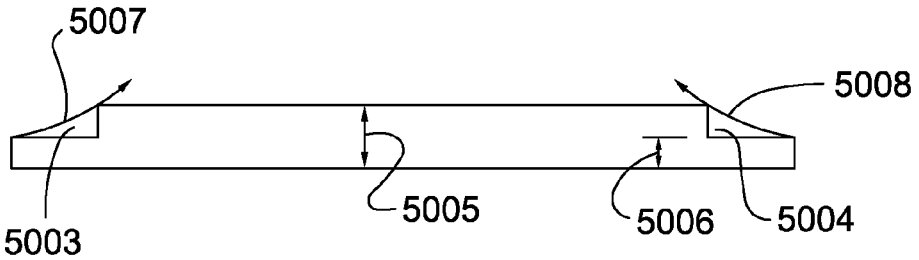
FIG. 114 is schematic cross sectional view taken along line 114-114 of FIG. 113.

The primary function of the access panels is to minimize the side panel section height near the door panel and the front panel to give access thereto. FIG. 113 is a schematic view plan view looking down on the base 17, showing the side panels folded down on the base 17. The area marked by the "X" 5000, shows the area occupied by the side panels when they are folded down. The two areas 5001, 5002, immediately adjacent the side panels are areas that are not occupied by the side panels because in this view the access panels are folded into the front panel or the door panel. A side view of the base 17 shown in FIG. 113 is shown in FIG. 114, which shows that since the side panels do not extend the entire length of the base, notched areas 5003, 5004 are formed at the ends of each side panel, because the stacked-up height 5005 of the base 17 and the side panels is substantially greater than the height 5006 of the base panel 17 at the two areas 5001, 5002, immediately adjacent the side panels. As shown by the curved arrows 5007, 5008, these notched areas 5003, 5004 allow the door panel and the front panel to clear the folded-down side panels as they swing along the paths shown by the curved arrows 5007, 5008 during the folding process. Unfortunately, inherent in this notched design are surfaces that may be difficult to seal effectively, and structural issues require additional weight in to achieve desirable rigidity of the container. This further embodiment eliminates the access panels all together by extending the side panels the entire length of the base. This eliminates the sealing requirements between the access panels and the side panels, reduces cost, and also significantly improves the structural aspects of the container.

Figure 115:
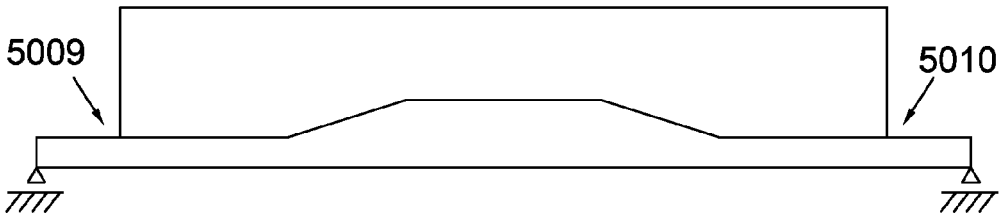
FIG. 115 shows a schematic side view of the base panel with the side panels in an unfolded position.

FIG. 115 shows a schematic side view of the base 17 with the side panels erect. As previously described, the side panels are structurally tied to the base panel 17 by side hinge members that provide both a hinge function for the side panels, and shear load capability for the container in its unfolded condition. While this design may perform satisfactorily, it incorporates structural features that may not be desirable in certain applications. Unfortunately, the side panels, which provide 80% of the load carrying capability of the base panel 17 (by effectively increasing the beam-height from a structural point of view), do not extend all the way to the ends of the base panel 17 where the right and left side door interlocks, and the right and left side front interlocks take all of the vertical loading. Consequently, stress is concentrated at the points 5009, 5010, where the ends of the side panels meet the base panel 17. By extending the side panels the full length of the base panel 17, to the end of the beam, this stress concentration can be eliminated.

Figure 116:
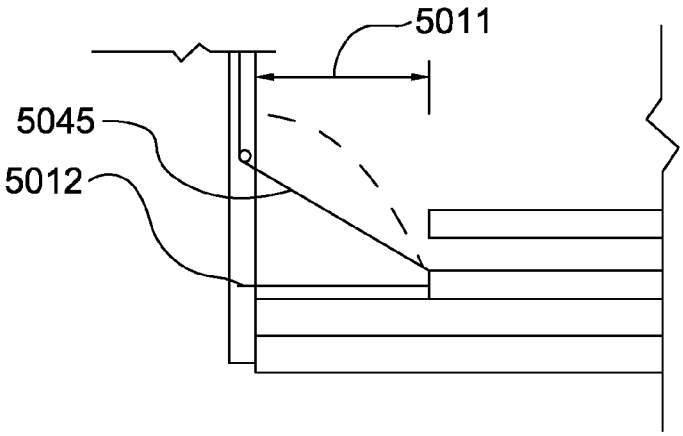
FIG. 116 is a schematic transverse cross-sectional view through the base panel and the side panels adjacent one of the side hinge members and linear spring assemblies.

FIG. 116 shows schematically a transverse cross-sectional view through the base panel 17 and the side panels adjacent one of the side hinge members and linear spring assemblies. As the left side panel is rotated down from its vertical position (as shown by the dashed lines) the spring mechanism in the linear spring assembly (not shown) is compressed, developing a tensile force in the cable 5045 which is preferably adjusted to provide the appropriate force to counter-balance the weight of the left side panel as it is folded down. Unfortunately, this design requires that the right side panel be shortened by a distance "D" 5011. As a result, the right side skirt, which extends down from the top panel, must be longer to compensate for the shortened height of the right side panel, as compared to if the right side panel height did not have to be shortened by a distance "D"5011 to accommodate the cable 5045. As those skilled in the art will readily appreciate, since the right and left side skirts are less rigid than the rest of the top panel from which they extend, the distance which the side skirts extend down from the top panel should preferably be as short as possible, and the side panels should be as tall as possible, to maximize the structural rigidity of the container.

Figure 117:
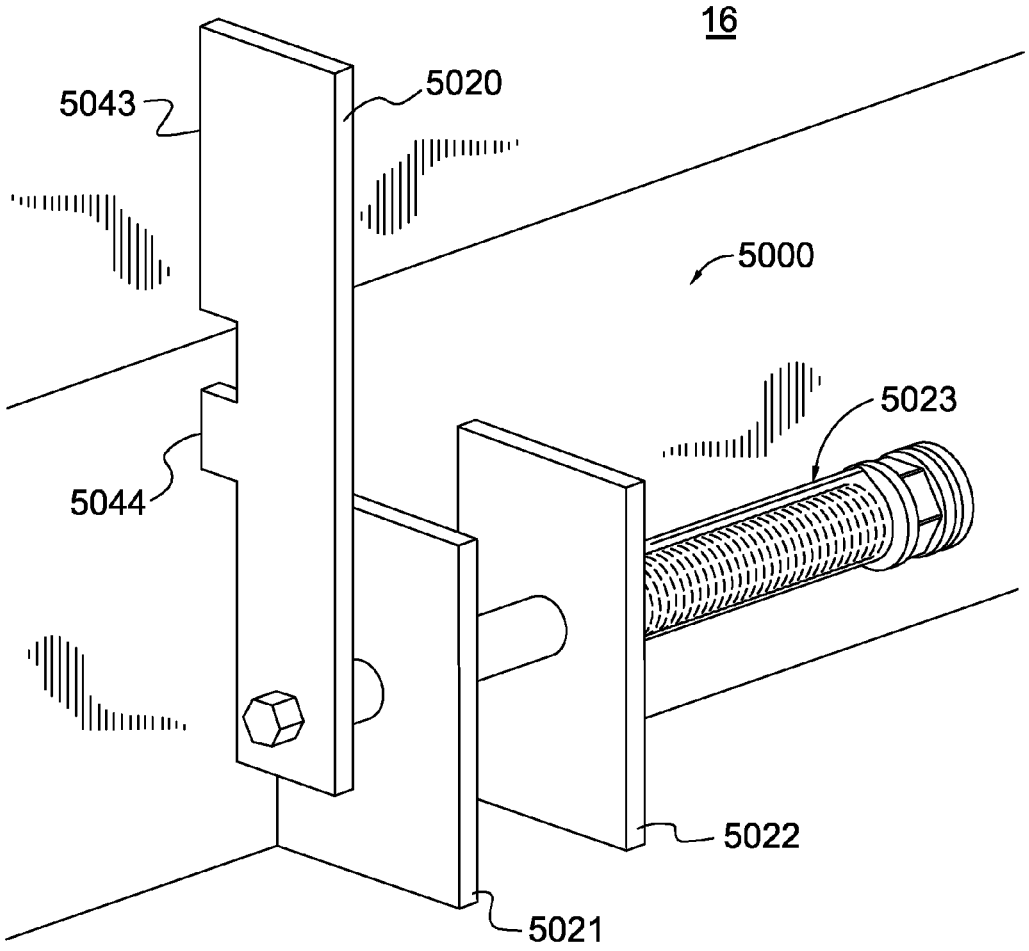
FIG. 117 is a view of one of the hinge pin torsion spring assemblies secured to the base panel and a side panel.

A further embodiment significant improvement to this arrangement is the use of hinge pin torsion spring assemblies, an example of which is shown in FIG. 117, instead of the linear spring assemblies and side hinge members attached to the right and left side panels described in the preferred embodiment. The hinge pin torsion spring replaces the "pin" in FIG. 116 torsion feature interior to the bottom beam. Preferably, each hinge pin torsion spring assembly 5000 includes a side panel hinge member 5020, base hinge members 5021, 5022, and a hinge pin torsion spring 5023. Although the hinge pin torsion spring assembly shown in FIG. 117 is shown and described attached to the to the left side panel, it is to be understood that the hinge pin torsion spring assemblies used on the right side panel are similar.

Figure 118:
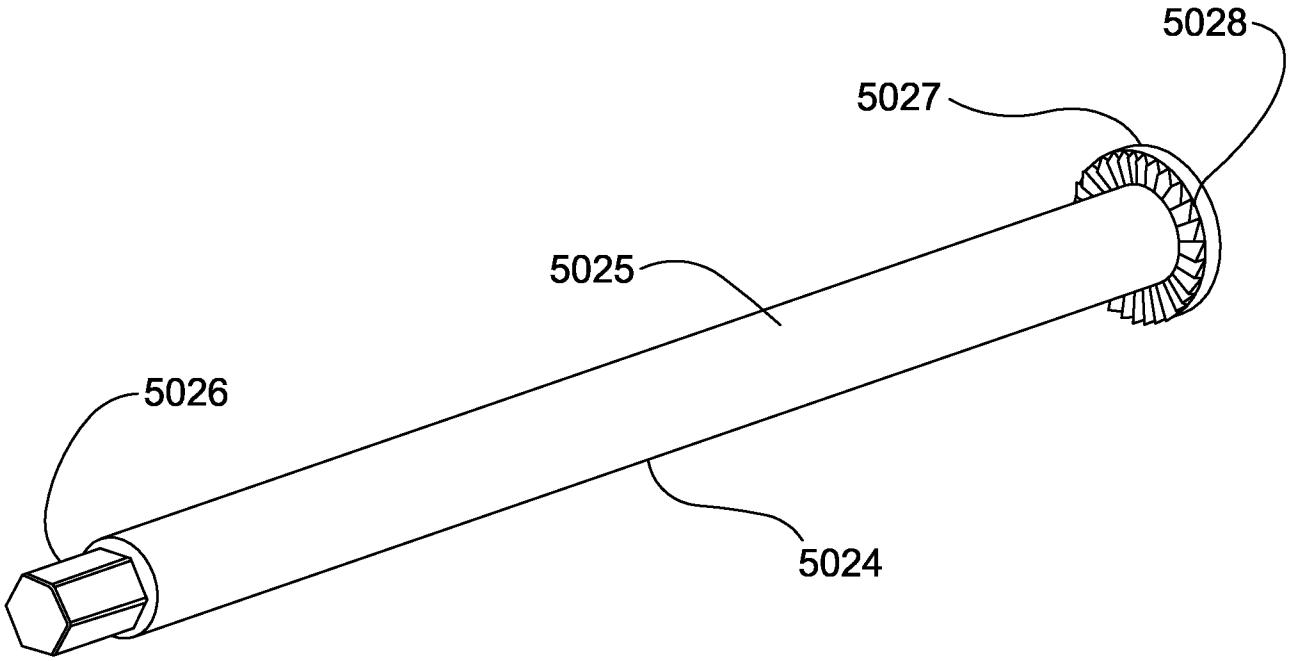
FIG. 118 is a view of a hinge pin of one of the hinge pin torsion spring assemblies.

The hinge pin torsion spring 5023, as shown in FIG. 118, includes a hinge pin 5024 having a cylindrical main section 5025, a non-cylindrical section 5026, preferably hexagonal in cross-section, at one end of the hinge pin, and a pin ratcheting feature 5027 at the end opposite the non-cylindrical section 5026. The pin ratcheting feature 5027, which is preferably a cylindrical disk, includes a plurality of gear teeth 5028 which face the non-cylindrical section 5026 and which are all canted in the same circumferential direction. The non-cylindrical section 5026 and the pin ratcheting feature 5027 are integral with the cylindrical main section 5025, so that rotation of the non-cylindrical section 5026 necessarily causes the pin ratcheting feature 5027 to rotate in the same direction.

Figure 119:
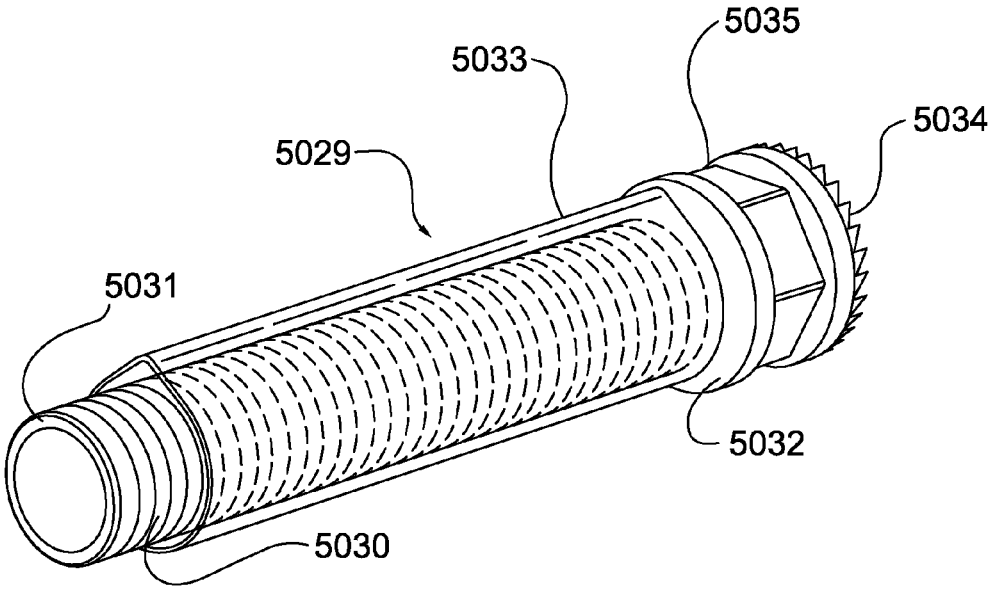
FIG. 119 is a view of a Torsion spring of one of the hinge pin torsion spring assemblies.

As shown in FIG. 119, the torsion spring 5029 of the hinge pin torsion spring 5023 includes a coil spring 5030, an attachment ring 5031, a spring ratcheting feature 5032, and a spring shield 5033. The attachment ring 5031 and the spring ratcheting feature 5032 each have an inner bore having a diameter that is greater than the outer diameter of the cylindrical main section 5025 of the hinge pin 5024 to allow the cylindrical main section 5025 of the hinge pin 5024 to slide therethrough without binding. Likewise, the inner diameter of the coil spring 5030 is greater than the outer diameter of the cylindrical main section 5025 of the hinge pin 5024 to avoid binding between the cylindrical main section 5025 of the hinge pin 5024 and the coil spring 5030 at all operating positions of the hinge pin torsion spring 5023. The attachment ring 5031 is fixedly attached, preferably by welding, to one end of the coil spring 5030, and the spring ratcheting feature 5032 is fixedly attached, preferably by welding, to the opposite end of the of the coil spring 5030. The spring ratcheting feature 5030, which is preferably generally cylindrical, includes a plurality of gear teeth 5034 which face away from the attachment ring 5031 and which are all canted in the same circumferential direction, which is opposite the direction in which the gear teeth 5028 of the pin ratcheting feature are canted. The spring ratcheting feature 5032 includes a non-cylindrical portion 5035, which is preferably hexagonal in cross section, the purpose of which is described below. The spring shield 5033 which is tubular and may be cylindrical or non-cylindrical, fits loosely around, and protects, the coil spring 5030.

Figure 120:
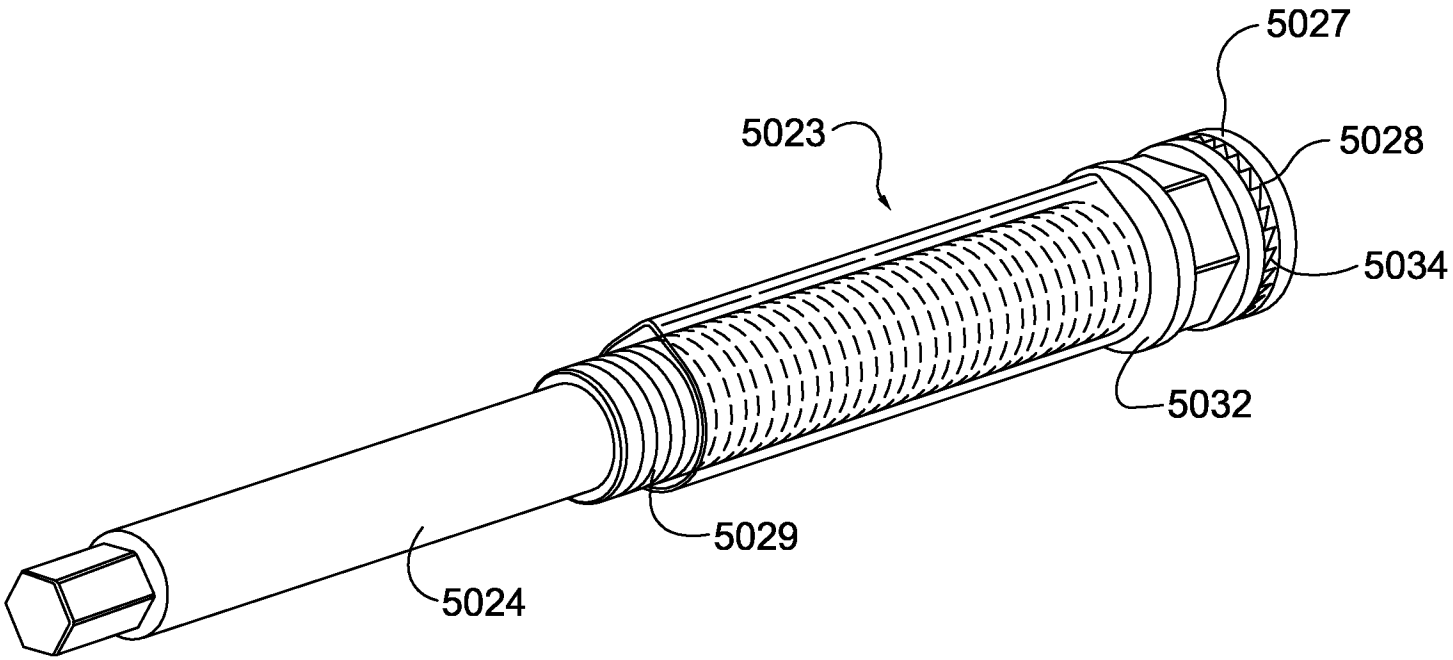
FIG. 120 is a view of a hinge pin torsion spring fully assembled.

The hinge pin torsion spring 5023 is shown in FIG. 120 fully assembled, with the hinge pin 5024 inserted into the torsion spring 5029. As those skilled in the art will readily appreciate, in this assembled condition, the gear teeth 5028 of the pin ratcheting feature 5027 are interlocked with the gear teeth 5034 of the spring ratcheting feature 5032, and due to the canted nature of the gear teeth 5028, 5034, can only be rotated in one direction, and the gear teeth 5028, 5034 will lock together if rotation in the opposite direction is attempted.

Figure 121:
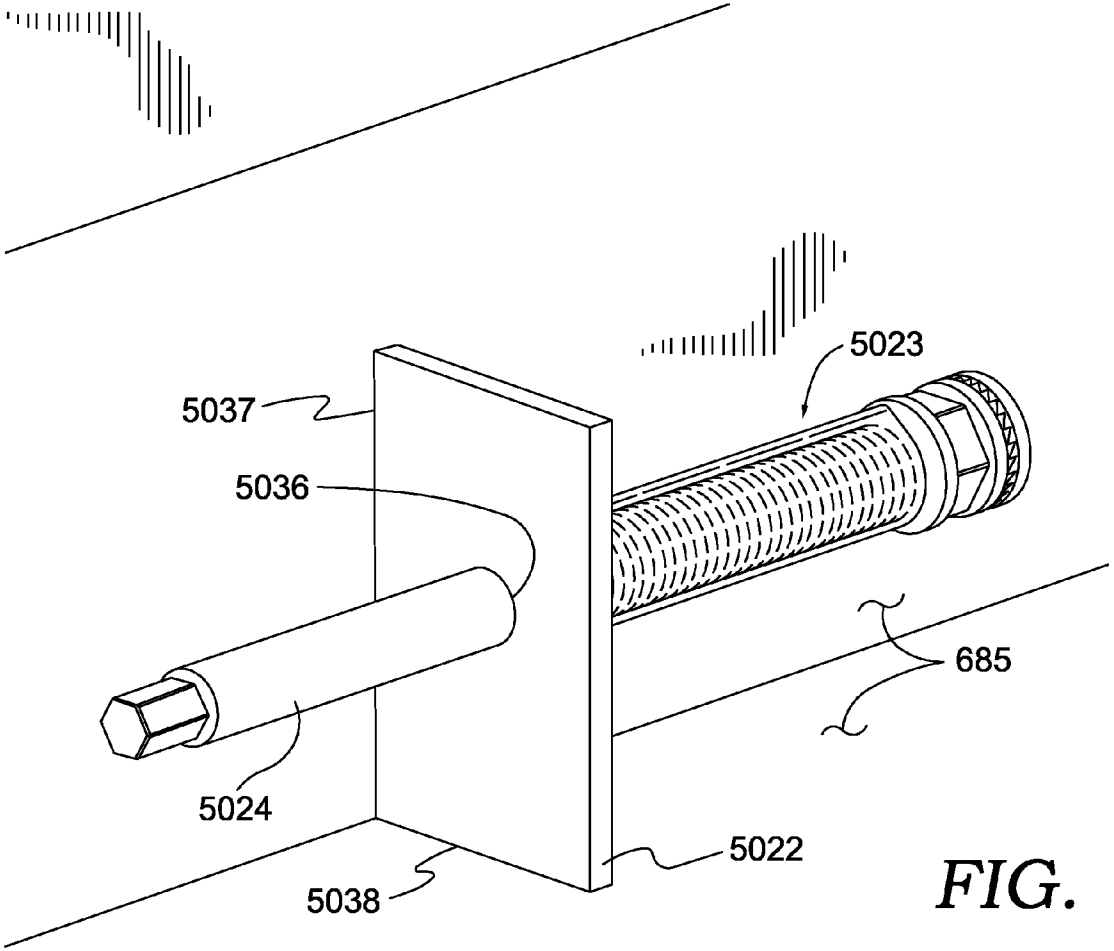
FIG. 121 is a view showing a hinge pin of a hinge pin torsion spring received within a hole in a base hinge member.

As shown in FIG. 121 the hinge pin 5024 of the hinge pin torsion spring 5023 is received within a hole 5036 in base hinge member 5022. The hole 5036 is slightly larger than the outer diameter of the cylindrical main portion 5025 of the hinge pin 5024 so as to allow the hinge pin to rotate freely therein. In addition, the attachment ring 5031, is fixedly attached to the base hinge member 5022, either by welding or by some other attachment method that prevents rotation between the attachment ring 5031 and base hinge member 5022. Base hinge member 5022 is welded to the base left beam 685 along the vertical edge 5037 immediately adjacent thereto, and to the base left beam 685 along the horizontal edge 5038 immediately adjacent thereto.

Figure 122:
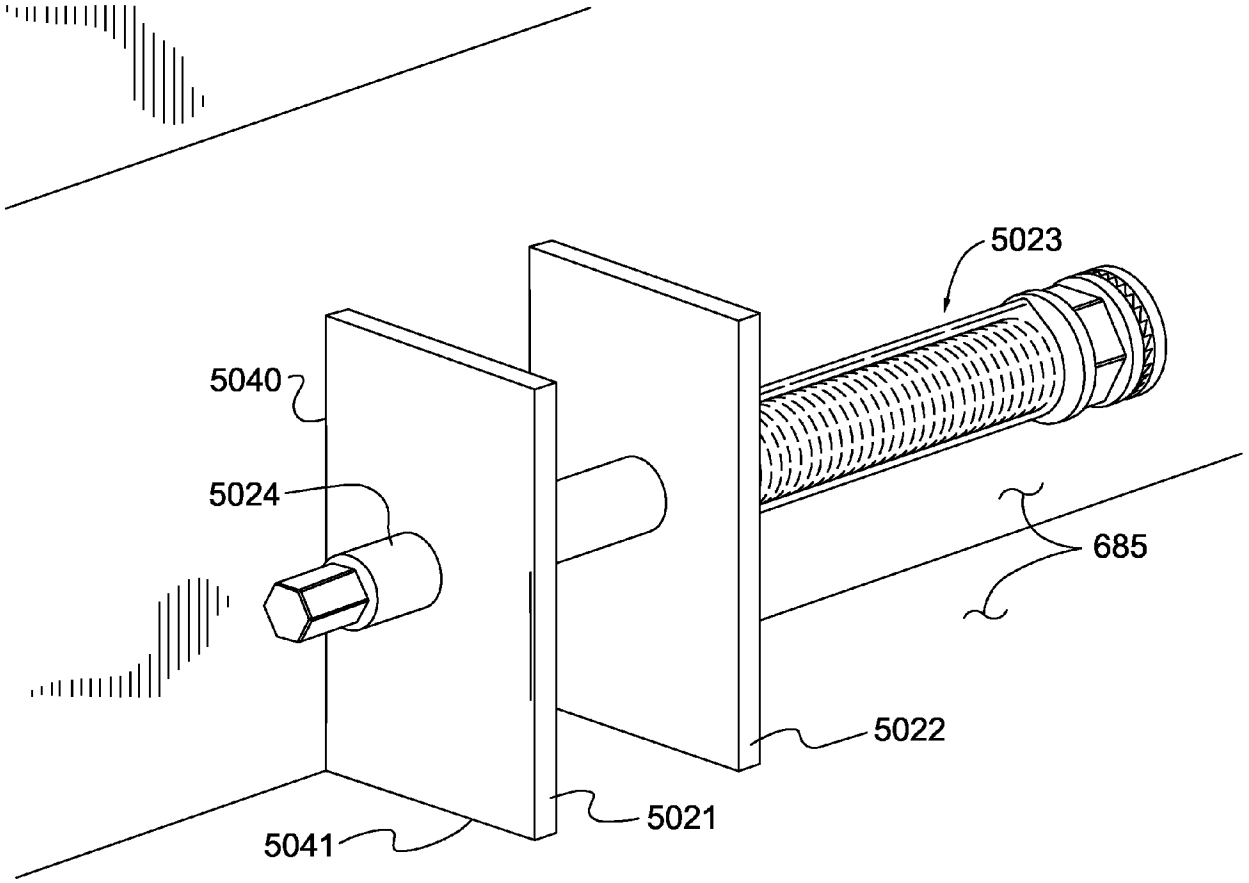
FIG. 122 is a view showing a hinge pin of a hinge pin torsion spring received within a hole in another base hinge member.
Figure 123:
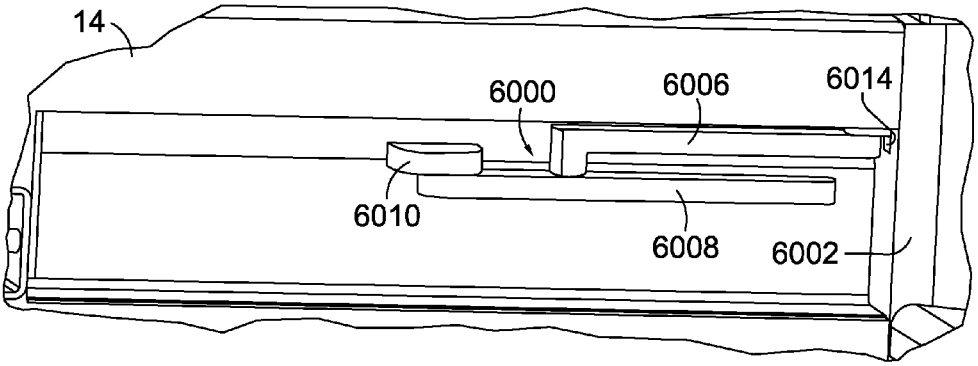
Figure 124:
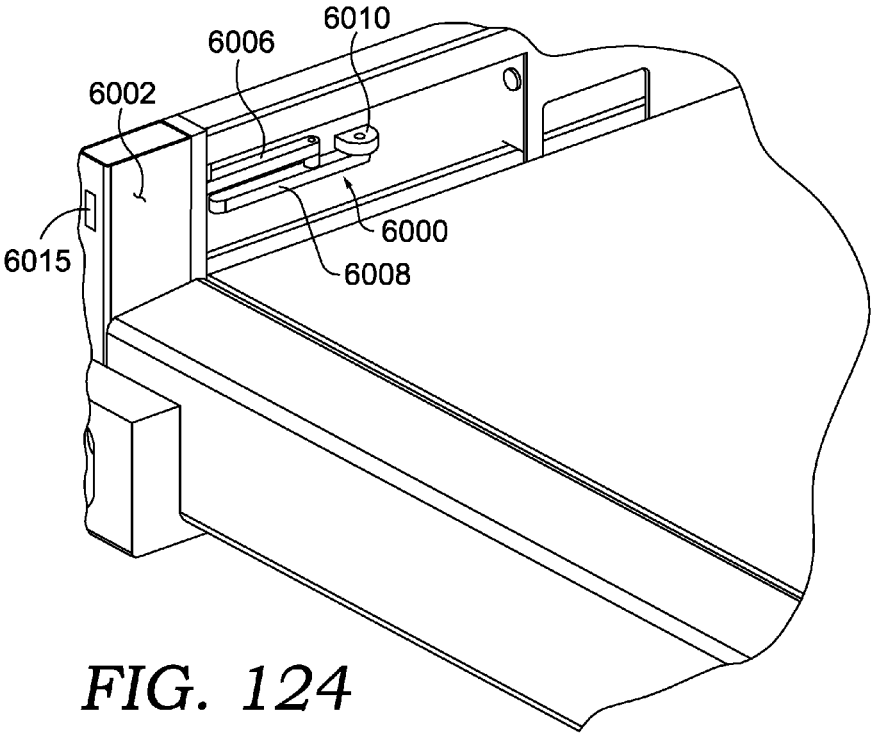

As shown in FIG. 122 the hinge pin 5024 of the hinge pin torsion spring 5023 is received within a hole 5039 in base hinge member 5021. The hole 5039 is slightly larger than the outer diameter of the cylindrical main portion 5025 of the hinge pin 5024 so as to allow the hinge pin to rotate freely therein. Base hinge member 5021 is welded to the base left beam 685 along the vertical edge 5040 immediately adjacent thereto, and to the base left beam 685 along the horizontal edge 5041 immediately adjacent thereto.

Referring again to FIG. 117, the hexagonal portion 5026 of the hinge pin 5024 is received within a hexagonal hole 5042 in side panel hinge member 5020. The hexagonal portion 5026 of the hinge pin 5024 welded, or otherwise fixedly secured to side panel hinge member 5020 to prevent the hinge pin 5024 from inadvertently sliding out of the torsion spring 5029. Side panel hinge member 5020 is welded to the left side panel 16 along the vertical edge 5043 immediately adjacent thereto, and if desired, may include a stop 5044 to insure that the side panel 16 stops rotating once the side panel 16 is vertical to prevent it from rotating past the vertical position.

As those skilled in the art will readily appreciate, in the fully assembled condition shown in FIG. 117, an open-end wrench can be used on the hexagonal portion 5035 of the spring ratcheting feature 5032 to rotate the spring ratcheting feature 5032, thereby increasing the torque on the hinge pin 5024 and increasing the counterbalancing effect of the coil spring 5030 on the side panel 16. Once the torque has been so set, the hinge pin torsion springs provide torque to the side panels as they are rotated down, thereby counterbalancing the weight of the side panels.

The hinge pin torsion spring assembly 5000 eliminates the need for the step up in height from height 5006 to height 5005 in FIG. 114, eliminates the requirement that either side panel 14, 16 be shortened to provide clearance for the cable 5045 from the linear spring assembly. Each hinge pin torsion spring assembly 5000 replaces a pin, cable and linear spring, among others. With no need to shorten the side panels to accommodate the cables, the height of the side panels can be increased to minimize the distance that the right and left skirts 23, 24 extend down from the roof panel, simplifying sealing in this area. With the elimination of the cable 5045, the risk that this cable, which is exposed and always under tension, may get caught on something and break, or injure someone, is eliminated as well. Likewise, elimination of the access panels allows each side panel to span the full length of the container, and the use of the hinge pin torsion springs allows height of each side panel to be maximized, resulting in a container that is lighter in weight and more rigid than a container incorporating access panels and linear spring assemblies with cables.

To fold the container of the present invention, the locking bolts on the access panels are retracted from their respective bolt holes in the roof panel, and the slide locking mechanisms in each of the access panels are used to retract the slide locking bolts from the bolt holes in the right and left side panels. One of the access panels on the front panel and one of the access panels on the at the door panel is then swung toward the interior of the folding container until they lie substantially flat against the respective front, or door, main panel. The remaining access panels are then swung toward the interior of the folding container until they lie substantially flat against the other access panel. (Of course, if the embodiment of the present invention is the one which eliminates the access panels by extending the length of each side panel to the full length of the container, the foregoing folding steps related to the access panels do not occur in the folding process.)

The doors are then swung closed, but the locking rods are left in the unlocked position. The locking bar is swung into the locking block so that it is received between the flanges of the locking block, and a locking rod on the adjacent door is received within the locking rod recess of the locking bar.

Then a locking pin is inserted through the pin receiving hole of the upper flange of the locking block and into the lock pin hole of the locking bar, thus securing the doors together to prevent the doors from opening during the folding process.

Next, the locking bolts on the left and right side panels are retracted from their respective bolt holes in the roof panel, thereby freeing the side panels to be rotated inwardly. One of the side panels is then swung from its vertical position to a position in which the side panel is resting on the floor of the base panel, after which the other side panel is then swung from its vertical position to a position in which it is resting on the other side. As each of the right and left side panels is rotated inward, the weight of that side panel is substantially counter balanced by the spring force provided by the springs in the linear spring assemblies, or the hinge pin torsion spring assemblies, depending on which is used, thereby allowing one or two people to safely fold the left and right side panels from a vertical position to a horizontal position without additional equipment. At this point, a spreader attaches to the roof panel at each of the four corner fittings in the manner similar to lifting typical shipping containers, so that the roof panel of the container is thus supported by both the spreader and the posts of the front panel and the door panel.

Then the hammer locking mechanisms in the recessed portions of the base right beam and base left beams adjacent the door main panel are used to retract the hammer locking bolts from the base door interlocks, and in doing so the holes in the door tangs at the lower ends of the right and left door posts, thus freeing the door panel from the base panel. Then and the hammer locking mechanisms in the recessed portions of the base right beam and base left beams adjacent the door main panel are used to retract the hammer locking bolts from the base door interlocks, and in doing so the holes in the door tangs at the lower ends of the right and left door posts, thus unlocking the door panel from the base panel. Likewise, the hammer locking mechanisms in the sill panel of the front panel are used to retract the hammer locking bolts from the base front interlocks, and in doing so the hammer locking bolts retract from the holes in the base front tangs in the lower ends of the right and left door posts, thus unlocking the front panel from the base panel.

The spreader then lifts the roof panel along with the attached front panel and door panel until the rollers at the lower ends of the door posts and front posts are just a little higher than the guide rails on the base panel immediately adjacent thereto, at which point the door tangs and base front tangs are in a position such that they are fully withdrawn from the interlocks of the door panel and front panel. At this point, the roof panel has been lifted to the highest point necessary in the folding process. Then workers push inwardly on the door panel to swing the bottom edge thereof to be positioned above the base panel well inward of the door edge of the base panel, while workers simultaneously push inwardly on the front panel to force the bottom edge thereof to be positioned above the base panel well inward of the front edge of the base panel. As the workers are so positioning the door panel and front panel, the spreader begins to slowly lower the roof panel until each of the rollers mounted on the lower ends of the door posts and front posts are resting on the immediately adjacent guide rails of the base panel.

Lowering of the roof panel then continues, causing the rollers of the door panel to roll along the guide rails of the base panel towards the front panel, guided by the cover plates which slide along, but outward of, the guide rails to keep the rollers from sliding off such guide rails. At the same time, lowering of the roof panel causes the rollers of the front panel to roll along the guide rails of the base panel towards the door panel, guided by the cover plates which slide along, but outward of, the guide rails to keep the rollers from sliding off such guide rails. Further lowering of the roof panel continues until the front panel and door panel are substantially parallel to the base panel, the roof panel is resting on the base panel, and each of the base tangs extending from the base panel is received within one of the interlocks of the roof panel. The container is then ready to be locked in its folded position.

Figure 111:
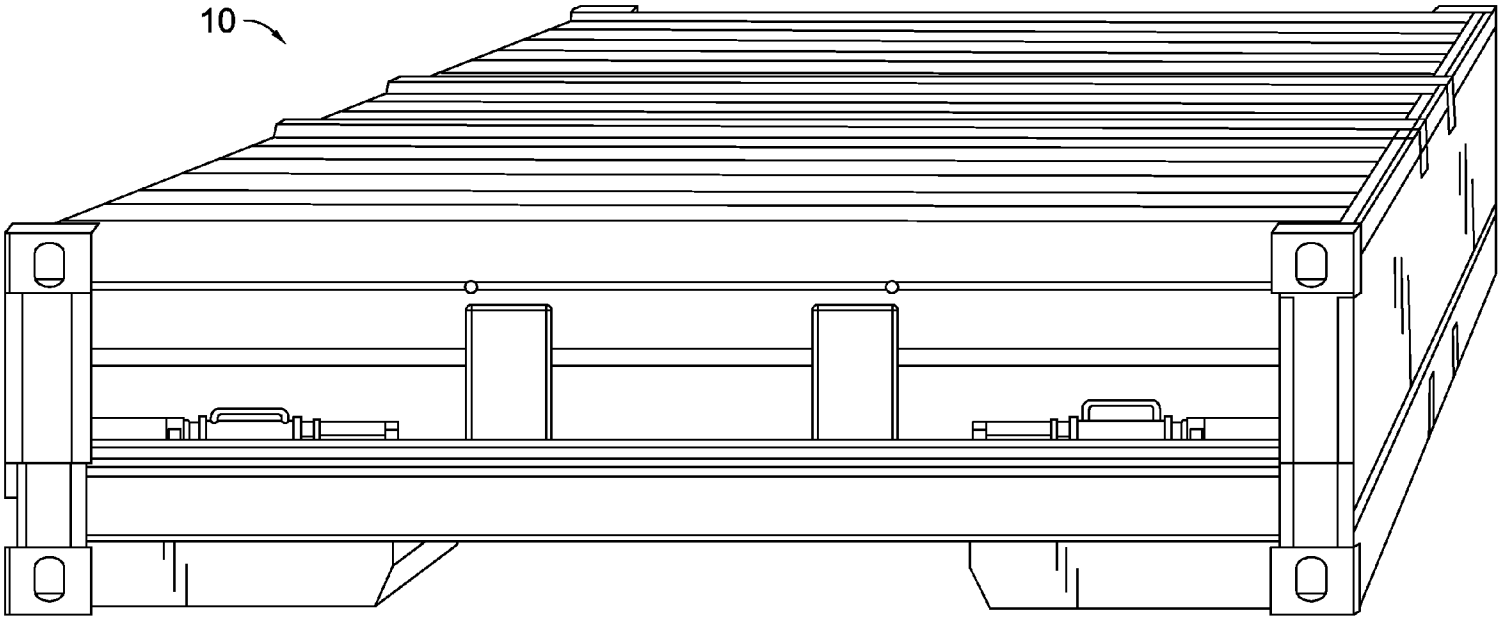
FIG. 111 is a perspective view of the front end of the folded container.
Figure 112:
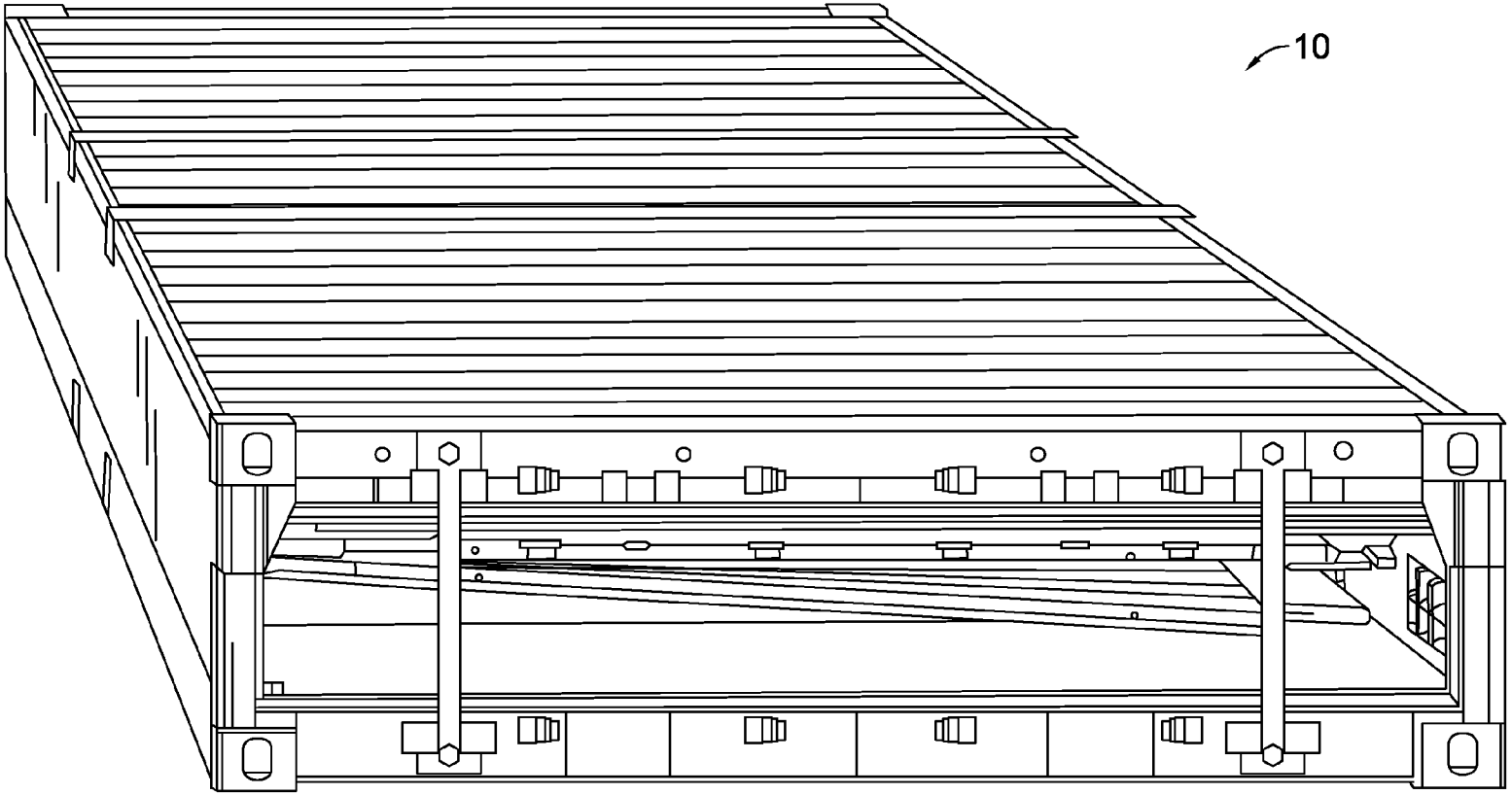
FIG. 112 is a perspective view of the door end of the folded container.

The hammer locks located on the roof panel adjacent the front edge thereof are engaged by hammering the locking bolts into the holes of the interlocks and the holes of the base tangs received therein, as shown in FIG. 111. This locks the roof panel to the base panel at the front edges thereof. Then, the pair of locking straps are removed from their stored position, and then re-attached to the folded container such that each locking strap is located between a pair of upper door stop receivers in the roof panel, and a pair of lower door stop receivers in the base panel. Each locking strap is secured to the folded container by bolting the upper end of each locking strap to the roof panel with a bolt that is threaded into one of the upper active strap bolt holes and tightened, and by bolting the lower end of each locking strap to the roof panel with a bolt that is threaded into one of the lower active strap bolt holes and tightened. In this position, as shown in FIG. 112, each "T" end of each locking strap is resting against the upper or lower door stop receivers immediately adjacent thereto, so that the load carried by the locking straps during lifting of the folded container is carried by such door stop receivers rather than the bolts that secure the locking straps to the roof panel and base panel. At this point, locking of the roof panel to the base panel has been completed, and the folded container is ready to be moved, stacked, shipped or stored. At this point the spreader can lift the folded container to be stacked onto other folded containers for shipment to the intended destination.

Unfolding of the preferred embodiment of the present invention is essentially the reverse of the folding process, however when the roof panel has been raised to what was the highest point in the folding process, workers pull the door panel and front panel outwardly to properly position the tangs on the door panel above the interlocks in the base at the door end of the base panel, while workers position the interlocks at the bottom of the front posts over the base front tangs. The workers then hold these positions until the roof panel is lowered and the door tangs and base front tangs are received within the adjacent interlocks. The hammer locks located on the base panel adjacent the door end are then secured by driving each locking bolt through the hole in the adjacent interlock and into the hole in the door tang received therein, and the hammer locks located in the sill panel of the front panel are secured by driving each locking bolt through the hole in the adjacent interlock and into the hole in the base front tang received therein. Then the left and right side panels are lifted to their vertical, unfolded positions (assisted by the counterbalance provided by the springs in the spring tubes), and the locking bolts on the side panels are extended into the bolt holes on the roof panel to lock the left and right side panels to the roof panel. Then, the access panels are unfolded from the door panel and front panel so as to be parallel with the side panels, the slide locking mechanisms in the access panels are used to drive the slide locking bolts into the bolt holes in the right and left side panels, and the locking bolts on the access panels are extended into the bolt holes on the roof panel to lock the access panels to the roof panel. At this point the container is ready for use in shipping cargo.

As those skilled in the art will readily appreciate, the access panels allow workers to easily enter and exit the container to assist with the folding and unfolding of the side panels. If this flexibility is not desired, the side panels could be extended to span the entire length between the front panel and the door panel, and locking features could be added to the side panels to lock the side panels to the front panel and the door panel, thus eliminating the access panels altogether.

Figure 125:
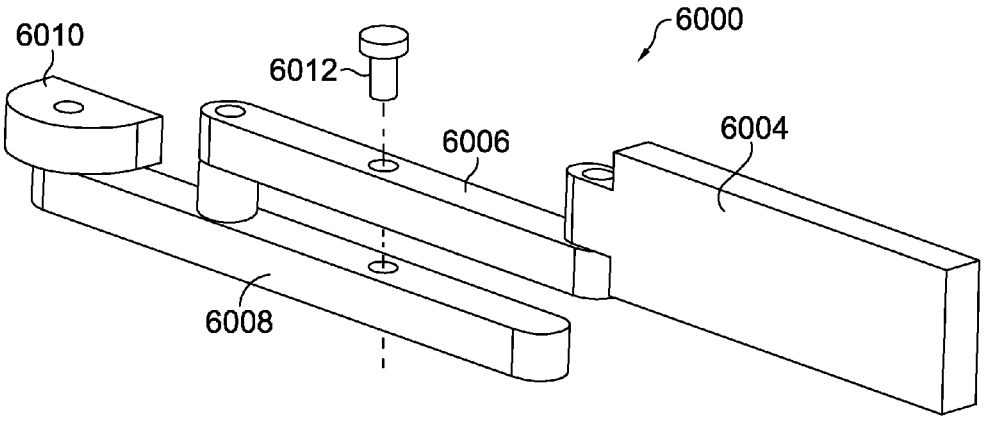

An alternate series of locking mechanisms for a collapsible container is provided in FIGS. 123-132. Referring now to FIGS. 123-129, elements forming an internal locking mechanism are depicted. More specifically, with respect to FIGS. 123-125, a locking plate assembly 6000 is depicted at the region between a side panel 14 and a corner post 6002. The locking plate assembly 6000 secures the front panel 12 and door panel 18 to the corner post 6002. More specifically, the locking plate assembly 6000 comprises a plate 6004 and a linkage bar 6006 with the linkage bar 6006 coupled to the plate 6004. Referring to FIG. 125, the plate 6004 has a generally rectangular shape. However, the specific size and shape of the plate 6004 can vary depending on the container geometry.

The locking plate assembly 6000 also comprises a lever arm 6008 that is coupled to the linkage bar 6006 and generally parallel to the linkage bar 6006. The lever arm 6008 has a hinge point 6010 at one end and is pivotable about the hinge point 6010. The locking plate assembly 6000 also includes a removable pin 6012 which, when installed between the linkage bar 6006 and the lever arm 6008, secures the locking plate assembly 6000 in its engaged position (with the plate 6004 positioned within corner post 6002).

The locking plate assembly 6000 is movable between an engaged position (where the plate 6004 engages the corner post 6002) and a disengaged position (where the plate 6004 has been slidably removed from the corner post 6002). More specifically, the plate 6004 engages and passes through a first opening 6014 in the corner post 6002. In order to engage the plate 6004 in the corner post 6002 a force is applied to the lever arm 6008 in a direction towards the side panel 14 such that the lever arm 6008 pivots about the hinge point 6010. Movement of the lever arm 6008 causes the linkage bar 6006 (and hence the plate 6004) to move laterally due to the connection point between the linkage bar 6006 and the lever arm 6008. A removable pin 6012 can then be placed through the linkage bar 6006 and the lever arm 6008 to lock the plate 6004 in place.

In an embodiment of the present invention, a collapsible shipping container utilizes four locking plate assemblies, one between each of four corner posts 6002 and an adjacent front panel 12 and door panel 18. Therefore, in order to collapse the container and permit the front panel 12 and door panel 18 to collapse, each of the four locking plate assemblies 6000 must be moved from an engaged (i.e. locked) position to a disengaged position, where the plate 6004 is removed from the corner post 6002.

The locking plate assembly 6000 is preferably fabricated from A514 or a similar high strength steel having an ultimate yield strength of 80 ksi or greater. Such a material is preferred for purposes of strength and corrosion resistance.

Figure 126:
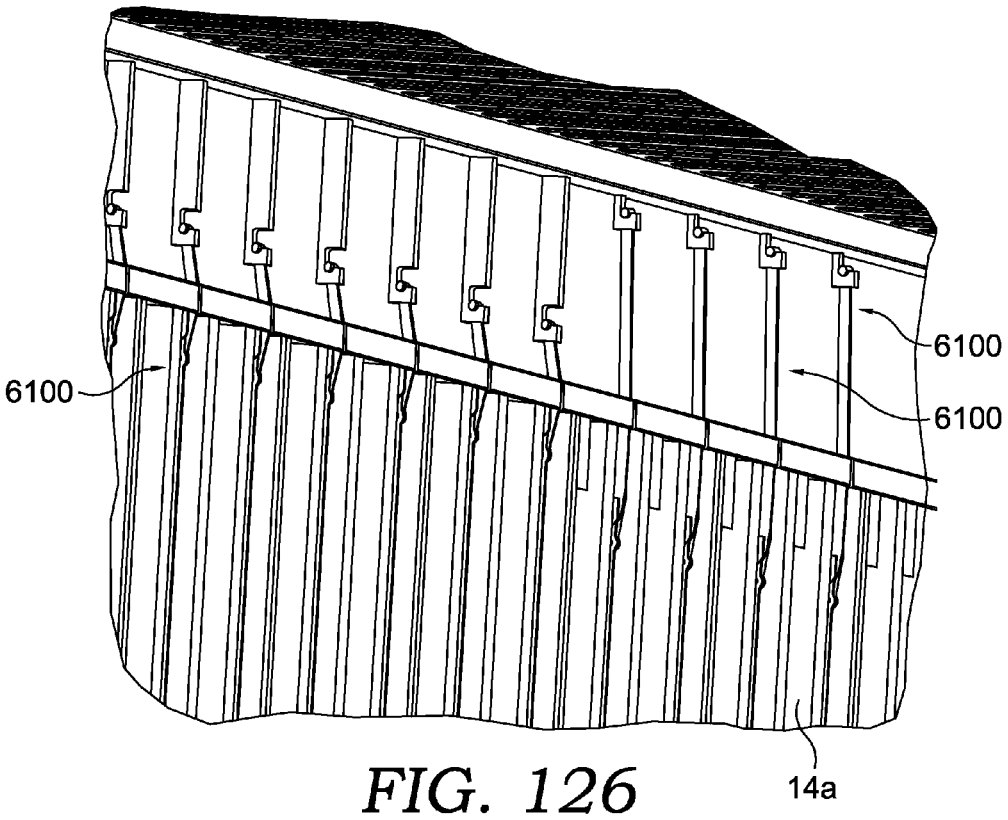

Referring now to FIGS. 126-129, an additional component of the internal locking system is depicted. Referring to FIG. 126, a partial perspective view of a plurality of lever latch assemblies 6100 is shown. The lever latch assemblies 6100 are positioned along an inner face or surface 14*a* of the of one or more side panels 14 and/or 16. As a result, the lever latch assemblies 6100 serve to removably engage the one or more side panels 14 and/or 16 to a skirt portion 23 and/or 24 of the roof panel 11.

Figure 129:
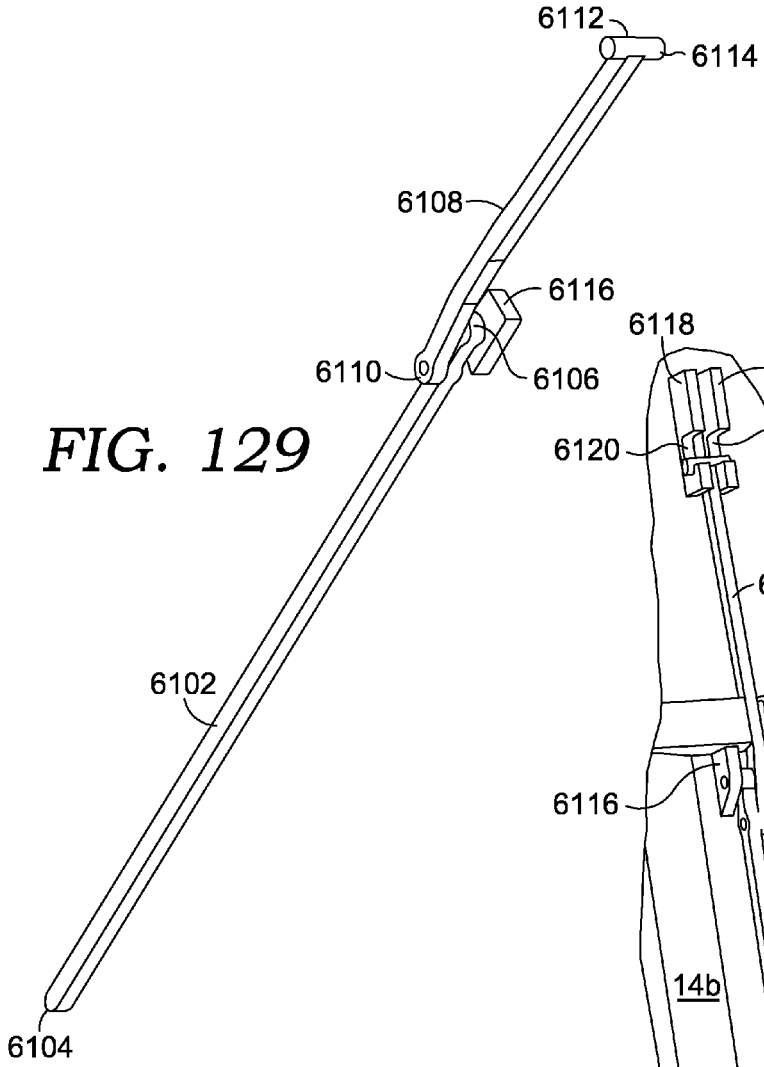
Figure 127:
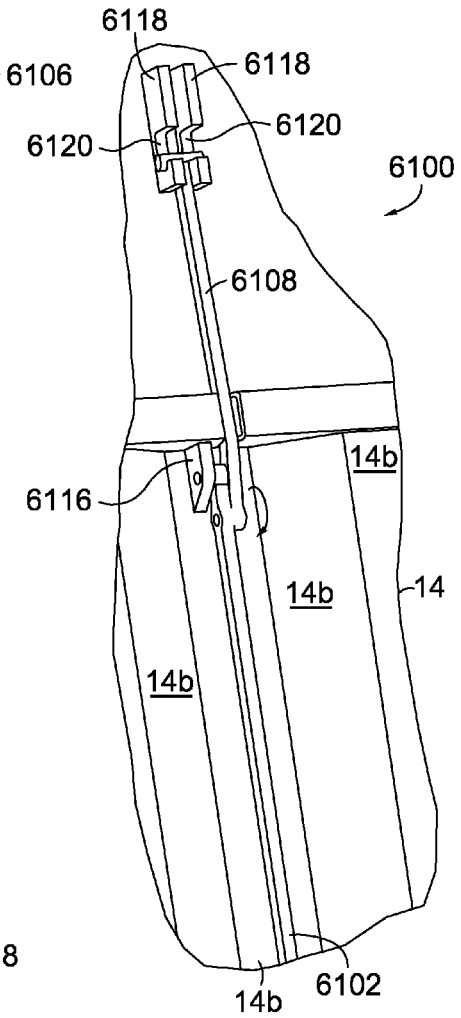
Figure 128:
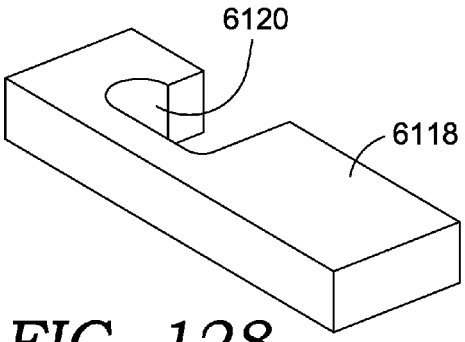

More specifically, the lever latch assembly 6100 is shown in more detail in FIGS. 127-129. The lever latch assembly 6100 comprises a lever arm 6102 having a first end 6104 and an opposing second end 6106. A lever latch 6108 is coupled to the lever arm 6102 and has a first end 6110 and an opposing second end 6112. The first end 6110 is coupled to the lever arm 6102 and the second end 6112 has a locking tab 6114. The lever latch assembly 6100 also comprises a base hinge 6116 that is coupled to the second end 6106 of the lever arm 6102.

Referring to FIGS. 127 and 128, the lever latch assembly 6100 also includes one or more capture plates 6118, with the plates 6118 having a recessed opening 6120 sized to receive the locking tab 6114. The recessed opening 6120 can take on a variety of shapes and configurations. For example, the capture plate 6118 shown in FIG. 128 has a generally U-shaped slot. The one or more capture plates 6118 are secured to the skirt 23 and 24 of the container 10 by a means such as welding. The one or more plates 6118 provide the region in which the locking tab 6114 engages. The lever latch assembly 6100 also comprises a removable pin (not shown) used to lock the lever latch assembly 6100 in an engaged or locked position. The removable pin can be placed on the lever arm 6102. A tab (not shown) can be placed long a corrugation 14*b* to which the removable pin would lock, thereby locking the lever latch assembly 6000. The lever latch assembly 6100 is preferably fabricated from A514 or a similar high strength steel having an ultimate yield strength of 80 ksi or greater.

Another feature of the lever latch assembly 6100 is the ability for the lever latch 6108 to rotate approximately 180 degrees such that it can be positioned generally parallel and adjacent to the lever arm 6102 or extending away from the lever arm 6102, as shown in FIG. 127. The side panel 14 has a series of corrugations 14*b* formed in the sheet metal wall making up the side panel 14. That is, according to an embodiment of the present invention, when the lever latch assembly 6100 is in a disengaged position, the lever latch 6108 can rotate to be positioned generally parallel and adjacent to the lever arm 6102 and thereby generally contained in the corrugations 14*b* of the side panel.

As discussed above, the lever latch assembly 6100 provides a system for locking the side panels 14 and 16 in place and for sealing the region between the side panels and the skirt portion 23 and/or 24 of the roof panel 11. In operation, to secure a side panel in place, the side panel is raised and the lever latch 6108 is rotated upwards towards the one or more capture plates 6118. Once the locking tab 6114 is positioned within the recessed opening 6120 of the capture plate 6118, a force is applied to the lever arm 6102, thereby causing the lever latch 6108 to pull downwards and securing the locking tab 6114 in the recessed opening 6120 of the one or more capture plates 6118. This process is repeated for each of the multiple lever latch assemblies 6100 located along the interior of the container 10.

As discussed above, when the side panels 14 and 16 are unlocked, these side panels can rotate to a collapsed condition where the side panels 14 and 16 are generally parallel to the roof panel 11 and base panel 18. In order to lower the side panels 14 and 16, with respect to the lever latch assembly 6100, it is necessary to disengage the lever latch assembly 6100 from the skirt 23 and/or 24.

In order to disengage the lever lock assemblies 6100 in preparation for folding the side panels, the above-described process is reversed. More specifically, a securing pin is removed and a force is applied to the lever arm 6102 in a direction away from the side panel. As a result of the force applied to the lever arm 6102, the lever arm 6102 pivots about the base hinge 6116, causing the lever latch 6108 to move in an upwards direction and releasing the locking tab 6114 from the recessed opening 6120 of the one or more capture plates 6118. Accordingly, the lever latch 6108 can then be pulled out of the one or more capture plates and rotated back to its disengaged position.

As it can be seen from FIG. 126, the lever latch assemblies 6100 can vary in geometry depending on the geometry of the skirts 23 and 24 and side panels 14 and 16. Specifically, the location of the one or more latch plates 6118 can vary as well as the respective lengths of the lever latch 6108 and lever arm 6102.

As discussed above, in one embodiment of the present invention, the locking plate assembly 6000 and the lever latch assembly 6100 are positioned generally along internal surfaces of the collapsible shipping container. However, in an alternate embodiment of the present invention, the locking plate assembly 6000 and the lever latch assembly 6100 can be positioned along exterior walls of the collapsible shipping container so as to be accessible from outside the container. Depending on the certification standards, such an arrangement for the locking plate assembly and lever latch assembly may be required. Given the relative uniform construction of the collapsible shipping container, it is understood that each of the locking mechanisms could be placed on the exterior of the collapsible container with relatively minor modifications to the design discussed above.

Figure 130:
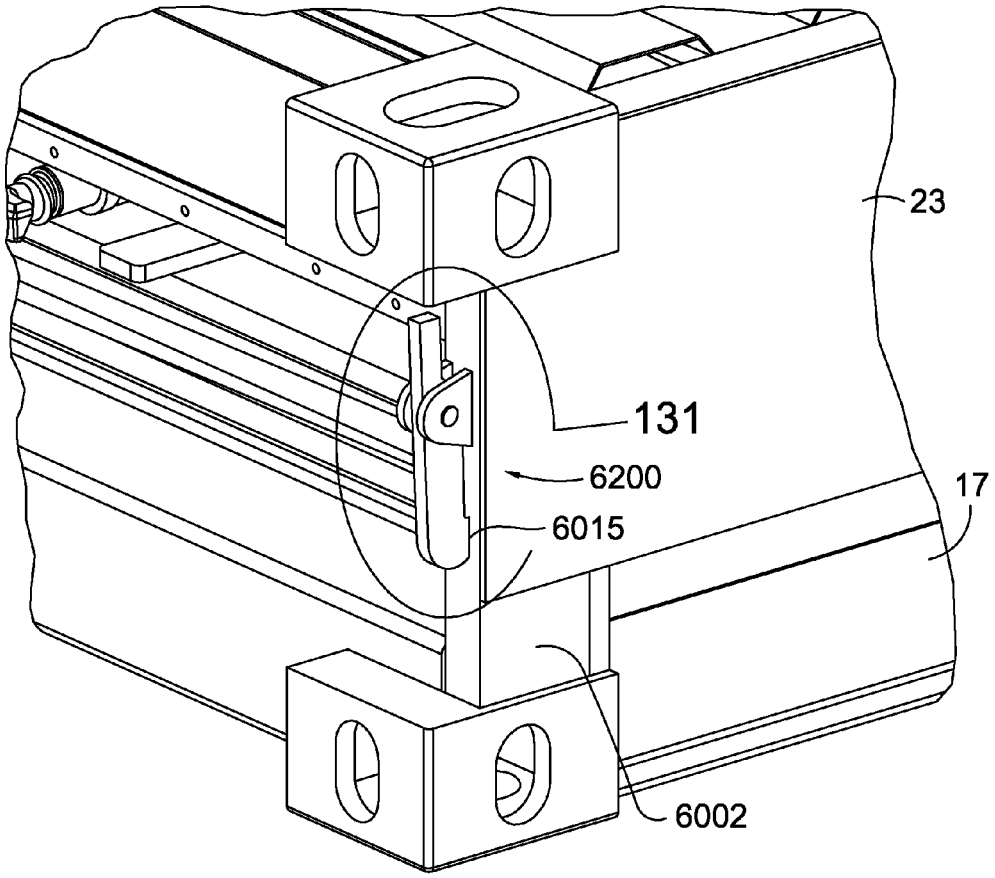
Figure 131:
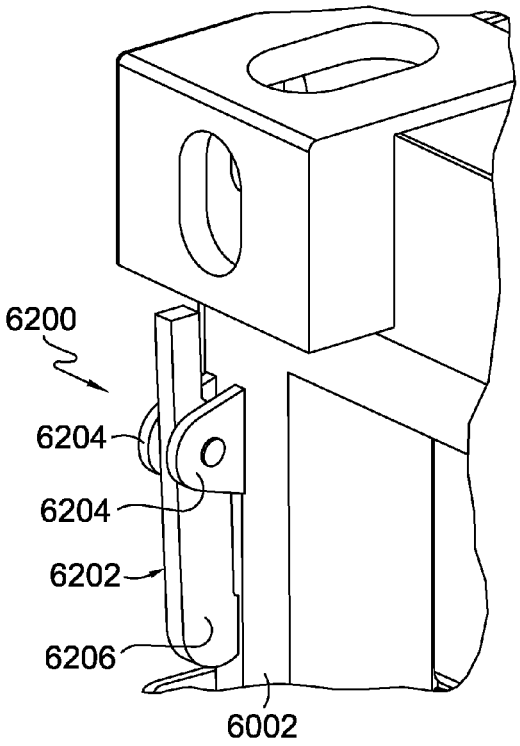
Figure 132:
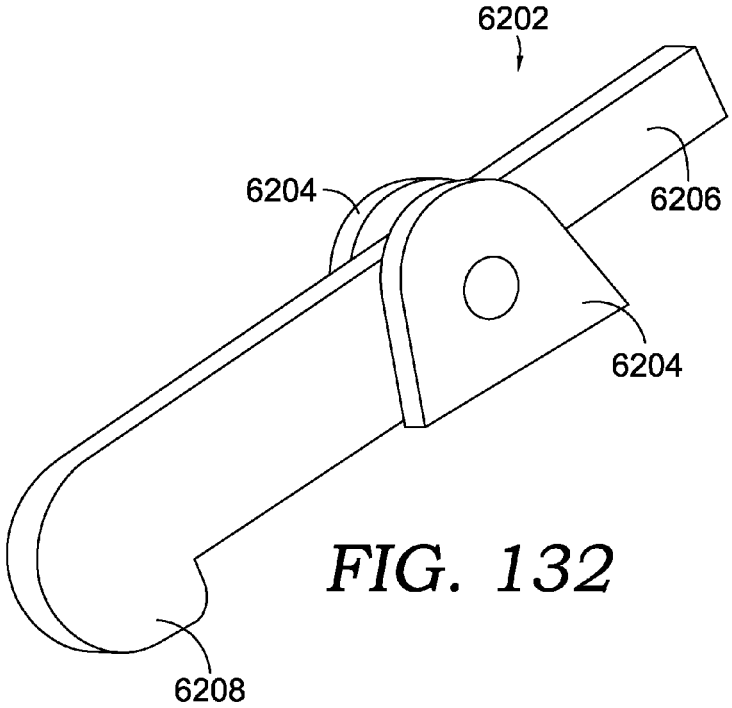

Referring now to FIGS. 130-132, an external locking mechanism 6200 for securing a shipping container in a collapsed condition is disclosed. More specifically, the external locking mechanism 6200 comprises one or more locking levers 6202 with each locking lever 6202 comprising a pair of mounting plates 6204 and an arm 6206. For the embodiment of the present invention shown, the mounting plates 6204 are secured adjacent a top skirt portion 23 and near a roof panel 11. The locking lever 6202 also comprises an arm 6206 that is pivotally mounted to the pair of mounting plates 6204. The arm 6206 has a locking tab 6208 at one end of the arm.

The external locking mechanism 6200 also comprises one or more corner posts 6002, which are adjacent to the base panel 17. The one or more corner posts 6002 contain a second opening 6015 sized to receive the locking tab 6208. The second opening 6015 is positioned opposite of the first opening 6014 discussed above and depicted in FIGS. 123 and 124.

The locking levers 6202 are biased so as to remain in an "engaged" or locked state by a bushing or other mechanism, such as a spring-loaded mechanism. Maintaining the locking levers 6202 in an engaged or use condition provides a fail-safe measure to ensure the locking levers 6202 are actively locking the container in a collapsed position, once the container has been folded. In order to disengage the locking lever 6202 and overcome its biased positioning, a force is applied to the arm 6206 at an end opposite of the locking tab 6208. The locking lever 6202 can further include a pin lock (not shown) for maintaining the locking lever in a locked position when in use.

For the embodiment of the present invention disclosed herein, two locking levers 6202 and corresponding corner posts 6002 are positioned adjacent a front panel 12 and an additional two locking levers 6202 and corresponding corner posts 6002 are positioned adjacent a door panel 18 of the container. Use of four locking levers 6202 provides sufficient locking redundancy and security for a collapsed storage container.

In an alternate embodiment of the present invention, a locking system for a collapsible shipping container is provided comprising a combination of the locking systems outlined in detail above. For example, the locking system comprises a plurality of locking plates for securing the front panel and door panel, a plurality of lever latch assemblies for securing the side panels, and a plurality of locking levers for securing the container when in a collapsed condition.

The above description clearly establishes the advantages provided by the present invention which need not be explained in greater detail to those skilled in the art, who will also recognize that various design modifications and differing components can be introduced within the scope of the present invention as set forth below.

While the invention has been described in what is known as presently the preferred embodiment, it is to be understood that the invention is not to be limited to the disclosed embodiment but, on the contrary, is intended to cover various modifications and equivalent arrangements within the scope of the following claims. The present invention has been described in relation to particular embodiments, which are intended in all respects to be illustrative rather than restrictive.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

I claim:

1. An internal locking system for a collapsible container comprising:

a plurality of locking plate assemblies positioned proximate side panels of the collapsible container for securing a front panel and door panel of the container to corner posts adjacent the front panel and door panel, the locking plate assemblies comprising:

a plate;

a linkage bar coupled to a lever arm at a first end and the plate at a second end;

the lever arm having a first and second end, the lever arm coupled to a hinge point at the first end and coupled to the linkage bar proximate the hinge point;

a removable pin for locking the linkage bar to the lever arm;

an aperture in the linkage bar for the removable pin to pass through, the aperture located between the first and second ends; and an aperture in the lever arm for the removable pin to pass through, the opening located between the second end of the lever arm and where the linkage bar is coupled to the lever arm;

wherein the lever arm is rotatable relative to the linkage bar and rotation of the lever arm causes the plate to slide in a lateral direction; and a plurality of lever latch assemblies positioned along an internal face of one or more side panels so as to removably engage the one or more side panels to a skirt portion of a roof panel.

2. The internal locking system of claim 1, wherein the plurality of locking plate assemblies are movable between an engaged and disengaged position.

3. The internal locking system of claim 1, wherein the plurality of lever latch assemblies each comprise:

a lever arm having a first end and an opposing second end;

a lever latch having a first end and an opposing second end, the first end of the lever latch coupled to the lever arm and the second end of the lever latch having a locking tab;

a base hinge coupled to the second end of the lever arm;

one or more capture plates having a recessed opening sized to receive the locking tab of the lever latch; and a removable pin.

4. The internal locking system of claim 3, wherein the one or more capture plates have a generally U-shaped slot for receiving the locking tab of the lever latch.

5. The internal locking system of claim 3, wherein the lever latch is pivotable approximately 180 degrees so as to be adjacent to the lever arm when the lever latch assembly is in a disengaged position.

6. The internal locking system of claim 1, wherein upon disengagement of the plurality of locking plate assemblies and the plurality of lever latch assemblies, the side panels, forward panel, and door panel are collapsible so as to be generally parallel with the roof panel and a base panel of the shipping container.

* * * * *